US008820106B2

(12) United States Patent
Wakamoto et al.

(10) Patent No.: US 8,820,106 B2
(45) Date of Patent: Sep. 2, 2014

(54) AIR CONDITIONING APPARATUS

(75) Inventors: Shinichi Wakamoto, Tokyo (JP); Koji Yamashita, Tokyo (JP); Takashi Okazaki, Tokyo (JP); Naoki Tanaka, Tokyo (JP); Keisuke Hokazono, Tokyo (JP); Hiroyuki Morimoto, Tokyo (JP); Yuji Motomura, Tokyo (JP); Takeshi Hatomura, Tokyo (JP); Tomohiko Kasai, Tokyo (JP); Naofumi Takenaka, Tokyo (JP); Yusuke Shimazu, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 931 days.

(21) Appl. No.: 12/990,391

(22) PCT Filed: Oct. 29, 2008

(86) PCT No.: PCT/JP2008/069596

§ 371 (c)(1),
(2), (4) Date: Jan. 10, 2011

(87) PCT Pub. No.: WO2009/133640

PCT Pub. Date: Nov. 5, 2009

(65) Prior Publication Data

US 2011/0088421 A1 Apr. 21, 2011

(30) Foreign Application Priority Data

Apr. 30, 2008 (JP) ..... 2008-118526

(51) Int. Cl.
*F25B 27/00* (2006.01)
*F25B 41/00* (2006.01)

(Continued)

(52) U.S. Cl.
USPC ..... 62/238.7; 62/196.1; 62/324.6; 62/527; 62/528; 62/513; 62/159; 62/160; 62/201; 62/504; 62/199; 62/200

(58) Field of Classification Search
CPC ..... F25B 43/00; F25B 41/00; F25B 27/00; F25B 13/00
USPC ..... 62/196.1, 324.6, 238.7, 527, 528, 513, 62/159, 160, 201, 504, 199, 200
See application file for complete search history.

(56) References Cited

U.S. PATENT DOCUMENTS 5,063,752 A 11/1991 Nakamura et al.

(Continued)

FOREIGN PATENT DOCUMENTS

EP 0575063 12/1993

(Continued)

OTHER PUBLICATIONS

U.S. Appl. No. 13/266,182, filed Oct. 25, 2011, Wakamoto, et al.

(Continued)

*Primary Examiner* — Mohammad M Ali
*Assistant Examiner* — Erik Mendoza-Wilkenfe
(74) *Attorney, Agent, or Firm* — Oblon, Spivak, McClelland, Maier & Neustadt, L.L.P.

(57) ABSTRACT

A heat source-side refrigerant circuit A including a compressor 11, an outdoor heat exchanger 13, a first refrigerant branch portion 21 connected to the compressor 11, a second refrigerant branch portion 22 and a third refrigerant branch portion 23 connected to the outdoor heat exchanger 13, a first refrigerant flow rate control device 24 provided between branch piping 40 and the second refrigerant branch portion 22, intermediate heat exchangers 25*n* connected at one side thereof to the first refrigerant branch portion 21 and the third refrigerant branch portion 23 via three-way valves 26*n* and connected at the other side thereof to the second refrigerant branch portion 22, and second refrigerant flow rate control devices 27*n* provided between the respective intermediate heat exchangers 25*n* and the second refrigerant branch portion 22, and user-side refrigerant circuits Bn having indoor heat exchangers 31*n* connected respectively to the intermediate heat exchangers 25*n* are provided, and at least one of water and an anti-freeze solution circulates in the user-side refrigerant circuits Bn.

16 Claims, 30 Drawing Sheets

(51) Int. Cl.

| | |
|---|---|
| ***F25B 29/00*** | (2006.01) |
| ***F25B 43/00*** | (2006.01) |
| ***F25B 39/02*** | (2006.01) |
| ***F02B 5/00*** | (2006.01) |

(56) References Cited

U.S. PATENT DOCUMENTS

| | | | | |
|---|---|---|---|---|
| 5,156,014 | A | 10/1992 | Nakamura et al. | |
| 5,237,833 | A | 8/1993 | Hayashida et al. | |
| 6,467,279 | B1 * | 10/2002 | Backman et al. | 62/79 |
| 7,637,315 | B2 * | 12/2009 | Ichinose et al. | 165/295 |
| 7,716,934 | B2 * | 5/2010 | Ebara | 62/113 |
| 2006/0254294 | A1 * | 11/2006 | Shimamoto et al. | 62/238.7 |
| 2009/0241575 | A1 * | 10/2009 | Jadric et al. | 62/259.1 |

FOREIGN PATENT DOCUMENTS

| | | | |
|---|---|---|---|
| EP | 0887599 | | 12/1998 |
| JP | 2 118372 | | 5/1990 |
| JP | 5 302737 | | 11/1993 |
| JP | 8 261599 | | 10/1996 |
| JP | 9-138030 | | 5/1997 |
| JP | 2001 289465 | | 10/2001 |
| JP | 2001-289465 | * | 10/2001 |
| JP | 2002-106995 | A | 4/2002 |
| JP | 2003 343936 | | 12/2003 |
| JP | 2004-53069 | A | 2/2004 |
| JP | 2004 60956 | | 2/2004 |
| JP | 2005 140444 | | 6/2005 |
| JP | 2005 282935 | | 10/2005 |
| JP | 2006 3079 | | 1/2006 |
| JP | 2007-147203 | A | 6/2007 |
| JP | 2007 183045 | | 7/2007 |

OTHER PUBLICATIONS

U.S. Appl. No. 13/266,247, filed Oct. 26, 2011, Takenaka, et al.
Chinese Office Action issued May 15, 2012, in China Patent Application No. 200880128930.8 (with English Translation).
International Search Report issued Jan. 6, 2009 in PCT/JP08/69596 filed Oct. 29, 2008.
Japanese Office Action issued Aug. 14, 2012 in Patent Application No. 2010-509996 wih English Translation.
Office Action issued on Apr. 2, 2013 in the corresponding Chinese Patent Application No. 200880128930.8 (with English Translation).
U.S. Appl. No. 12/990,568, filed Nov. 1, 2010, Wakamoto, et al.
Extended European Search Report dated Jun. 3, 2014 in European Patent Application No. 08874117.8.

* cited by examiner

AIR CONDITIONING APPARATUS

TECHNICAL FIELD

The present invention relates to an air conditioning apparatus, and more specifically, to a multi-chamber type air conditioning apparatus having a plurality of indoor units and being capable of performing a cooling-heating simultaneous operation.

BACKGROUND ART

As a multi-chamber type air conditioning apparatus in the related art having a plurality of indoor units and being capable of performing a cooling-heating simultaneous operation, for example, a configuration such as "Reference numeral (1) designates a compressor, (2) designates a four-way valve configured to switch the direction of flow of a refrigerant in a heat source unit, (3) designates a heat source unit-side heat exchanger, and (4) designates an accumulator being connected to the apparatuses (1) to (3), whereby a heat source unit (A) is configured. Reference numeral (5) designates three indoor-side heat exchangers, (6) designates first connecting piping that connects the four-way valve (2) of the heat source unit (A) and a relay (E), (6*b*), (6*c*), (6*d*) designate indoor unit-side first connecting piping that connects the indoor-side heat exchangers (5) of indoor units (B), (C), (D) and the relay (E) respectively to correspond to the first connecting piping (6), (7) designates second connecting piping that connects the heat source unit-side heat exchanger (3) of the heat source unit (A) and the relay (E), (7*b*), (7*c*), (7*d*) designate indoor unit-side second connecting piping that connects the indoor-side heat exchangers (5) of the indoor units (B), (C), and (D) and the relay (E) respectively to correspond to the second connecting piping, (8) designates three-way switching valves that switchably connect the indoor unit-side first connecting piping (6*b*), (6*c*), and (6*d*) and the first connecting piping (6) or the second connecting piping (7), and (9) designates first flow rate control devices connected in proximity to the indoor-side heat exchangers (5), configured to be controlled each depending on a super heat amount at the time of cooling and a subcool amount at the time of heating on the sides of exits of the indoor-side heat exchangers (5), and connected to the indoor unit-side second connecting piping (7*b*), (7*c*), (7*d*). Reference numeral (10) designates a first branch portion including the indoor unit-side first connecting piping (6*b*), (6*c*), (6*d*) and the three-way switching valves (8) that are switchably connected to the first connecting piping (6) or the second connecting piping (7), (11) designates a second branch portion including the indoor unit-side second connecting piping (7*b*), (7*c*), (7*d*) and the second connecting piping (7), and (12) designates freely openable and closable second flow rate device that connects the first branch portion (10) and the second branch portion (11) of the second connecting piping (7)." (see Patent Document 1, for example) is proposed.

Also, for example, a configuration such as "A compressor 11 for compressing refrigerant gas, outdoor heat exchangers 12*a*, 12*b*, 13*a*, 13*b*, a blower (not shown) for blowing outside air to outdoor heat exchangers 12*a*, 12*b*, an accumulator 14 for preventing liquid return to the compressor 11, shut-off valves 15, 16, 17, 18, 19, 20, and piping for connecting these components are built in an outdoor unit 10. In contrast, intermediate heat exchangers 53*a* and 54*a* provided in third piping 85*a* and 86*a* connected in an annular shape in the first piping, third restrictors 55*a* and 56*a*, and three-way valves 51*a* and 52*a* for connecting an indoor unit 30*a* and either one of the intermediate heat exchanger 53*a* or 54*a* are built in a branch unit 50*a*. Here, the positions of installation of the intermediate heat exchangers 53*a* and 54*a* are installed so that a natural circulation operation in which an indoor heat exchanger 31*a* is used as an evaporator is established at the time of cooling operation and a natural circulation operation in which the indoor heat exchanger 31*a* is used as a condenser is established at the time of heating operation. Also, the branch unit 50*a* is connected to the indoor unit 30*a* via gas piping 83*a* and liquid piping 84*a*. Terminal ends of high-pressure piping 81 and low-pressure piping 82 are connected via a first restrictor 71 built in a terminal end unit 70, and a pressure detector 73 and a first temperature detector 72 are provided in the terminal end unit 70. Also, the indoor heat exchanger 31*a*, a second restrictor 32*a* that adjusts the flow rate of the refrigerant flowing in the indoor heat exchanger 31*a*, a blower (not shown) for forcedly blowing indoor air to an outer surface of the indoor heat exchanger 31*a*, and piping for connecting these components are built in the indoor unit 30*a*. Furthermore, a second temperature detector 33*a* is provided on a gas side of the indoor unit 30*a*, and a third temperature detector 34*a* is provided on a liquid side thereof. One end of the indoor heat exchanger 31*a* is connected to the liquid piping 84*a* via the second restrictor 32*a*, and the other end thereof is connected to the gas piping 83*a*." (see Patent Document 2, for example) is proposed.

Patent Document 1: Japanese Unexamined Patent Application Publication No. 2-118372 (p. 3, FIG. 1)

Patent Document 2: Japanese Unexamined Patent Application Publication No. 2003-343936 (paragraphs 0029 to 0031, FIG. 1)

DISCLOSURE OF INVENTION

Problems to be Solved by the Present Invention

An allowable concentration of a refrigerant leaking into a space such as indoors is determined by an international standard considering influences exerted on human bodies such as toxicity of the refrigerant or combustibility thereof. The allowable concentrations of the refrigerant leaking into the room are determined, for example, 0.44 kg/m$^3$ for R410A, which is one of fluorocarbons refrigerants, 0.07 kg/m$^3$ for $CO_2$, and 0.008 kg/m$^3$ for propane.

Since the multi-chamber type air conditioning apparatus in the related art described in Patent Document 1 is made up of one refrigerant circuit, when the refrigerant leaks into the space such as indoors, an entire part of the refrigerant in the refrigerant circuit leaks into the space. The multi-chamber type air conditioning apparatus in this configuration may use a refrigerant of several tens kg or more. Therefore, there is a problem that when the refrigerant leaks into the space such as the room, the refrigerant concentration in the space may exceed the above-described allowable concentration.

The multi-chamber type air conditioning apparatus in the related art described in Patent Document 2 includes a heat source-side refrigerant circuit (heat source-side refrigerant cycle) provided in an outdoor unit and a branch unit, and a user-side refrigerant circuit (user-side refrigerant cycle) provided in the indoor unit and the branch unit divided from each other. Therefore, the refrigerant leaking into the space such as the room is smaller than the multi-chamber type air conditioning apparatus in the related art described in Patent Document 1. However, there still remains a problem that when the refrigerant leaks in the space such as the room, the refrigerant concentration in the space may still exceed the above-described allowable concentrations.

In order to solve the problems as described above, it is an object of the present invention to provide a multi-chamber type air conditioning apparatus which is capable of performing a cooling-heating simultaneous operation, and is capable of preventing a refrigerant whose allowable concentration is kept under control from leaking into a space such as a room.

Means for Solving the Problems

An air conditioning apparatus according to the present invention which allows selection of either one of a cooling operation and a heating operation for respective indoor units independently includes: an outdoor unit having a compressor and an outdoor heat exchanger provided therein; a plurality of the indoor units each provided with an indoor heat exchanger; and relay units interposed between these units, including: a heat source-side refrigerant circuit, the heat source-side refrigerant circuit including: the outdoor heat exchanger connected at one end thereof to an end of the compressor; a second refrigerant branch portion and a third refrigerant branch portion connected to the other end of the outdoor heat exchanger via branch piping; a first refrigerant flow rate control device configured to control the flow rate of a heat source-side refrigerant flowing in the second refrigerant branch portion; a plurality of intermediate heat exchangers each connected at one end thereof to the first refrigerant branch portion and the third refrigerant branch portion via a first refrigerant flow channel switching device and connected at the other end thereof to the second refrigerant branch portion, and a plurality of second refrigerant flow rate control devices configured to control the flow rate of the heat source-side refrigerant flowing between the respective intermediate heat exchangers and the second refrigerant branch portions; and a plurality of user-side refrigerant circuits including: a circulating device connected at one end of a user-side circuit configured to perform a heat exchange with respect to the heat source-side refrigerant circuit of the intermediate heat exchanger; and an indoor heat exchanger connected at one end thereof to the circulating device and is connected at the other end thereof to the other end of the user-side circuit of the intermediate heat exchanger, wherein the first refrigerant branch portion, the branch piping, the second refrigerant branch portion, the third refrigerant branch portion, the first refrigerant flow rate control device, the intermediate heat exchanger, the first refrigerant flow channel switching device, the second refrigerant flow rate control device, and the circulating device are provided in the relay unit, and at least one of water and antifreeze solution as the user-side refrigerant circulates in at least one of the plurality of user-side refrigerant circuits.

Advantages

In the present invention, at least one of the water and the antifreeze solution circulates in at least one of the plurality of user-side refrigerant circuits. Therefore, the refrigerant whose allowable concentration is kept under control is prevented from leaking into a space where people exist by circulating at least one of the water and the antifreeze solution in the user-side refrigerant circuit installed in, for example, the space where people exist (living spaces, or spaces where people come and go, etc.). With the configuration of this refrigerant circuit, the plurality of indoor units are capable of performing a cooling and heating simultaneous operation.

REFERENCE NUMERALS

1 air conditioning apparatus, 10 outdoor unit, 11 compressor, 12 four-way valve, 13 outdoor heat exchanger, relay unit, 21 first refrigerant branch portion, 22 second refrigerant branch portion, 23 third refrigerant branch portion, 24 first refrigerant flow rate control device, 25*n* intermediate heat exchanger, 26*n* three-way valve, 27*n* second refrigerant flow rate control device, 28*n* pump, 30*n* indoor unit, 31*n* indoor heat exchanger, 40 branch piping, 41 first extension piping, 42 second extension piping, 43*n* third extension piping, 44*n* fourth extension piping, 50 refrigerant flow channel switching unit, 51 first check valve, 52 second check valve, 53 third check valve, 54 fourth check valve, 61 gas-liquid separating device, 62 bypass piping, 63 third refrigerant flow rate control device, 64*n* first temperature sensor, 65*n* second temperature sensor, 66*n* inverter, 70 opening and closing device, 80 user-side refrigerant flow channel switching unit, 81*n* first switching valve, 82*n* second switching valve, 90 second refrigerant flow channel switching unit, 91*n* fifth check valve, 92*n* sixth check valve, 93 heat exchanger, 94 second bypass piping, 95 fourth refrigerant branch portion, 100 building, 111-113 living space, 121-123 shared space, 130 piping-installed space, A heat source-side refrigerant circuit, Bn user-side refrigerant circuit.

BEST MODES FOR CARRYING OUT THE PRESENT INVENTION

Embodiment 1

Figure 1:
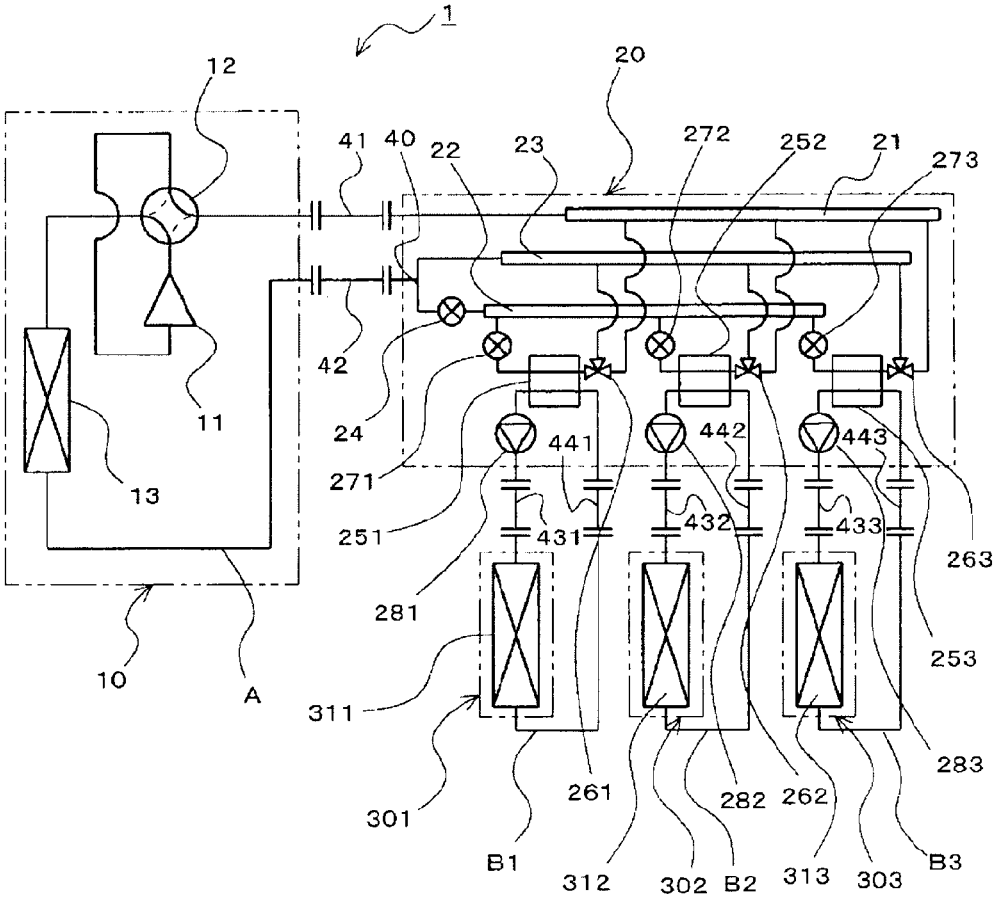
FIG. 1 is a refrigerant circuit diagram of an air conditioning apparatus according to Embodiment 1 in the present invention.

FIG. 1 is a refrigerant circuit diagram of an air conditioning apparatus according to Embodiment 1 in the present invention.

An air conditioning apparatus 1 includes a heat source-side refrigerant circuit A having an outdoor heat exchanger 13 configured to perform a heat exchange with outdoor air, and user-side refrigerant circuits Bn having indoor heat exchangers 31*n* (hereinafter, n represents 1 and larger natural numbers, and represents the number of units of the indoor heat exchangers) configured to perform the heat exchange with indoor air. A heat source-side refrigerant circulating in the heat source-side refrigerant circuit A and the user-side refrigerant circulating in the user-side refrigerant circuits Bn perform the heat exchange each other in intermediate heat exchangers 25*n*. Then, respective components in the heat source-side refrigerant circuit A and the user-side refrigerant circuits Bn are provided in an outdoor unit 10, a relay unit 20, and indoor units 30*n*. In Embodiment 1, water is used as the user-side refrigerant.

In Embodiment 1, although the number of the indoor units 30*n* is three (n=3), it may be two or three or more. The number of the relay units 20 is not limited to one, and a plurality of pieces may be provided. In other words, the present invention may be implemented in a configuration in which a plurality of indoor units are provided in each of the plurality of relay units. Also, a plurality of the outdoor units 10 can be provided according to an output load.

The heat source-side refrigerant circuit A includes a compressor 11, a four-way valve 12, the outdoor heat exchanger 13, a first refrigerant branch portion 21, a second refrigerant branch portion 22, a third refrigerant branch portion 23, a first refrigerant flow rate control device 24, intermediate heat exchangers 251-253, three-way valves 261-263, and second refrigerant flow rate control devices 271-273. Here, the four-way valve 12 and the three-way valves 261-263 correspond to a second refrigerant flow channel switching device and a first refrigerant flow channel switching device in the present invention, respectively.

The compressor 11 is connected to the four-way valve 12 configured to switch the direction of flow of the heat source-side refrigerant being discharged from the compressor 11. The four-way valve 12 is connected to the first refrigerant branch portion 21 via first extension piping 41. The outdoor heat exchanger 13 is connected at one side thereof to the four-way valve 12, and at the other side thereof to the second refrigerant branch portion 22 and the third refrigerant branch portion 23 via second extension piping and branch piping 40. Also, provided between the branch piping 40 and the second refrigerant branch portion 22 is the first refrigerant flow rate control device 24. The intermediate heat exchangers 251-253 each are connected at one side thereof to the second refrigerant branch portion 22 via each of the second refrigerant flow rate control devices 271-273, and at the other side thereof to the first refrigerant branch portion 21 and the third refrigerant branch portion 23 via each of the three-way valves 261-263.

The user-side refrigerant circuit B includes the intermediate heat exchangers 251-253, pumps 281-283, and indoor heat exchangers 311-313. The outdoor heat exchangers 311-313 each are connected at one side thereof to each of the intermediate heat exchangers 251-253 via each of third extension piping 431-433 and each of the pumps 281-283. Each of the other sides thereof are connected to each of the intermediate heat exchangers 251-253 via each of fourth extension piping 441-443. Here, the pumps 281-283 correspond to a circulating device in the present invention.

The outdoor unit 10 includes the compressor 11, the four-way valve 12, and the outdoor heat exchanger 13 as components of the heat source-side refrigerant circuit A. The relay unit 20 includes the first refrigerant branch portion 21, the second refrigerant branch portion 22, the third refrigerant branch portion 23, the first refrigerant flow rate control device 24, the intermediate heat exchangers 251-253, the three-way valves 261-263, and the second refrigerant flow rate control devices 271-273. The relay unit 20 is provided with the pumps 281-283 as components of the user-side refrigerant circuit. The indoor units 301-303 are provided with the indoor heat exchangers 311-313, respectively, as components of the user-side refrigerant circuit.

In order to allow separation of the outdoor unit 10 and the relay unit 20, the first extension piping 41 being separable by, for example, a connecting device such as a joint or a valve is provided between the four-way valve 12 and the first refrigerant branch portion 21. Provided between the outdoor heat exchanger 13 and the branch piping 40 is second extension piping 42 being separable by the connecting device such as the joint or the valve. In order to allow separation of the relay unit 20 and the indoor unit, the third extension piping 431-433 each being separable by, for example, the connecting device such as the joint or the valve are provided between the pumps 281-283 and the indoor heat exchangers 311-313. Provided between the indoor heat exchangers 311-313 and the intermediate heat exchangers 251-253 are the fourth extension piping 441-443 each being separable by, for example, the connecting device such as the joint or the valve.

(Operating Actions)

Subsequently, operating actions of the air conditioning apparatus 1 in Embodiment 1 will be described. The operating actions of the air conditioning apparatus 1 include four modes; a cooling operation mode, a heating operation mode, a cooling-dominated operation mode, and a heating-dominated operation mode.

The cooling operation mode is an operation mode in which the indoor units 30*n* are capable of cooling only. The heating operation mode is an operation mode in which the indoor units 30*n* are capable of heating only. The cooling-dominated operation mode is an operation mode which allows selection of either the cooling operation or the heating operation for the respective indoor units 30*n* independently, and is a mode used when a cooling load is larger than a heating load. The heating-dominated operation mode is an operation mode which allows selection of either the cooling operation or the heating operation for the respective indoor units 30*n* independently, and is a mode used when the heating load is larger than the cooling load.

(Cooling Operation Mode)

First of all, the cooling operation mode will be described.

Figure 2:
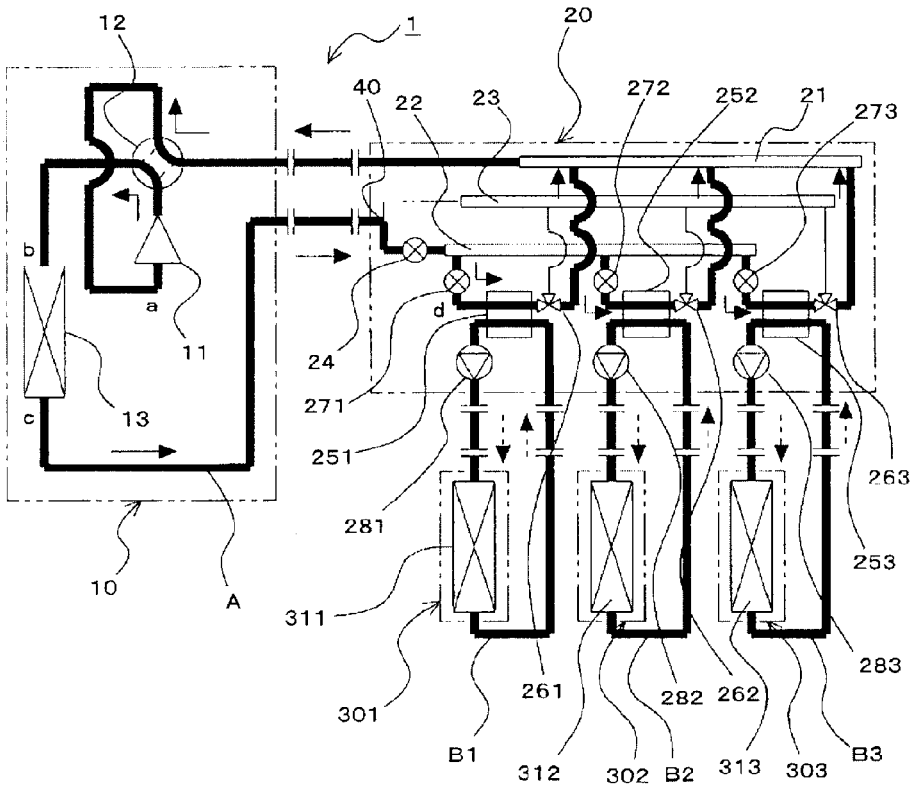
FIG. 2 is a refrigerant circuit diagram showing a flow of a refrigerant in a cooling operation mode of the air conditioning apparatus according to Embodiment 1 in the present invention.
Figure 3:
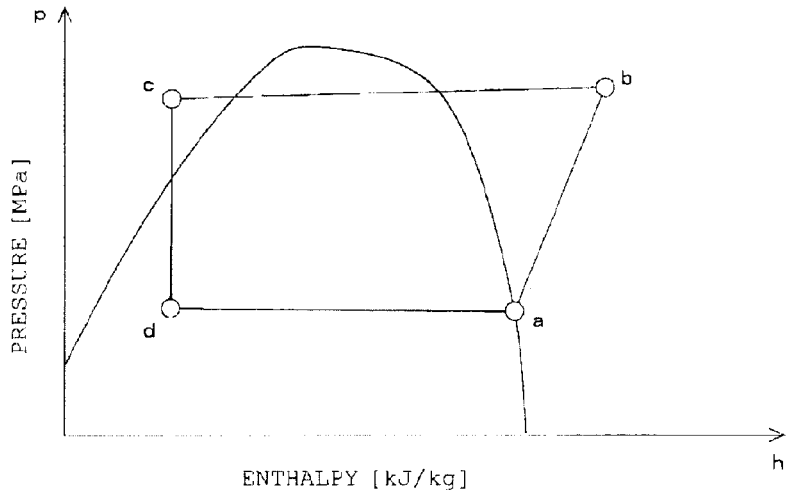
FIG. 3 is a p-h diagram showing a change of a heat source-side refrigerant in FIG. 2.

FIG. 2 is a refrigerant circuit diagram showing a flow of a refrigerant in the cooling operation mode of the air conditioning apparatus according to Embodiment 1 in the present invention. FIG. 3 is a p-h diagram showing a change in a heat source-side refrigerant in the cooling operation mode.

In FIG. 2, piping illustrated in thick lines indicates piping in which the refrigerant circulates. Then, the direction of flow of the heat source-side refrigerant is indicated by arrows of solid lines, and the direction of flow of water as the user-side refrigerant is indicated by arrows of broken lines. The states of refrigerant a-d shown in FIG. 3 indicate the states of the refrigerant at points indicated by reference signs a-d in FIG. 2, respectively.

When all the indoor units 301-303 perform the cooling operation, the four-way valve 12 is switched to allow the heat source-side refrigerant being discharged from the compressor 11 to flow toward the outdoor heat exchanger 13. In other words, the four-way valve 12 is switched to allow the heat source-side refrigerant being discharged from the first refrigerant branch portion 21 of the relay unit 20 to flow into the compressor 11. The three-way valves 261-263 each are switched to allow the respective intermediate heat exchangers 251-253 to communicate with the first refrigerant branch portion 21. The respective second refrigerant flow rate control devices 271-273 restrict the degrees of openings thereof. The first refrigerant flow rate control device 24 increases the degree of opening thereof to a fully opened state. In this state, the operations of the compressor 11 and the pumps 281-283 are started.

First of all, the flow of the refrigerant in the heat source-side refrigerant circuit A will be described. The low-temperature low-pressure vapor-state refrigerant is compressed by the compressor 11 and is discharged as the high-temperature high-pressure refrigerant. A refrigerant compression process of the compressor 11 is expressed by an isentropic curve as shown from the point a to b in FIG. 3 on the assumption that heat entry and exit with respect to the periphery does not occur. The high-temperature high-pressure refrigerant being discharged from the compressor 11 passes through the four-way valve 12 and flows into the outdoor heat exchanger 13. Then, the refrigerant is transformed into condensed liquid while dissipating heat to the outdoor air in the outdoor heat exchanger 13, thereby becoming a high-pressure liquid-state refrigerant. The change of the refrigerant in the outdoor heat exchanger 13 is performed under a substantially constant pressure. The change of the refrigerant at this time is expressed by a line slightly inclined but substantially horizontal as shown from the point b to c in FIG. 3 when considering a pressure loss of the outdoor heat exchanger 13.

The high-pressure liquid-state refrigerant flowing out from the outdoor heat exchanger 13 passes through the second extension piping 42 and the first refrigerant flow rate control device 24 and flows into the second refrigerant branch portion 22. The high-pressure liquid-state refrigerant flowing into the second refrigerant branch portion 22 is branched from the second refrigerant branch portion 22 and flows into the second refrigerant flow rate control devices 271-273. Then, the high-pressure liquid-state refrigerant is restricted and then is expanded (decompressed) in the second refrigerant flow rate control devices 271-273, thereby assuming a low-temperature low-pressure gas-liquid two-phase state. The changes of the refrigerant in the second refrigerant flow rate control devices 271-273 are performed under a constant enthalpy. The change of the refrigerant at this time is expressed by a vertical line as shown from the point c to d in FIG. 3.

The low-temperature low-pressure refrigerant flowing out from the second refrigerant flow rate control devices 271-273 flows into the intermediate heat exchangers 251-253, respectively. Then, the refrigerant absorbs heat from the water flowing in the intermediate heat exchangers 251-253, thereby becoming low-temperature low-pressure vapor-state refrigerant. The change of the heat source-side refrigerant in the intermediate heat exchangers 251-253 is performed under a substantially constant pressure. The change of the refrigerant at this time is expressed by a line slightly inclined but substantially horizontal as shown from the point d to a in FIG. 3 when considering a pressure loss of the intermediate heat exchangers 251-253.

The low-temperature low-pressure vapor-state refrigerant flowing out from the intermediate heat exchangers 251-253 passes through the three-way valves 261-263 respectively, and flows into the first refrigerant branch portion 21. The low-temperature low-pressure vapor-state refrigerant joining in the first refrigerant branch portion 21 flows into the compressor 11 through the first extension piping 41 and the four-way valve 12, and is compressed therein.

Since the low-temperature low-pressure vapor-state refrigerant flowing into the compressor 11 passes through the piping, the pressure is lowered slightly in comparison with the low-temperature low-pressure vapor-state refrigerant immediately after leaving the intermediate heat exchangers 251-253, but in FIG. 3, it is expressed by the same point a. In the same manner, since the high-pressure liquid-state refrigerant flowing into the second refrigerant flow rate control devices 271-273 passes through the piping, the pressure is lowered slightly in comparison with the high-pressure liquid-state refrigerant flowing out from the outdoor heat exchanger 13, but in FIG. 3, it is expressed by the same point c. A pressure loss of the refrigerant caused by the passage through the piping as described above, or the above-described pressure loss of the outdoor heat exchanger 13 and the intermediate heat exchangers 251-253 are the same also in the heating operation mode, the cooling-dominant operating mode, and the heating-dominant operating mode described below, and hence the description will be omitted except for a case where it is necessary.

Subsequently, the flow of the refrigerant in the user-side refrigerant circuit B will be described.

The water cooled by the heat source-side refrigerant flowing in the intermediate heat exchangers 251-253 flows into the indoor heat exchangers 311-313 through the pumps 281-283. Then, the water absorbs heat from the indoor air in the indoor heat exchangers 311-313 to cool the interior of the room in which the indoor units 301-303 (the indoor heat exchangers 311-313) are provided. Subsequently, the water flowing out from the indoor heat exchangers 311-313 flows into the intermediate heat exchangers 251-253.

(Heating Operation Mode)

Subsequently, the heating operation mode will be described.

Figure 4:
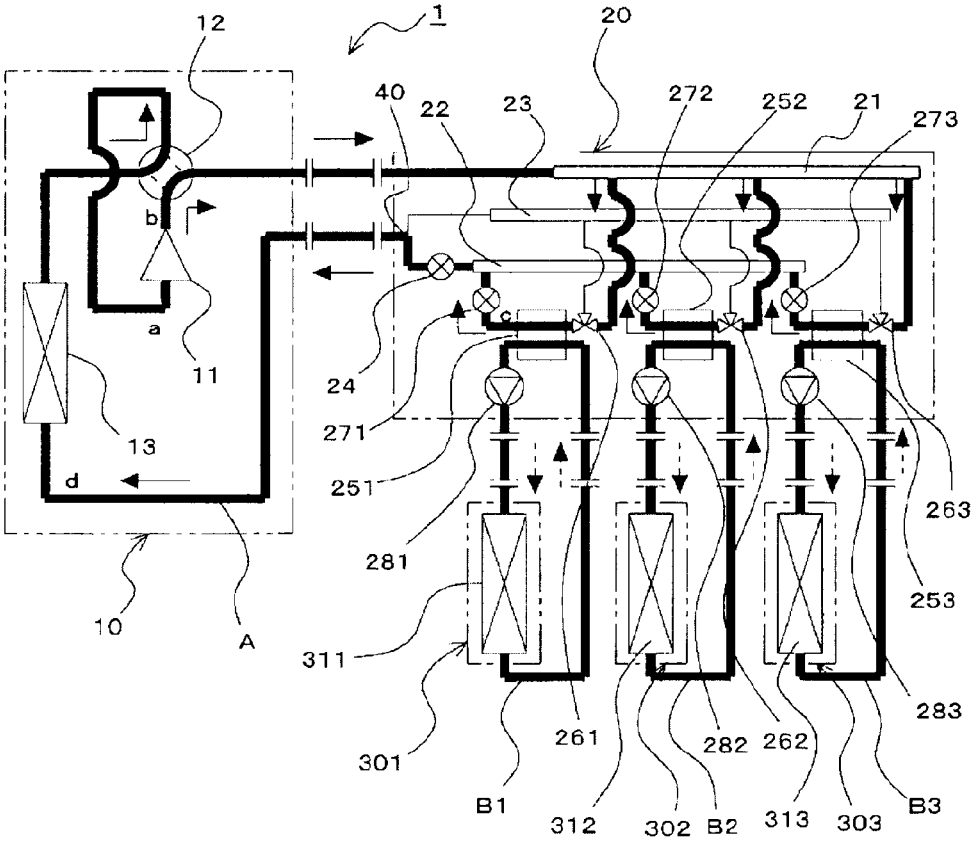
FIG. 4 is a refrigerant circuit diagram showing the flow of the refrigerant in a heating operation mode of the air conditioning apparatus according to Embodiment 1 in the present invention.
Figure 5:
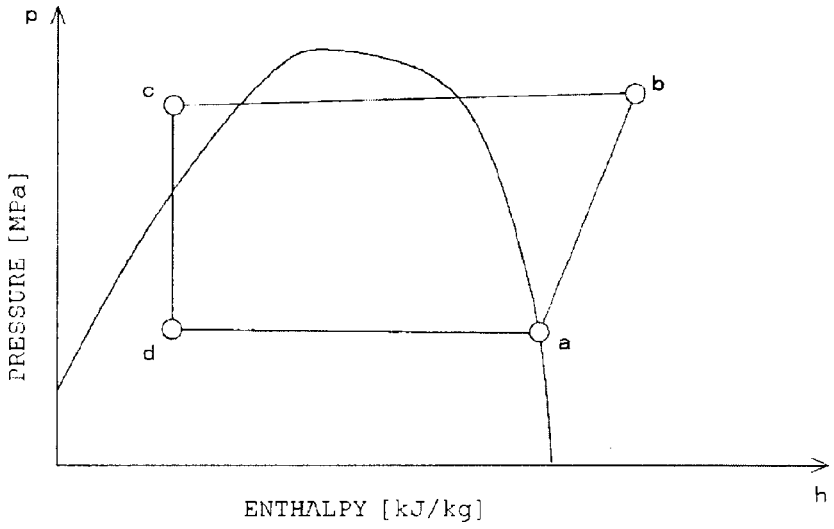
FIG. 5 is a p-h diagram showing the change of the heat source-side refrigerant in FIG. 4.

FIG. 4 is a refrigerant circuit diagram showing the flow of the refrigerant in the heating operation mode of the air conditioning apparatus according to Embodiment 1 in the present invention. FIG. 5 is a p-h diagram showing the change of the heat source-side refrigerant in the heating operation mode.

In FIG. 4, piping illustrated in thick lines indicates piping in which the refrigerant circulates. Then, the direction of flow of the heat source-side refrigerant is indicated by arrows of solid lines, and the direction of flow of water as the user-side refrigerant is indicated by arrows of broken lines. The states of refrigerant a-d shown in FIG. 5 indicate the states of the refrigerant at points indicated by reference signs a-d in FIG. 4, respectively.

When all the indoor units 301-303 perform the heating operation, the four-way valve 12 is switched to allow the heat source-side refrigerant being discharged from the compressor 11 to pass through the first extension piping 41 and to flow into the outdoor heat exchanger 21 of the relay unit 20. In other words, it is switched to allow the heat source-side refrigerant flowing out from the outdoor heat exchanger 13 to flow into the compressor 11. The three-way valves 261-263 are switched to allow the respective intermediate heat exchangers 251-253 to communicate with the first refrigerant branch portion 21. The respective second refrigerant flow rate control devices 271-273 restrict the degrees of openings thereof. The first refrigerant flow rate control device 24 makes its opening to a fully opened state. In this state, the operations of the compressor 11 and the pumps 281-283 are started.

First of all, the flow of the refrigerant in the heat source-side refrigerant circuit A will be described. The vapor-state low-temperature low-pressure refrigerant is compressed by the compressor 11 and is discharged as the high-temperature high-pressure refrigerant. The refrigerant compression process of the compressor 11 is expressed by an isentropic curve as shown from the point a to b in FIG. 5. The high-temperature high-pressure refrigerant being discharged from the compressor 11 passes through the four-way valve 12 and the first extension piping 41 and flows into the first refrigerant branch portion 21. The high-temperature high-pressure refrigerant flowing into the first refrigerant branch portion 21 is branched from the first refrigerant branch portion 21, passes through the three-way valves 261-263, and flows into the intermediate heat exchangers 251-253, respectively. Then, the refrigerant is transformed into condensed liquid while dissipating heat to the water flowing in the intermediate heat exchangers 251-253, thereby becoming a high-pressure liquid-state refrigerant. The change of the refrigerant at this time is expressed by a line slightly inclined but substantially horizontal as shown from the point b to c in FIG. 5.

The high-pressure liquid-state refrigerant flowing out from the intermediate heat exchangers 251-253 flows into the second refrigerant flow rate control devices 271-273. Then, the high-pressure liquid-state refrigerant is restricted and then is expanded (decompressed) in the second refrigerant flow rate control devices 271-273, thereby assuming a low-temperature low-pressure gas-liquid two-phase state. The change of the refrigerant at this time is expressed by a vertical line as shown from the point c to d in FIG. 5. The low-temperature low-pressure gas-liquid two-phase state refrigerant flowing out from the second refrigerant flow rate control devices 271-273 flows into the second refrigerant branch portion 22. The gas-liquid two-phase state refrigerant joining in the second refrigerant branch portion 22 passes through the first refrigerant flow rate control device 24 and the second extension piping 42 and flows into the outdoor heat exchanger 13. Then, the refrigerant absorbs heat from the outdoor air in the outdoor heat exchanger 13, thereby becoming a low-temperature low-pressure vapor-state refrigerant. The change of the refrigerant at this time is expressed by a line slightly inclined but substantially horizontal as shown from the point d to a in FIG. 5. The low-temperature low-pressure vapor-state refrigerant flowing out from the outdoor heat exchanger 13 flows into the compressor 11 through the four-way valve 12, and is compressed therein, thereby becoming a high-temperature high-pressure refrigerant.

Subsequently, the flow of the refrigerant in the user-side refrigerant circuit B will be described.

The water heated by the heat source-side refrigerant flowing in the intermediate heat exchangers 251-253 passes through the pumps 281-283 and flows into the indoor heat exchangers 311-313. Then, the water dissipates heat into the indoor air in the indoor heat exchangers 311-313 to heat up the interior of the room in which the indoor units 301-303 (the indoor heat exchangers 311-313) are provided. Subsequently, the water flowing out from the indoor heat exchangers 311-313 flows into the intermediate heat exchangers 251-253.

(Cooling-Dominated Operation Mode)

Subsequently, the cooling-dominated operation mode will be described.

Figure 6:
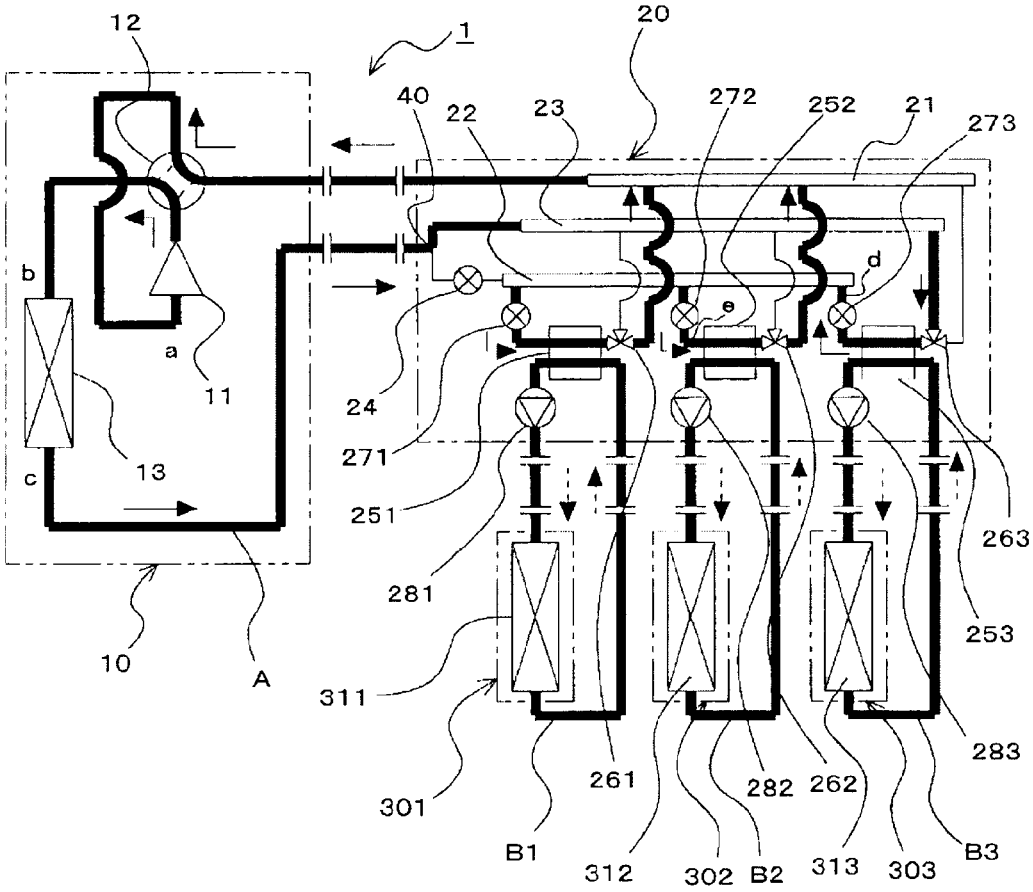
FIG. 6 is a refrigerant circuit diagram showing the flow of the refrigerant in a cooling-dominated operation mode of the air conditioning apparatus according to Embodiment 1 in the present invention.
Figure 7:
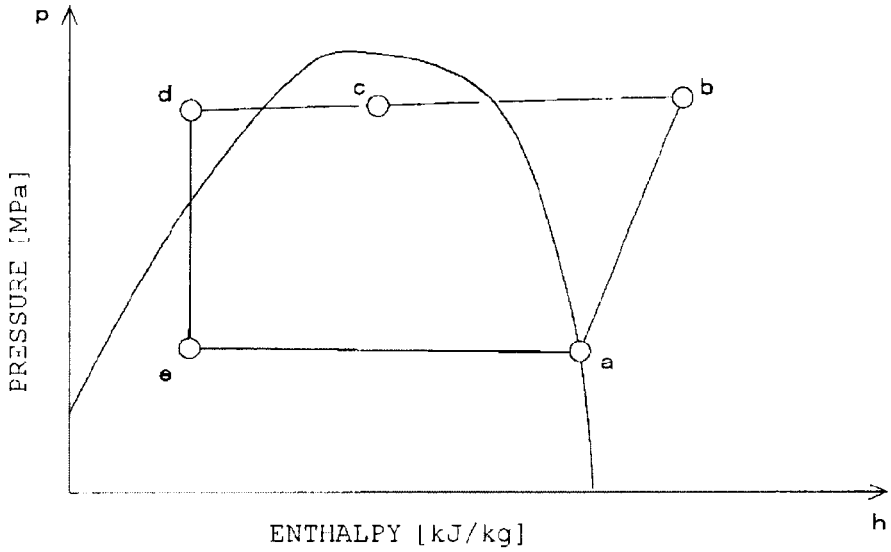
FIG. 7 is a p-h diagram showing the change of the heat source-side refrigerant in FIG. 6.

FIG. 6 is a refrigerant circuit diagram showing the flow of the refrigerant in the cooling dominated operation mode of the air conditioning apparatus according to Embodiment 1 in the present invention. FIG. 7 is a p-h diagram showing the change of the heat source-side refrigerant in the cooling-dominated operation mode.

In FIG. 6, piping illustrated in thick lines indicates piping in which the refrigerant circulates. Then, the direction of flow of the heat source-side refrigerant is indicated by arrows of solid lines, and the direction of flow of water as the user-side refrigerant is indicated by arrows of broken lines. The states of refrigerant a-e shown in FIG. 7 indicate the states of the refrigerant at points indicated by reference signs a-e in FIG. 6, respectively.

A case where the indoor units 301 and 302 perform the cooling operation and the indoor unit 303 performs the heating operation will be described. The four-way valve 12 is switched to allow the heat source-side refrigerant being discharged from the compressor 11 to flow toward the outdoor heat exchanger 13. In other words, it is switched to allow the heat source-side refrigerant being discharged from the first refrigerant branch portion 21 of the relay unit 20 to flow into the compressor 11. The three-way valves 261 and 262 are switched to allow the intermediate heat exchangers 251 and 252 to communicate with the first refrigerant branch portion 21. Also, the three-way valve 263 is switched to allow the intermediate heat exchanger 253 to communicate with the third refrigerant branch portion 23. The second refrigerant flow rate control devices 271 and 272 restrict the degrees of openings thereof, and the second refrigerant flow rate control device 273 increases the degree of opening thereof to a fully opened state. The first refrigerant flow rate control device 24 reduces the degree of opening thereof to a fully closed state. In this state, the operations of the compressor 11 and the pumps 281-283 are started.

First of all, the flow of the refrigerant in the heat source-side refrigerant circuit A will be described. The low-temperature low-pressure vapor-state refrigerant is compressed by the compressor 11 and is discharged as the high-temperature high-pressure refrigerant. The refrigerant compression process of the compressor 11 is expressed by an isentropic curve as shown from the point a to b in FIG. 7. The high-temperature high-pressure refrigerant being discharged from the compressor 11 passes through the four-way valve 12 and flows into the outdoor heat exchanger 13. Then, the refrigerant dissipates heat to the outdoor air in the outdoor heat exchanger 13, thereby becoming a high-pressure gas-liquid two-phase state refrigerant. The change of the refrigerant at this time is expressed by a line slightly inclined but substantially horizontal as shown from the point b to c in FIG. 7.

The high-pressure gas-liquid two-phase refrigerant flowing out from the outdoor heat exchanger 13 passes through the second extension piping 42 and flows into the third refrigerant branch portion 23. The high-pressure gas-liquid two-phase refrigerant flowing out from the third refrigerant branch portion 23 passes through the three-way valve 263, and flows into the intermediate heat exchanger 253. Then, the refrigerant is transformed into condensed liquid while dissipating heat to the water flowing in the intermediate heat exchanger 253, thereby becoming a high-pressure liquid-state refrigerant. The change of the refrigerant at this time is expressed by a line slightly inclined but substantially horizontal as shown from the point c to d in FIG. 7. The high-pressure liquid-state refrigerant flowing out from the intermediate heat exchanger 253 passes through the second refrigerant flow rate control device 273 and flows into the second refrigerant branch portion 22.

The high-pressure liquid-state refrigerant flowing into the second refrigerant branch portion 22 is branched from the second refrigerant branch portion and flows into the second refrigerant flow rate control devices 271 and 272. Then, the high-pressure liquid-state refrigerant is restricted and then is expanded (decompressed) in the second refrigerant flow rate control devices 271 and 272, thereby assuming a low-temperature low-pressure gas-liquid two-phase state. The change of the refrigerant at this time is expressed by a vertical line as shown from the point d to e in FIG. 7.

The low-temperature low-pressure refrigerant in the gas-liquid two-phase state flowing out from the second refrigerant flow rate control devices 271 and 272 flows into the intermediate heat exchangers 251 and 252, respectively. Then, the refrigerant absorbs heat from the water flowing in the intermediate heat exchangers 251 and 252, thereby becoming low-temperature low-pressure vapor-state refrigerant. The change of the refrigerant at this time is expressed by a line slightly inclined but substantially horizontal as shown from the point e to a in FIG. 7.

The low-temperature low-pressure vapor-state refrigerant flowing out from the intermediate heat exchangers 251 and 252 passes through the three-way valves 261 and 262 respectively, and flow into the first refrigerant branch portion 21. The low-temperature low-pressure vapor-state refrigerant joining in the first refrigerant branch portion 21 flows into the compressor 11 through the first extension piping 41 and the four-way valve 12, and is compressed therein.

Subsequently, the flow of the refrigerant in the user-side refrigerant circuit B will be described.

The water cooled by the heat source-side refrigerant flowing in the intermediate heat exchangers 251 and 252 passes through the pumps 281 and 282 and flows into the indoor heat exchangers 311 and 312. Then, the water absorbs heat from the indoor air in the indoor heat exchangers 311 and 312 to cool down the interior of the room in which the indoor units 301 and 302 (the indoor heat exchangers 311 and 312) are provided. Subsequently, the water flowing out from the indoor heat exchangers 311 and 312 flows into the intermediate heat exchangers 251 and 252.

The water heated by the heat source-side refrigerant flowing in the intermediate heat exchanger 253 passes through the pump 283 and flows into the indoor heat exchanger 313. Then, the water dissipates heat into the indoor air in the indoor heat exchanger 313 to heat up the interior of the room in which the indoor unit 303 (the indoor heat exchanger 313) is provided. Subsequently, the water flowing out from the indoor heat exchanger 313 flows into the intermediate heat exchanger 253.

(Heating-Dominated Operation Mode)

Subsequently, the heating-dominated operation mode will be described.

Figure 8:
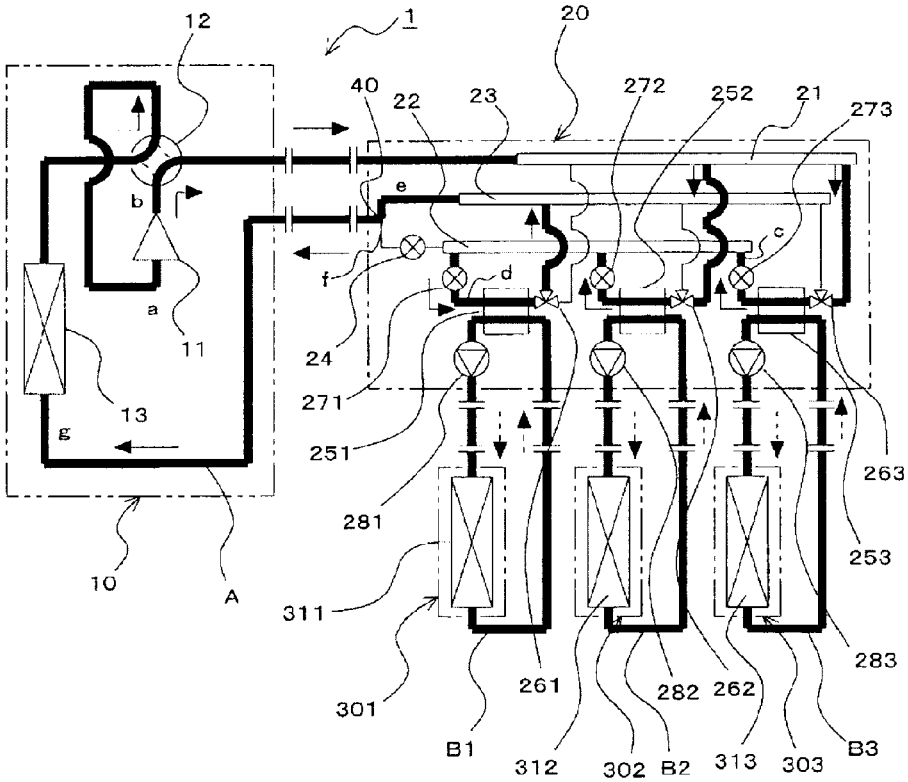
FIG. 8 is a refrigerant circuit diagram showing the flow of the refrigerant in a heating-dominated operation mode of the air conditioning apparatus according to Embodiment 1 in the present invention.
Figure 9:
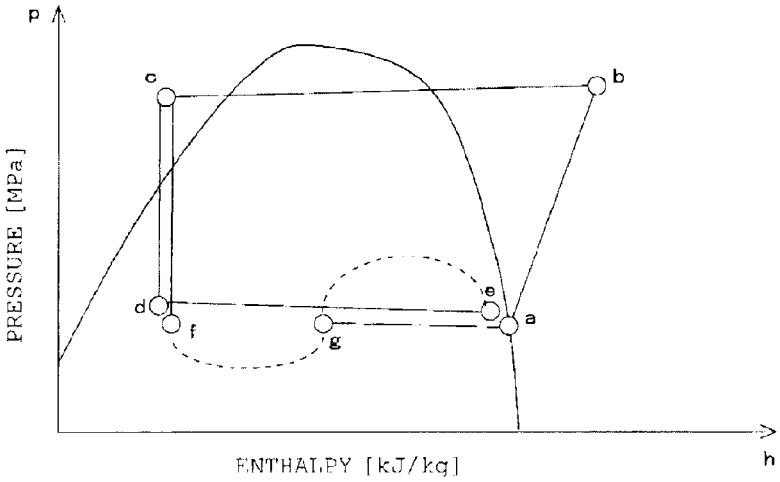
FIG. 9 is a p-h diagram showing the change of the heat source-side refrigerant in FIG. 8.

FIG. 8 is a refrigerant circuit diagram showing the flow of the refrigerant in the heating-dominated operation mode of the air conditioning apparatus according to Embodiment 1 in the present invention. FIG. 9 is a p-h diagram showing the change of the heat source-side refrigerant in the heating operation mode.

In FIG. 8, piping illustrated in thick lines indicates piping in which the refrigerant circulates. Then, the direction of flow of the heat source-side refrigerant is indicated by arrows of solid lines, and the direction of flow of water as the user-side refrigerant is indicated by arrows of broken lines. The states of refrigerant a-g shown in FIG. 9 indicate the states of the refrigerant at points indicated by reference signs a-g in FIG. 8, respectively.

A case where the indoor unit 301 performs the cooling operation and the indoor units 302 and 303 perform the heating operation will be described. The four-way valve 12 is switched to allow the heat source-side refrigerant being discharged from the compressor 11 to pass through the first extension piping 41 and to flow into the first refrigerant branch portion 21 of the relay unit 20. In other words, it is switched to allow the heat source-side refrigerant flowing out from the outdoor heat exchanger 13 to flow into the compressor 11. The three-way valve 261 is switched to allow the intermediate heat exchanger 251 to communicate with the third refrigerant branch portion 23. Also, the three-way valves 262 and 263 are switched to allow the intermediate heat exchangers 252 and 253 to communicate with the first refrigerant branch portion 21. The second refrigerant flow rate control devices 271 restricts the degree of opening thereof and the respective second refrigerant flow rate control devices 272 and 273 increase the degrees of openings thereof to a fully opened state. The respective second refrigerant flow rate control devices 271-273 restrict the degrees of openings thereof. The first refrigerant flow rate control device 24 restricts the degree of opening thereof. In this state, the operations of the compressor 11 and the pumps 281-283 are started.

First of all, the flow of the refrigerant in the heat source-side refrigerant circuit A will be described. The low-temperature low-pressure vapor-state refrigerant is compressed by the compressor 11 and is discharged as the high-temperature high-pressure refrigerant. The refrigerant compression process of the compressor 11 is expressed by an isentropic curve as shown from the point a to b in FIG. 9. The high-temperature high-pressure refrigerant being discharged from the compressor 11 passes through the four-way valve 12 and the first extension piping 41 and flows into the first refrigerant branch portion 21. The high-temperature high-pressure refrigerant flowing into the first refrigerant branch portion 21 is branched from the first refrigerant branch portion 21, passes through the three-way valves 262 and 263, and flows into the intermediate heat exchangers 253 and 253, respectively. Then, the refrigerant is transformed into condensed liquid while dissipating heat to the water flowing in the intermediate heat exchangers 252 and 253, thereby becoming a high-pressure liquid-state refrigerant. The change of the refrigerant at this time is expressed by a line slightly inclined but substantially horizontal as shown from the point b to c in FIG. 9.

The high-pressure liquid-state refrigerant flowing out from the intermediate heat exchangers 252 and 253 passes through the second refrigerant flow rate control devices 272 and 273 and flow into the second refrigerant branch portion 22. Part of the high-pressure liquid-state refrigerant joining in the second refrigerant branch portion 22 flows into the second refrigerant flow rate control device 271. Then, the high-pressure liquid-state refrigerant is restricted and then is expanded (decompressed) in the second refrigerant flow rate control device 271, thereby assuming a low-temperature low-pressure gas-liquid two-phase state. The change of the refrigerant at this time is expressed by a vertical line as shown from the point c to d in FIG. 9. The low-temperature low-pressure gas-liquid two-phase state refrigerant flowing out from the second refrigerant flow rate control device 271 flows into the intermediate heat exchanger 251. Then, the refrigerant absorbs heat from the water flowing in the intermediate heat exchanger 251, thereby becoming a low-temperature low-pressure vapor-state refrigerant (or gas-liquid two-phase state refrigerant). The change of the refrigerant at this time is expressed by a line slightly inclined but substantially horizontal as shown from the point d to e in FIG. 9. The low-temperature low-pressure vapor-state refrigerant flowing out from the intermediate heat exchanger 251 passes through the three-way valves 261 and flows into the third refrigerant branch portion 23.

In contrast, the remaining high-pressure liquid-state refrigerant joining in the second refrigerant branch portion 22 is restricted and then is expanded (decompressed) in the first refrigerant flow rate control device 24, thereby assuming a low-temperature low-pressure gas-liquid two-phase state. The change of the refrigerant at this time is expressed by a vertical line as shown from the point c to f in FIG. 9. The low-temperature low-pressure gas-liquid two-phase state refrigerant flowing out from the first refrigerant flow rate control device 24 joins the low-temperature low-pressure vapor-state refrigerant flowing out from the third refrigerant branch portion 23 (point g shown in FIG. 9), passes through the second extension piping 42, and flows into the outdoor heat exchanger 13. Then, the refrigerant absorbs heat from the outdoor air in the outdoor heat exchanger 13, thereby becoming a low-temperature low-pressure vapor-state refrigerant. The change of the refrigerant at this time is expressed by a line slightly inclined but substantially horizontal as shown from the point g to a in FIG. 9. The low-temperature low-pressure vapor-state refrigerant flowing out from the outdoor heat exchanger 13 flows into the compressor 11 through the four-way valve 12, and is compressed therein, thereby becoming a high-temperature high-pressure refrigerant.

Subsequently, the flow of the refrigerant in the user-side refrigerant circuit B will be described.

The water cooled by the heat source-side refrigerant flowing in the intermediate heat exchanger 251 passes through the pump 281 and flows into the indoor heat exchanger 311. Then, the water absorbs heat from the indoor air in the indoor heat exchanger 311 to cool down the interior of the room in which the indoor unit 301 (the indoor heat exchanger 311) is provided. Subsequently, the water flowing out from the indoor heat exchanger 311 flows into the intermediate heat exchanger 251.

The water heated by the heat source-side refrigerant flowing in the intermediate heat exchangers 252 and 253 passes through the pumps 282 and 283 and flows into the indoor heat exchangers 312 and 312. Then, the water dissipates heat into the indoor air in the indoor heat exchangers 312 and 313 to heat up the interior of the room in which the indoor units 302 and 303 (the indoor heat exchanger 313) are provided. Subsequently, the water flowing out from the indoor heat exchangers 312 and 313 flows into the intermediate heat exchangers 252 and 253.

The air conditioning apparatus 1 configured in this manner is installed, for example, on a roof, a basement, or the like of a building and the relay unit 20 is installed, for example, in shared spaces provided at each floor level in the building or the like. In other words, the outdoor unit 10 and the relay unit 20 are installed in places other than spaces where people exist (living spaces or spaces where people come and go, etc.). Installed in the spaces where people exist are the user-side refrigerant circuits B1-B3 in which the water circulates and the indoor units 301-303. Therefore, the refrigerant whose allowable concentration when leaking into a space is kept under control can be prevented from leaking into the space where people exist. Also, the cooling-heating simultaneous operation of the indoor units 301-303 is enabled.

Since the relay unit 20 is separable from the indoor units 301-303, the indoor units 301-303, the third extension piping 431-433, and the fourth extension piping 441-443 are reusable when the air conditioning apparatus 1 is installed instead of equipment which has been using a water refrigerant previously.

Also, since the circuit configuration which enables the cooling-heating simultaneous operation of the indoor units 301-303 in the heat source-side refrigerant circuit A is provided in the relay unit 20, the outdoor unit 10 and the relay unit can be connected by two arrangements of piping (the first extension piping 41 and the second extension piping 42). Therefore, reduction of the cost of a piping material and reduction of the number of steps in installation are possible.

Although the type of the refrigerant as the heat source-side refrigerant is not specified, the heat source-side refrigerant is not limited in Embodiment 1, and various types of refrigerants can be used. For example, a non-azeotropic mixed refrigerant such as R4070, a pseudo-azeotropic mixed refrigerant such as R410A, or a single refrigerant such as R22 may be used. Natural refrigerants such as carbon dioxide, hydrocarbon may be used. Refrigerants having global warming coefficients smaller than those of fluorocarbon refrigerants (R407C, R410A, etc.), such as refrigerants containing tetrafluoropropene as a primary component, may be used. By using the natural refrigerants or the refrigerants having the global warming coefficients smaller than those of the chlorofluorocarbon refrigerants as the heat source-side refrigerant, the glasshouse effect of the earth due to the refrigerant leaking is effectively prevented. In particular, since the carbon dioxide assumes a supercritical state on the high-pressure side where the heat exchange is performed without condensation, a configuration to cause the water and carbon dioxide to be heat-exchanged in an opposed flow system in the intermediate heat exchangers 251-253 improves the performance of the heat exchange in the case of heating the water.

Although the water is used as the user-side refrigerant in Embodiment 1, antifreeze solution, mixture of water antifreeze solution, or mixture of water and additive having a high anticorrosive effect may also be used. In this configuration, the leakage of refrigerant due to freezing or corrosion can be prevented even at a low outside air temperature, so that a high reliability is achieved. In the user-side refrigerant circuit B installed in a room such as a computer room which dislikes moisture, fluorinated inactive liquid having high heat insulation properties may be used as the user-side refrigerant.

Furthermore, although the degree of opening of the first refrigerant flow rate control device 24 is fully closed during operation in the cooling-dominated operation mode, an operation in a state of slightly opened is also applicable. Part of the high-pressure gas-liquid two-phase refrigerant flowing out from the outdoor heat exchanger 13 flows into the second refrigerant branch portion 22, and the quantity of refrigerant flowing in the intermediate heat exchanger 253 can be restrained. Accordingly, generation of vibrations or refrigerant noise due to increase in flow rate of the refrigerant can be restrained in the intermediate heat exchanger 253.

Although the three-way valves 261-263 are provided as the refrigerant flow channel switching devices, two two-way switching valves may be provided as the refrigerant flow channel switching devices. Although the three-way valve having a bidirectional flow system has a complex sealing structure and costs much, the air conditioning apparatus 1 can be manufactured at a low cost by using inexpensive two-way switching valve.

Although the four-way valve 12 is provided on the discharge side of the compressor 11 in order to perform the cooling operation mode and the heating operation mode in Embodiment 1, the present invention can be implemented even when the four-way valve 12 is not provided if only one of the operation modes is intended. By not providing the four-way valve 12, the cooling operation mode or the heating operation mode is disabled. However, the cooling-heating simultaneous operation of the indoor units 301-303 is enabled by the cooling-dominated operation mode or the heating-dominated operation mode.

Although the detailed embodiments in the present invention has been described thus far, the present invention is not limited thereto, and various deformations and modifications are possible without departing the scope and the spirit of the present invention. For example, a mode in which the two three-way switching valves are provided instead of the four-way valve provided in the outdoor unit 10 is also applicable.

Also, in the present invention, the term "unit" used in the outdoor unit 10 and the indoor units **30*n* does not necessarily mean that all the components are provided in an identical housing or on an outer wall of the identical housing. For example, a configuration in which a housing in which the first refrigerant branch portion 21, the second refrigerant branch portion 22, and the third refrigerant branch portion 23 of the relay unit 20 are stored and a housing in which the pumps 28*n* and the intermediate heat exchangers 25*n* are stored are arranged at different positions is also included within the scope of the present invention. Also, a configuration in which a plurality of sets each made up of the outdoor heat exchanger 13 and the compressor 11 are provided in the outdoor unit 10, and the heat source-side refrigerant flowing out from the respective sets is joined and caused to flow into the relay unit 20** is also applicable.

Since the mode in which the refrigerant which dissipates heat while condensing is filled as the heat source-side refrigerant has been described in Embodiment described above, when a refrigerant which dissipates heat in the supercritical state such as carbon dioxide is filled in the heat source-side refrigerant circuit A, the condenser operates as a radiator, and the refrigerant is decreased in temperature while dissipating heat without concentration.

Embodiment 2

Figure 10:
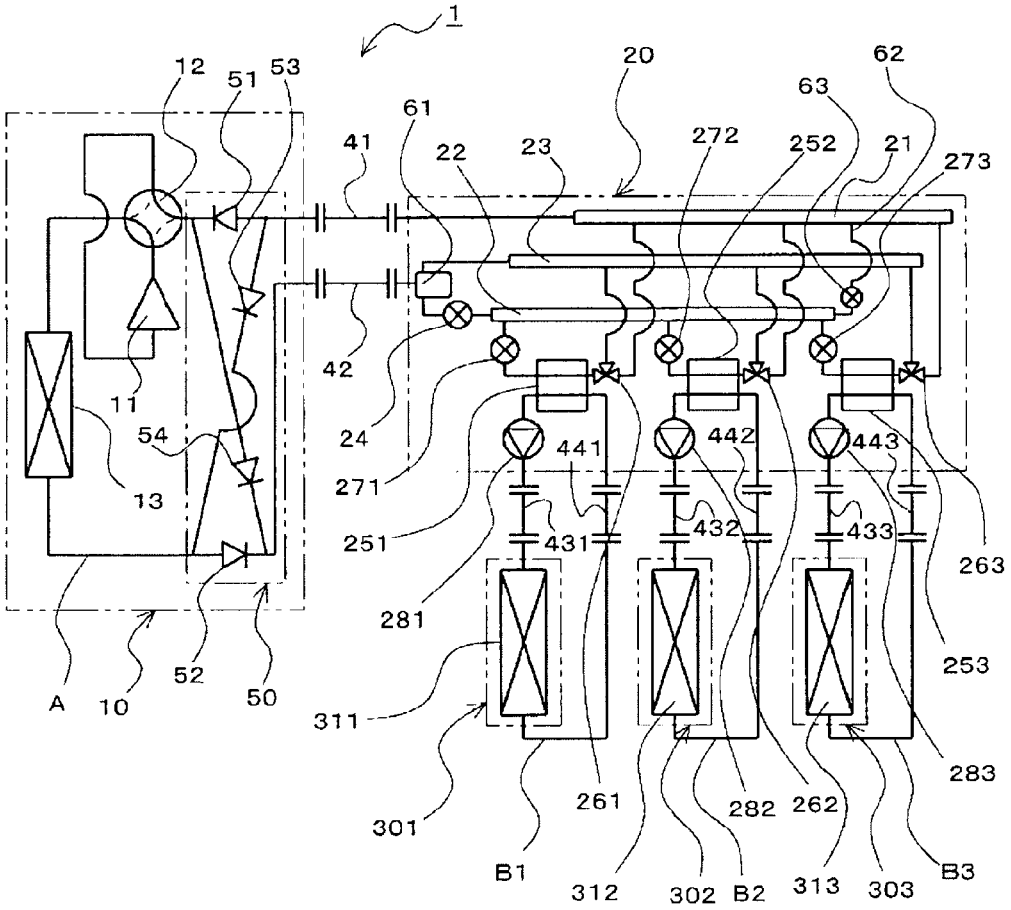
FIG. 10 is a refrigerant circuit diagram of the air conditioning apparatus according to Embodiment 2 in the present invention.

FIG. 10 is a refrigerant circuit diagram of the air conditioning apparatus according to Embodiment 2 in the present invention. The air conditioning apparatus 1 includes a refrigerant flow channel switching unit 50, a gas-liquid separating device 61, bypass piping 62, and a third refrigerant flow rate control device 63 in the refrigerant circuit in the air conditioning apparatus in Embodiment 1. A refrigerant which dissipates heat while condensing is used in the heat source-side refrigerant circuit A in the air conditioning apparatus 1. Here, the refrigerant flow channel switching unit 50 corresponds to the third refrigerant flow channel switching device in the present invention.

In Embodiment 2, items which are not specifically noted are the same as those in Embodiment 1, and the same functions and configurations will be described using the same reference numerals.

The refrigerant flow channel switching unit 50 is provided in the outdoor unit 10, and includes a first check valve 51, a second check valve 52, a third check valve 53, and a fourth check valve 54. The first check valve 51 is provided on piping which connects the four-way valve 12 and the first extension piping 41, and the heat source-side refrigerant flows only in the direction toward the four-way valve 12. The second check valve 52 is provided on piping which connects the outdoor heat exchanger 13 and the second extension piping 42, and the heat source-side refrigerant flows only in the direction toward the second refrigerant branch portion 22 and the third refrigerant branch portion 23. The third check valve 53 is provided on piping which connects an inlet side of the first check valve 51 and an inlet side of the second check valve 52, and the heat-side refrigerant flows only in the direction toward the inlet side of the second check valve 52. The fourth check valve 54 is provided on piping which connects an outlet side of the first check valve 51 and an outlet side of the second check valve 52, and the heat-side refrigerant flows only in the direction toward the outlet side of the second check valve 52. With the provision of the refrigerant flow channel switching unit 50 in this configuration in the outdoor unit, the heat source-side refrigerant being discharged from the compressor 11 always passes through the second extension piping 42 and flows into the relay unit 20, and the heat source-side refrigerant flowing out from the relay unit 20 always passes through the first extension piping 41.

The branch piping 40 of the relay unit 20 is provided with the gas-liquid separating device 61. The gas-liquid separating device 61 separates the heat source-side refrigerant flowing therein from the outdoor unit 10 side into a liquid-state refrigerant and a vapor-state refrigerant. The liquid-state refrigerant separated by the gas-liquid separating device 61 passes through the first refrigerant flow rate control device 24 and flows into the second refrigerant branch portion 22. The vapor-state refrigerant separated by the gas-liquid separating device 61 flows into the third refrigerant branch portion 23.

The relay unit 20 is provided with the bypass piping 62 which connects the first refrigerant branch portion 21 and the third refrigerant branch portion 23. The bypass piping 62 is provided with the third refrigerant flow rate control device 63.

(Operating Actions)

Subsequently, operating actions of the air conditioning apparatus 1 in Embodiment 2 will be described.

(Cooling Operation Mode)

First of all, the cooling operation mode will be described.

Figure 11:
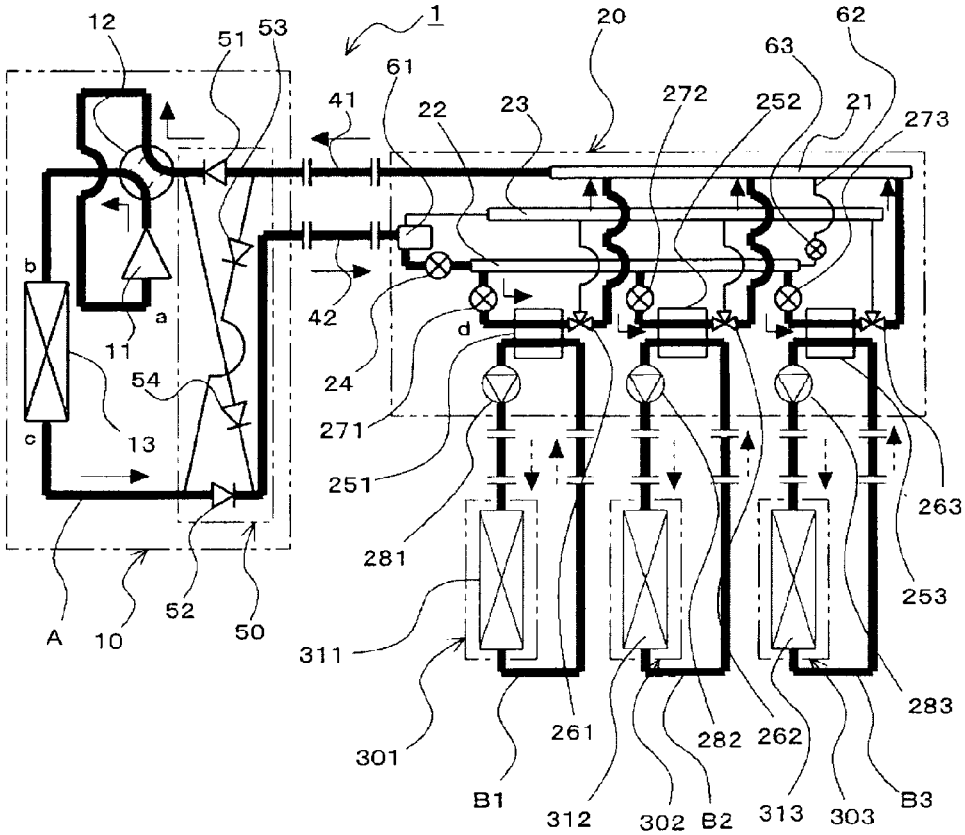
FIG. 11 is a refrigerant circuit diagram showing the flow of the refrigerant in a cooling operation mode of the air conditioning apparatus according to Embodiment 2 in the present invention.
Figure 12:
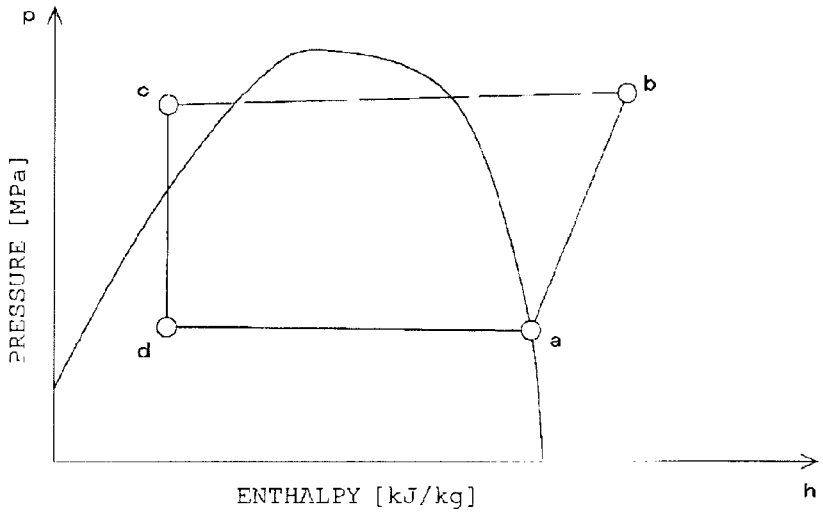
FIG. 12 is a p-h diagram showing the change of the heat source-side refrigerant in FIG. 11.

FIG. 11 is a refrigerant circuit diagram showing the flow of the refrigerant in the cooling operation mode of the air conditioning apparatus according to Embodiment 2 in the present invention. FIG. 12 is a p-h diagram showing the change of the heat source-side refrigerant in the cooling operation mode.

In FIG. 11, piping illustrated in thick lines indicates piping in which the refrigerant circulates. Then, the direction of flow of the heat source-side refrigerant is indicated by arrows of solid lines, and the direction of flow of water as the user-side refrigerant is indicated by arrows of broken lines. The states of refrigerant a-d shown in FIG. 12 indicate the states of the refrigerant at points indicated by reference signs a-d in FIG. 11, respectively.

When all the indoor units 301-303 perform the cooling operation, the four-way valve 12 is switched to allow the heat source-side refrigerant being discharged from the compressor 11 to flow toward the outdoor heat exchanger 13. In other words, the four-way valve 12 is switched to allow the heat source-side refrigerant being discharged from the first refrigerant branch portion 21 of the relay unit 20 to pass through the first extension piping 41 and the first check valve 51 and to flow into the compressor 11. The three-way valves 261-263 are switched to allow the respective intermediate heat exchangers 251-253 to communicate with the first refrigerant branch portion 21. The respective second refrigerant flow rate control devices 271-273 reduces the degrees of openings thereof. The first refrigerant flow rate control device 24 controls the degree of opening thereof to a fully opened state. The third refrigerant flow rate control device 63 controls the degree of opening thereof to a fully closed state. In this state, the operations of the compressor 11 and the pumps 281-283 are started.

The flow of the refrigerant in the heat source-side refrigerant circuit A will be described. The low-temperature low-pressure vapor-state refrigerant is compressed by the compressor 11 and is discharged as the high-temperature high-pressure refrigerant. A refrigerant compression process of the compressor 11 is expressed by an isentropic curve as shown from the point a to b in FIG. 12 on the assumption that heat entry and exit with respect to the periphery does not occur. The high-temperature high-pressure refrigerant being discharged from the compressor 11 passes through the four-way valve 12 and flows into the outdoor heat exchanger 13. Then, the refrigerant is transformed into condensed liquid while dissipating heat to the outdoor air, thereby becoming a high-pressure liquid-state refrigerant. The change of the refrigerant in the outdoor heat exchanger 13 is performed under a substantially constant pressure. The change of the refrigerant at this time is expressed by a line slightly inclined but substantially horizontal as shown from the point b to c in FIG. 12 when considering the pressure loss of the outdoor heat exchanger 13.

The high-pressure liquid-state refrigerant flowing out from the outdoor heat exchanger 13 passes through the second check valve 52, the second extension piping 42, the gas-liquid separating device 61, and the first refrigerant flow rate control device 24 and flows into the second refrigerant branch portion 22. The high-pressure liquid-state refrigerant flowing into the second refrigerant branch portion 22 is branched from the second refrigerant branch portion 22 and flows into the second refrigerant flow rate control devices 271-273. Then, the high-pressure liquid-state refrigerant is restricted and then is expanded (decompressed) in the second refrigerant flow rate control devices 271-273, thereby assuming a low-temperature low-pressure gas-liquid two-phase state. The changes of the refrigerant in the second refrigerant flow rate control devices 271-273 are performed under a constant enthalpy. The change of the refrigerant at this time is expressed by a vertical line as shown from the point c to d in FIG. 12.

The low-temperature low-pressure refrigerant in the gas-liquid two-phase state flowing out from the second refrigerant flow rate control devices 271-273 flows into the intermediate heat exchangers 251-253, respectively. Then, the refrigerant absorbs heat from the water flowing in the intermediate heat exchangers 251-253, thereby becoming a low-temperature low-pressure vapor-state refrigerant. The changes of the refrigerant in the intermediate heat exchangers 251-253 are performed under a substantially constant pressure. The change of the refrigerant at this time is expressed by a line slightly inclined but substantially horizontal as shown from the point d to a in FIG. 12 when considering the pressure loss of the intermediate heat exchangers 251-253.

The low-temperature low-pressure vapor-state refrigerant flowing out from the intermediate heat exchangers 251-253 passes through the three-way valves 261-263 respectively, and flow into the first refrigerant branch portion 21. The low-temperature low-pressure vapor-state refrigerant joining in the first refrigerant branch portion 21 flows into the compressor 11 through the first extension piping 41, the first check valve 51, and the four-way valve 12, and is compressed therein.

Since the flow of the refrigerant in the user-side refrigerant circuit B is the same as that in Embodiment 1, and hence description will be omitted in Embodiment 2.

(Heating Operation Mode)

Subsequently, the heating operation mode will be described.

Figure 13:
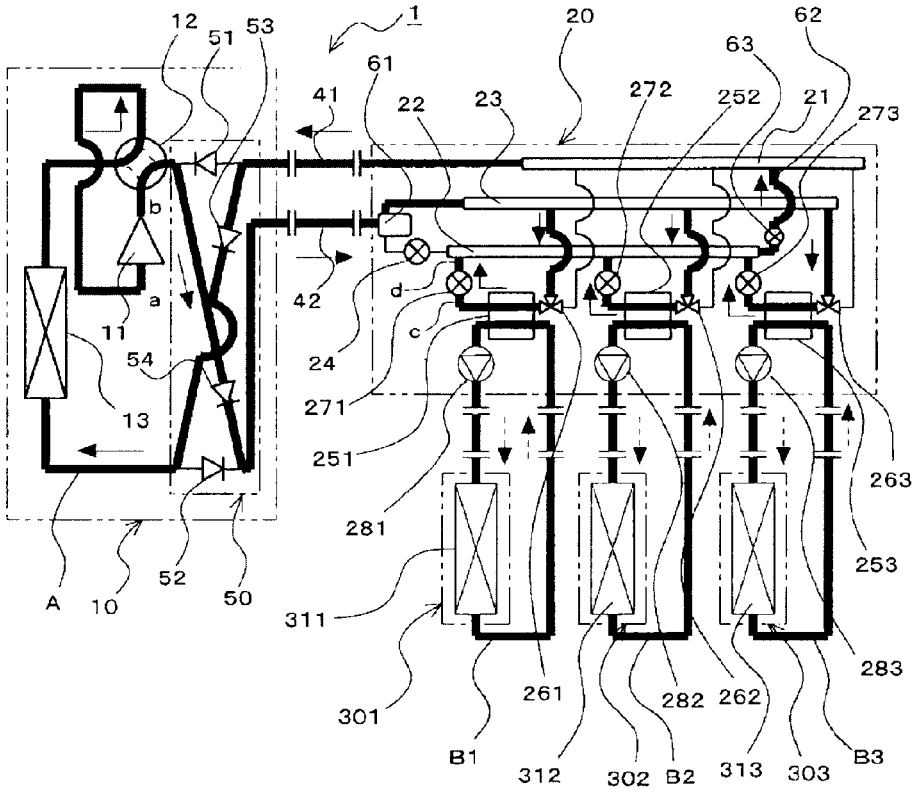
FIG. 13 is a refrigerant circuit diagram showing the flow of the refrigerant in a heating operation mode of the air conditioning apparatus according to Embodiment 2 in the present invention.
Figure 14:
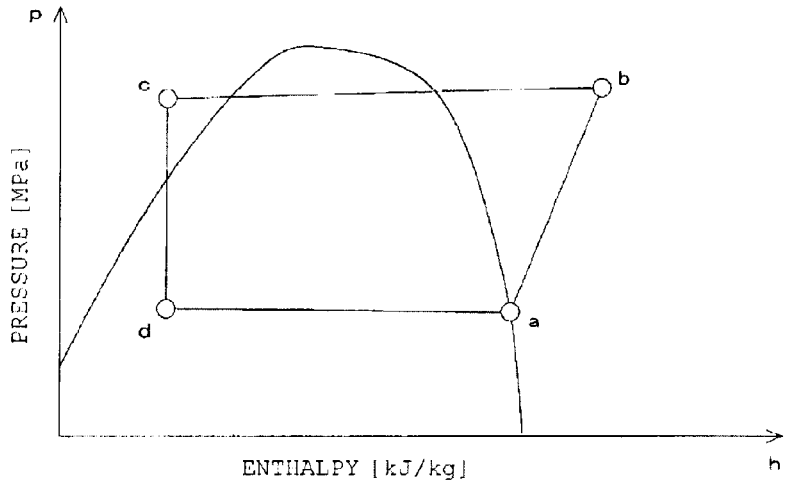
FIG. 14 is a p-h diagram showing the change of the heat source-side refrigerant in FIG. 13.

FIG. 13 is a refrigerant circuit diagram showing the flow of the refrigerant in the heating operation mode of the air conditioning apparatus according to Embodiment 2 in the present invention. FIG. 14 is a p-h diagram showing the change of the heat source-side refrigerant in the heating operation mode.

In FIG. 13, piping illustrated in thick lines indicates piping in which the refrigerant circulates. Then, the direction of flow of the heat source-side refrigerant is indicated by arrows of solid lines, and the direction of flow of water as the user-side refrigerant is indicated by arrows of broken lines. The states of refrigerant a-d shown in FIG. 14 indicate the states of the refrigerant at points indicated by reference signs a-d in FIG. 13, respectively.

When all the indoor units 301-303 perform the heating operation, the four-way valve 12 is switched to allow the heat source-side refrigerant being discharged from the compressor 11 to pass through the fourth check valve 52 and the second extension piping 42 and to flow into the third refrigerant branch portion 23 of the relay unit 20. In other words, it is switched to allow the heat source-side refrigerant flowing out from the outdoor heat exchanger 13 to flow into the compressor 11. The three-way valves 261-263 are switched to allow the respective intermediate heat exchangers 251-253 to communicate with the third refrigerant branch portion 23. The respective second refrigerant flow rate control devices 271-273 restrict the degrees of the openings thereof. The first refrigerant flow rate control device 24 reduces the degree of opening thereof to a fully closed state. The third refrigerant flow rate control device 63 increases the degree of opening thereof to a fully opened state. In this state, the operations of the compressor 11 and the pumps 281-283 are started.

The flow of the refrigerant in the heat source-side refrigerant circuit A will be described. The low-temperature low-pressure vapor-state refrigerant is compressed by the compressor 11 and is discharged as the high-temperature high-pressure refrigerant. The refrigerant compression process of the compressor 11 is expressed by an isentropic curve as shown from the point a to b in FIG. 14. The high-temperature high-pressure refrigerant being discharged from the compressor 11 passes through the four-way valve 12, the fourth check valve 54, the second extension piping 42, and the gas-liquid separating device 61 and flows into the first refrigerant branch portion 23. The high-temperature high-pressure refrigerant flowing into the third refrigerant branch portion 23 is branched from the third refrigerant branch portion 23, passes through the three-way valves 261-263, and flows into the intermediate heat exchangers 251-253, respectively. Then, the refrigerant is transformed into condensed liquid while dissipating heat to the water flowing in the intermediate heat exchangers 251-253, thereby becoming a high-pressure liquid-state refrigerant. The change of the refrigerant at this time is expressed by a line slightly inclined but substantially horizontal as shown from the point b to c in FIG. 14.

The high-pressure liquid-state refrigerant flowing out from the intermediate heat exchangers 251-253 flows into the second refrigerant flow rate control devices 271-273. Then, the high-pressure liquid-state refrigerant is throttled to be expanded (decompressed) in the second refrigerant flow rate control devices 271-273, thereby turning into a low-temperature low-pressure gas-liquid two-phase state. The change in the refrigerant at this time is expressed by a vertical line as shown from the point c to d in FIG. 14. The low-temperature low-pressure gas-liquid two-phase state refrigerant flowing out from the second refrigerant flow rate control devices 271-273 flows into the second refrigerant branch portion 22. The gas-liquid two-phase state refrigerant joined in the second refrigerant branch portion 22 passes through the bypass piping 62 and the third refrigerant flow rate control device 63 and flows into the first refrigerant branch portion 21. Subsequently, the refrigerant passes through the first extension piping 41 and the third check valve 53 and flows into the outdoor heat exchanger 13. Then, the refrigerant absorbs heat from the outdoor air in the outdoor heat exchanger 13, thereby becoming a low-temperature low-pressure vapor-state refrigerant. The change in the refrigerant at this time is expressed by a slightly inclined but substantially horizontal line as shown from the point d to a in FIG. 14. The low-temperature low-pressure vapor-state refrigerant flowing out from the outdoor heat exchanger 13 flows into the compressor 11 through the four-way valve 12, and is compressed to turn into a high-temperature high-pressure refrigerant.

Since the flow of the refrigerant in the user-side refrigerant circuit B is the same as that in Embodiment 1, and hence description will be omitted in Embodiment 2.

(Cooling-Dominated Operation Mode)

Subsequently, the cooling-dominated operation mode will be described.

Figure 15:
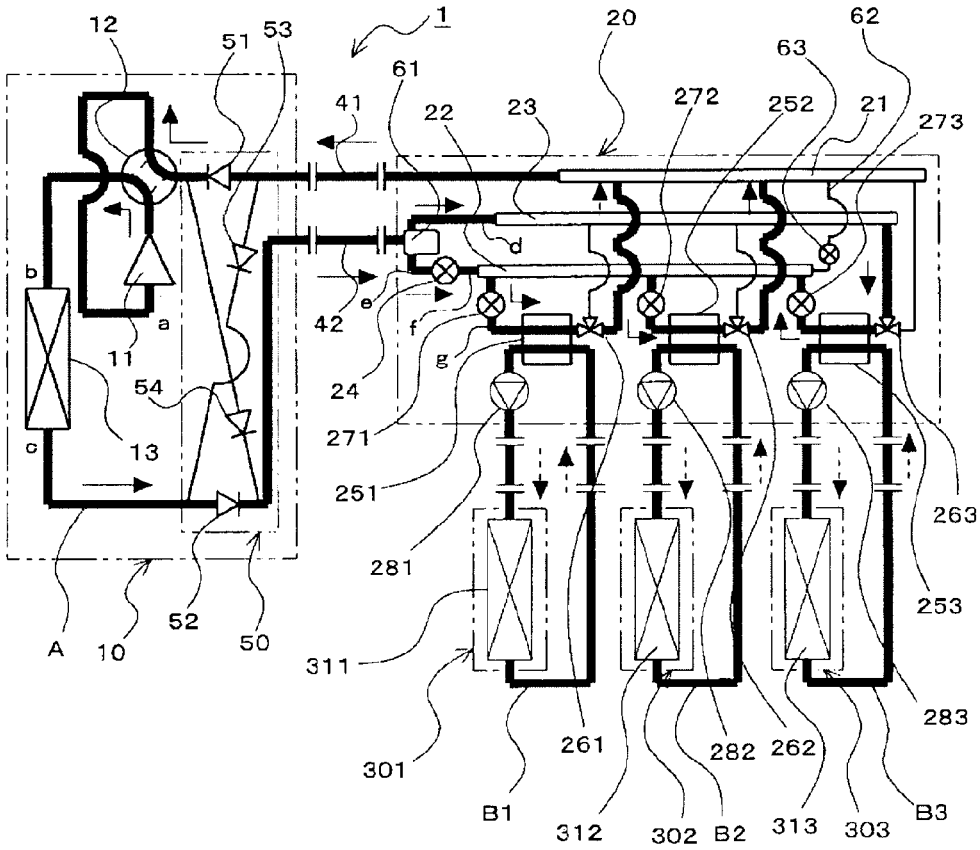
FIG. 15 is a refrigerant circuit diagram showing the flow of the refrigerant in a cooling-dominated operation mode of the air conditioning apparatus according to Embodiment 2 in the present invention.
Figure 16:
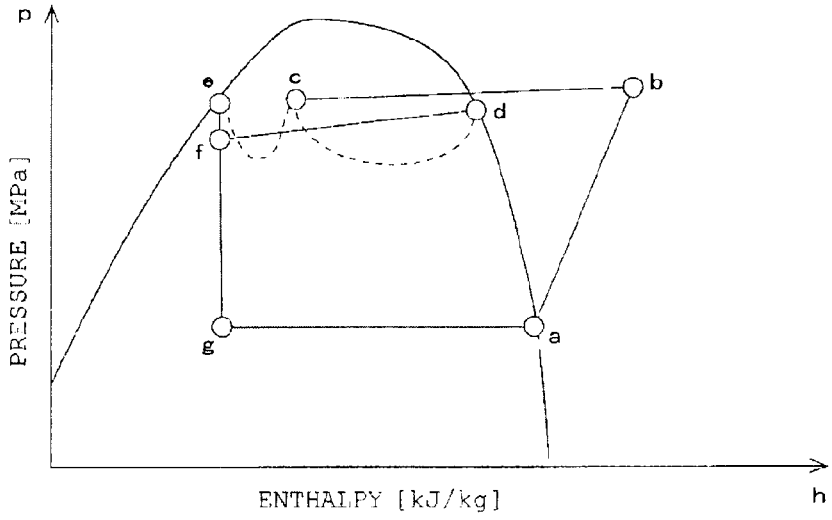
FIG. 16 is a p-h diagram showing the change of the heat source-side refrigerant in FIG. 15.

FIG. 15 is a refrigerant circuit diagram showing the flow of the refrigerant in the cooling-dominated operation mode of the air conditioning apparatus according to Embodiment 2 in the present invention. FIG. 16 is a p-h diagram showing the change of the heat source-side refrigerant in the cooling-dominated operation mode.

In FIG. 15, piping illustrated in thick lines indicates piping in which the refrigerant circulates. Then, the direction of flow of the heat source-side refrigerant is indicated by arrows of solid lines, and the direction of flow of water as the user-side refrigerant is indicated by arrows of broken lines. The states of refrigerant a-g shown in FIG. 16 indicate the states of the refrigerant at points indicated by reference signs a-g in FIG. 15, respectively.

A case where the indoor units 301 and 302 perform the cooling operation and the indoor unit 303 performs the heating operation will be described. The four-way valve 12 is switched to allow the heat source-side refrigerant being discharged from the compressor 11 to flow toward the outdoor heat exchanger 13. In other words, the four-way valve 12 is switched to allow the heat source-side refrigerant being discharged from the first refrigerant branch portion 21 of the relay unit 20 to pass through the first extension piping 41 and the first check valve 51 and to flow into the compressor 11. The three-way valves 261 and 262 are switched to allow the intermediate heat exchangers 251 and 252 to communicate with the first refrigerant branch portion 21. The three-way valve 263 is switched to allow the intermediate heat exchanger 253 to communicate with the third refrigerant branch portion 23. The second refrigerant flow rate control devices 271 and 272 restrict the degrees of openings thereof and the second refrigerant flow rate control device 273 increases the degree of opening thereof to a fully opened state. The first refrigerant flow rate control device 24 restricts the degree of opening so as to separate the heat source-side refrigerant into the liquid-state refrigerant and the vapor-stat refrigerant in the gas-liquid separating device 61. The third refrigerant flow rate control device 63 reduces the degree of opening thereof to a fully closed state. In this state, the operations of the compressor 11 and the pumps 281-283 are started.

The flow of the refrigerant in the heat source-side refrigerant circuit A will be described. The low-temperature low-pressure vapor-state refrigerant is compressed by the compressor 11 and is discharged as the high-temperature high-pressure refrigerant. The refrigerant compression process of the compressor 11 is expressed by an isentropic curve as shown from the point a to b in FIG. 16. The high-temperature high-pressure refrigerant being discharged from the compressor 11 passes through the four-way valve 12 and flows into the outdoor heat exchanger 13. Then, the refrigerant condenses while dissipating heat to the outdoor air in the outdoor heat exchanger 13, thereby becoming a high-pressure gas-liquid two-phase state refrigerant. The change of the refrigerant at this time is expressed by a line slightly inclined but substantially horizontal as shown from the point b to c in FIG. 16.

The high-pressure gas-liquid two-phase refrigerant flowing out from the outdoor heat exchanger 13 passes through the second check valve 52 and the second extension piping 42 and flows into the gas-liquid separating device 61. Then, the refrigerant is separated into the vapor-state refrigerant (point d) and the liquid-state refrigerant (point e) in the gas-liquid separating device 61.

The vapor-stat refrigerant (point d) separated in the gas-liquid separating device 61 passes through the third refrigerant branch portion 23 and the three-way valve 263 and flows into the intermediate heat exchanger 253. Then, the refrigerant condenses while dissipating heat to the water flowing in the intermediate heat exchanger 253, thereby becoming a gas-liquid two-phase state refrigerant. The change of the refrigerant at this time is expressed by a line slightly inclined but substantially horizontal as shown from the point d to f in FIG. 16. The gas-liquid two-phase state refrigerant flowing out from the intermediate heat exchanger 253 passes through the second refrigerant flow rate control device 273 and flows into the second refrigerant branch portion 22.

In contrast, the liquid-state refrigerant (point e) separated in the gas-liquid separating device 61 flows into the first refrigerant flow rate control device 24. Then, the liquid-state refrigerant is restricted and then is expanded (decompressed) in the first refrigerant flow rate control device 24, thereby becoming a gas-liquid two-phase sate refrigerant. The change of the refrigerant at this time is expressed by a vertical line as shown from the point e to f in FIG. 16. The gas-liquid two-phase state refrigerant flowing out from the first refrigerant flow rate control device 24 flows into the second refrigerant branch portion 22, and joins the gas-liquid two-phase state refrigerant flowing therein from the intermediate heat exchanger 253 (point f).

The gas-liquid two-phase state refrigerant flowing into the second refrigerant branch portion 22 is branched from the second refrigerant branch portion 22 and flows into the second refrigerant flow rate control devices 271 and 272. Then, the gas-liquid two-phase state refrigerant is restricted and then is expanded (decompressed) in the second refrigerant flow rate control devices 271 and 272, thereby assuming a low-temperature low-pressure gas-liquid two-phase state. The change of the refrigerant at this time is expressed by a vertical line as shown from the point f to g in FIG. 16.

The low-temperature low-pressure gas-liquid two-phase state refrigerant flowing out from the second refrigerant flow rate control devices 271 and 272 flows into the intermediate heat exchangers 251 and 252, respectively. Then, the refrigerant absorbs heat from the water flowing in the intermediate heat exchangers 251 and 252, thereby becoming low-temperature low-pressure vapor-state refrigerant. The change of the refrigerant at this time is expressed by a line slightly inclined but substantially horizontal as shown from the point g to a in FIG. 16.

The low-temperature low-pressure vapor-state refrigerant flowing out from the intermediate heat exchangers 251 and 252 passes through the three-way valves 261 and 262 respectively, and flows into the first refrigerant branch portion 21. The low-temperature low-pressure vapor-state refrigerant joined in the first refrigerant branch portion 21 flows into the compressor 11 through the first extension piping 41, the first check valve 51, and the four-way valve 12, and is compressed therein.

Since the flow of the refrigerant in the user-side refrigerant circuit B is the same as that in Embodiment 1, and hence description will be omitted in Embodiment 2.

(Heating-Dominated Operation Mode)

Subsequently, the heating-dominated operation mode will be described.

Figure 17:
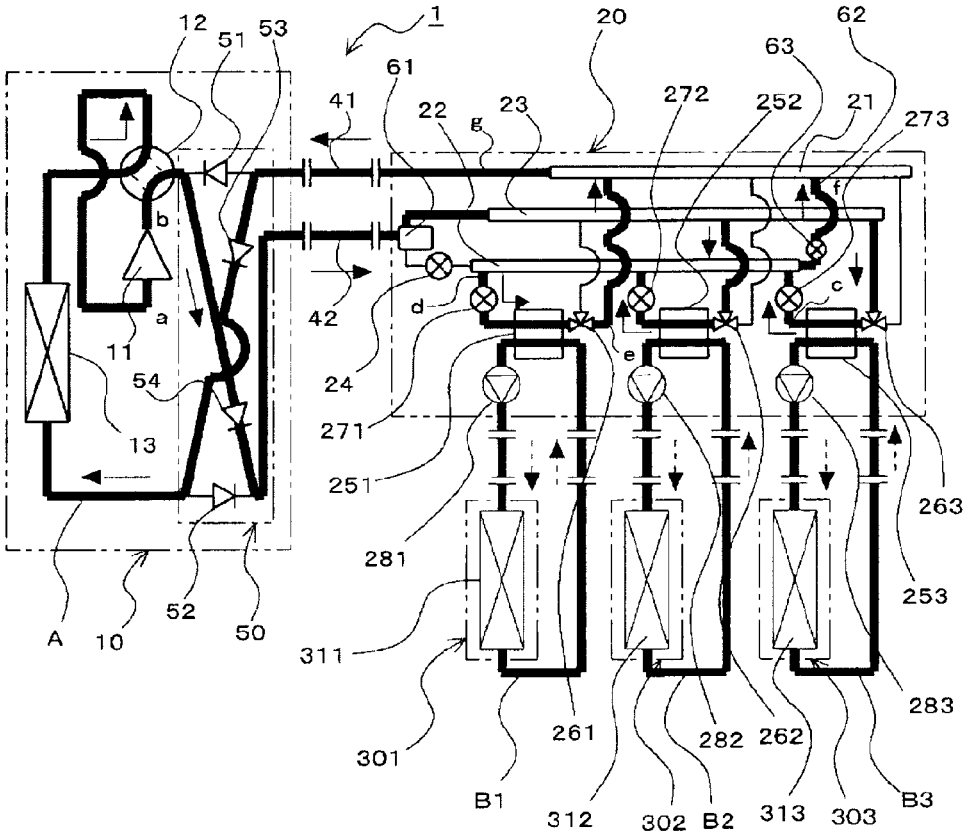
FIG. 17 is a refrigerant circuit diagram showing the flow of the refrigerant in a heating-dominated operation mode of the air conditioning apparatus according to Embodiment 2 in the present invention.
Figure 18:
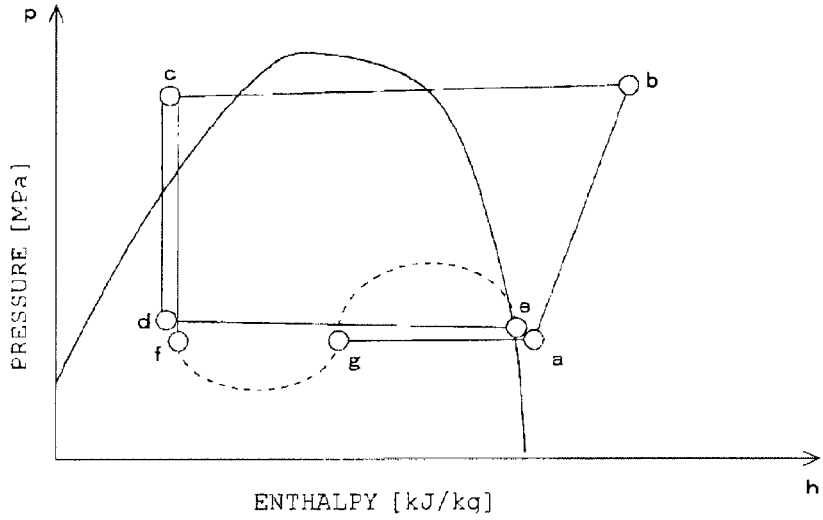
FIG. 18 is a p-h diagram showing the change of the heat source-side refrigerant in FIG. 15.

FIG. 17 is a refrigerant circuit diagram showing the flow of the refrigerant in the heating-dominated operation mode of the air conditioning apparatus according to Embodiment 2 in the present invention. FIG. 18 is a p-h diagram showing the change of the heat source-side refrigerant in the heating operation mode.

In FIG. 17, piping illustrated in thick lines indicates piping in which the refrigerant circulates. Then, the direction of flow of the heat source-side refrigerant is indicated by arrows of solid lines, and the direction of flow of water as the user-side refrigerant is indicated by arrows of broken lines. The states of refrigerant a-g shown in FIG. 18 indicate the states of the refrigerant at points indicated by reference signs a-g in FIG. 17, respectively.

A case where the indoor unit 301 performs the cooling operation and the indoor units 302 and 303 perform the heating operation will be described. The four-way valve 12 is switched to allow the heat source-side refrigerant being discharged from the compressor 11 to pass through the second check valve 52 and the second extension piping 42 and to flow into the third refrigerant branch portion 23 of the relay unit 20. In other words, the four-way valve 12 is switched to allow the heat source-side refrigerant flowing out from the outdoor heat exchanger 13 to flow into the compressor 11. The three-way valve 261 is switched to allow the intermediate heat exchanger 251 to communicate with the first refrigerant branch portion 21. Also, the three-way valves 262 and 263 are switched to allow the intermediate heat exchangers 252 and 253 to communicate with the third refrigerant branch portion 23. The second refrigerant flow rate control devices 271 restricts the degree of opening thereof and the second refrigerant flow rate control devices 272 and 273 increase the degrees of openings thereof to a fully opened state. The first refrigerant flow rate control device 24 reduces the degree of opening thereof to a fully closed state. The third refrigerant flow rate control device 63 restricts the degree of opening thereof to allow part of the heat source-side refrigerant flowing into the second refrigerant branch portion 22 to flow to the bypass piping 62. In this state, the operations of the compressor 11 and the pumps 281-283 are started.

The flow of the refrigerant in the heat source-side refrigerant circuit A will be described. The low-temperature low-pressure vapor-state refrigerant is compressed by the compressor 11 and is discharged as the high-temperature high-pressure refrigerant. The refrigerant compression process of the compressor 11 is expressed by an isentropic curve as shown from the point a to b in FIG. 18. The high-temperature high-pressure refrigerant being discharged from the compressor 11 passes through the fourth check valve 54, the second extension piping 42, and the gas-liquid separating device 61 and flows into the third refrigerant branch portion 23. The high-temperature high-pressure refrigerant flowing into the third refrigerant branch portion 23 is branched from the third refrigerant branch portion 23, passes through the three-way valves 262 and 263, and flows into the intermediate heat exchangers 252 and 253, respectively. Then, the refrigerant is transformed into condensed liquid while dissipating heat to the water flowing in the intermediate heat exchangers 252 and 253, thereby becoming a high-pressure liquid-state refrigerant. The change of the refrigerant at this time is expressed by a line slightly inclined but substantially horizontal as shown from the point b to c in FIG. 18.

The high-pressure liquid-state refrigerant flowing out from the intermediate heat exchangers 252 and 253 passes through the second refrigerant flow rate control devices 272 and 273 and flow into the second refrigerant branch portion 22. Part of the high-pressure liquid-state refrigerant joining in the second refrigerant branch portion 22 flows into the second refrigerant flow rate control device 271. Then, the high-pressure liquid-state refrigerant is restricted and then is expanded (decompressed) in the second refrigerant flow rate control device 271, thereby assuming a low-temperature low-pressure gas-liquid two-phase state. The change of the refrigerant at this time is expressed by a vertical line as shown from the point c to d in FIG. 18. The low-temperature low-pressure gas-liquid two-phase state refrigerant flowing out from the second refrigerant flow rate control device 271 flows into the intermediate heat exchanger 251. Then, the refrigerant absorbs heat from the water flowing in the intermediate heat exchanger 251, thereby becoming a low-temperature low-pressure vapor-state refrigerant. The change of the refrigerant at this time is expressed by a line slightly inclined but substantially horizontal as shown from the point d to e in FIG. 18. The low-temperature low-pressure vapor-state refrigerant flowing out from the intermediate heat exchanger 251 passes through the three-way valves 261 and flows into the first refrigerant branch portion 21.

In contrast, remaining part of the high-pressure liquid-state refrigerant flowing out from the intermediate heat exchangers 252 and 253 into the second refrigerant branch portion 22 flows into the third refrigerant flow rate control device 63. Then, the high-pressure liquid-state refrigerant is restricted and then is expanded (decompressed) in the third refrigerant flow rate control device 63, thereby assuming a low-temperature low-pressure gas-liquid two-phase state. The change of the refrigerant at this time is expressed by a vertical line as shown from the point c to f in FIG. 18. The low-temperature low-pressure gas-liquid two-phase state refrigerant flowing out from the third refrigerant flow rate control device 63 flows into the first refrigerant branch portion 21, and joins the low-temperature low-pressure vapor-state refrigerant flowing therein from the intermediate heat exchanger 251 (point g).

The low-temperature low-pressure gas-liquid two-phase state refrigerant flowing out from the first refrigerant branch portion 21 passes through the first extension piping 41 and the third check valve 53 and flows into the outdoor heat exchanger 13. Then, the refrigerant absorbs heat from the outdoor air in the outdoor heat exchanger 13, thereby becoming a low-temperature low-pressure vapor-state refrigerant. The change of the refrigerant at this time is expressed by a line slightly inclined but substantially horizontal as shown from the point g to a in FIG. 18. The low-temperature low-pressure vapor-state refrigerant flowing out from the outdoor heat exchanger 13 flows into the compressor 11 through the four-way valve 12, and is compressed therein, thereby becoming a high-temperature high-pressure refrigerant.

Since the flow of the refrigerant in the user-side refrigerant circuit B is the same as that in Embodiment 1, and hence description will be omitted in Embodiment 2.

In the air conditioning apparatus 1 configured in this manner, since the refrigerant flow channel switching unit 50 is provided in the outdoor unit 10, the heat source-side refrigerant being discharged from the compressor 11 always passes through the second extension piping 42 and flows into the relay unit 20, and the heat source-side refrigerant flowing out from the relay unit 20 always passes through the first extension piping 41. Therefore, the thickness of the first extension piping 41 can be reduced, and hence equipment cost can be reduced.

Furthermore, since the gas-liquid separating device 61 is provided in the branch piping 40, only the vapor-state refrigerant can be supplied to the intermediate heat exchangers 25*n* in the cooling-dominated operation. Therefore, improvement of operating efficiency of the air conditioning apparatus is achieved.

Although the type of refrigerant as the heat source-side refrigerant is not specified in Embodiment 2 as well, the heat source-side refrigerant is not limited, and various types of refrigerants can be used. For example, the non-azeotropic mixed refrigerant such as R407C, the pseudo-azeotropic mixed refrigerant such as R410A, or the single refrigerant such as R22 may be used. The natural refrigerants such as carbon dioxide or hydrocarbon may be used. The refrigerants having global warming coefficients smaller than those of the fluorocarbon refrigerants (R407C, R410A, etc.), such as the refrigerants containing tetrafluoropropene as a primary component, may be used. By using the natural refrigerants or the refrigerants having the global warming coefficients smaller than that of the chlorofluorocarbons refrigerant, the glass-house effect of the earth due to the refrigerant leaking can be effectively prevented. In particular, since the carbon dioxide performs the heat exchange without condensation under a supercritical state at a high-pressure side, a configuration to cause the water and carbon dioxide to be heat-exchanged in the opposed flow system in the intermediate heat exchangers 251-253 improves the performance of the heat exchange in the case of heating the water.

Although water is used as the user-side refrigerant in Embodiment 2 as well, the antifreeze solution, the mixture of water and antifreeze solution, or the mixture of water and additive having the high anticorrosive effect may also be used. In this configuration, the leakage of refrigerant due to freezing or corrosion can be prevented even at a low outside air temperature, so that a high reliability is achieved. In the user-side refrigerant circuit B installed in the room such as computer rooms which dislike moisture, the fluorinated inactive liquid having high heat insulation properties may be used as the user-side refrigerant.

Although the three-way valves 261-263 are provided as the refrigerant flow channel switching devices, the two two-way switching valves may be provided as the refrigerant flow channel switching device. Although the three-way valve having the bidirectional flow system has a complex sealing structure and costs much, the air conditioning apparatus 1 can be manufactured at a low cost by using inexpensive two-way switching valve.

Embodiment 3

Although the flow rate of the water flowing in the user-side refrigerant circuits B1-B3 is not controlled in Embodiment 1 and Embodiment 2, the user-side refrigerant circuits B1-B3 may be configured to control the flow rate of the water flowing in the user-side refrigerant circuits B1-B3.

Figure 19:
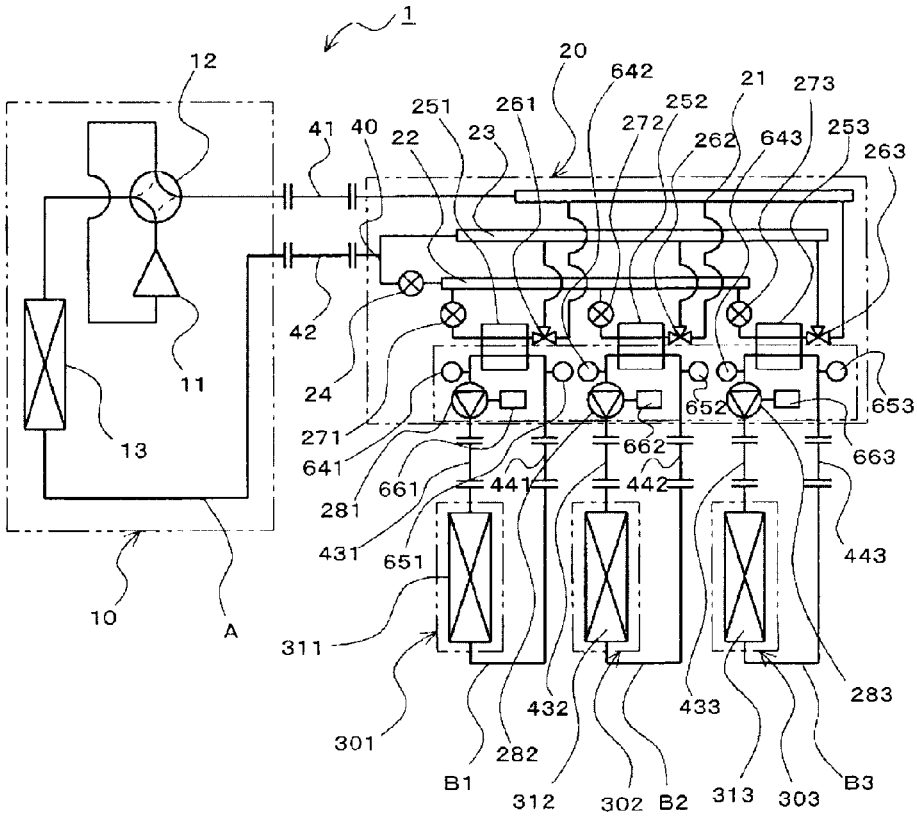
FIG. 19 is a refrigerant circuit diagram of the air conditioning apparatus according to Embodiment 3 in the present invention.

FIG. 19 is a refrigerant circuit diagram of the air conditioning apparatus according to Embodiment 3 in the present invention. The air conditioning apparatus 1 is provided with first temperature sensors 641-643, the second temperature sensors 651-653, and inverters 661-663 in the user-side refrigerant circuit in the air conditioning apparatus 1 shown in Embodiment 1. Here, the inverters 661-663 correspond to the fourth refrigerant flow rate control device in the present invention.

The first temperature sensors 641-643 are provided in the inlet-side piping (relay unit side) of the indoor heat exchangers 311-313 respectively for detecting the temperature of the water flowing into the indoor heat exchangers 311-313. The second temperature sensors 651-653 are provided in the outlet-side piping (relay unit side) of the indoor heat exchangers 311-313 respectively for detecting the temperature of the water flowing out from the indoor heat exchangers 311-313. The inverters 661-663 are provided in the pumps 281-283 respectively for adjusting the flow rate of the water flowing in the user-side refrigerant circuits B1-B3.

Although the first temperature sensors 641-643 are provided on the intake sides of the pumps 281-283 in Embodiment 3, the first temperature sensors 641-643 may be provided on the discharge sides of the pumps 281-283. In other words, what is essential is to detect the temperature of the water flowing into the indoor heat exchangers 311-313.

(Operating Actions)

Subsequently, an example of the operating actions of the first temperature sensors 641-643, the second temperature sensors 651-653, and the inverters 661-663 will be described. The operating actions of the first temperature sensors 641-643, the second temperature sensors 651-653, and the inverters 661-663 are the same in the respective user-side refrigerant circuits B1-B3, the user-side refrigerant circuit B is used for the description of the operating action.

When the indoor unit 301 starts the operation, the first temperature sensor 641 detects the temperature (hereinafter, referred to as T1) of the water flowing into the indoor heat exchanger 311. The second temperature sensor 651 detects the temperature (hereinafter, referred to as T2) of the water flowing out from the indoor heat exchanger 311. The inverter 661 adjusts the discharge of the pump 281 (that is, the flow rate of the user-side refrigerant circuit B) on the basis of the values of T1 and T2. The flow rate of the inverter 66 may be adjusted according to the air volume of a fan (not shown) provided in the indoor unit, for example.

(Cooling Operation)

First of all, a case where the indoor unit 301 performs the cooling operation will be described.

When the detected valve T1 of the first temperature sensor 641 is higher than a predetermined temperature T3, the inverter 661 increases the discharge of the pump 281 (that is, the flow rate of the user-side refrigerant circuit B) in order to increase the quantity of heat exchange between the water and the heat source-side refrigerant in the intermediate heat exchanger 251. When the detected valve T1 of the first temperature sensor 641 is lower than the predetermined temperature T3, the inverter 661 decreases the discharge of the pump 281 (that is, the flow rate of the user-side refrigerant circuit B) in order to restrain an excessive heat exchange between the water and the heat source-side refrigerant in the intermediate heat exchanger 251.

Here, the predetermined temperature T3 is a value determined by, for example, a set temperature of the indoor unit 301, a temperature preset in the air conditioning apparatus 1, a value calculated on the basis of these items of temperature information (for example, differential temperature or the like), the air volume of the fan (not shown) provided in the indoor unit 301, or a correction temperature calculated from these temperatures and the air volume of the fan.

When the detected valve T2 of the second temperature sensor 651 is higher than a predetermined temperature T4, the inverter 661 increases the discharge of the pump 281 (that is, the flow rate of the user-side refrigerant circuit B) in order to increase the quantity of heat exchange between the water and the indoor air in the indoor heat exchanger 311. When the detected valve T2 of the second temperature sensor 651 is lower than the predetermined temperature T4, the inverter 661 decreases the discharge of the pump 281 (that is, the flow rate of the user-side refrigerant circuit B) in order to restrain the excessive heat exchange between the water and the indoor air in the indoor heat exchanger 311.

Here, the predetermined temperature T4 is a value determined by, for example, the set temperature of the indoor unit 301, the temperature preset in the air conditioning apparatus 1, the value calculated on the basis of these items of temperature information (for example, the differential temperature or the like), the air volume of the fan (not shown) provided in the indoor unit 301, or the correction temperature calculated from these temperatures and the air volume of the fan.

(Heating Operation)

Subsequently, a case where the indoor unit 301 performs the heating operation will be described.

When the detected valve T1 of the first temperature sensor 641 is lower than a predetermined temperature T5, the inverter 661 increases the discharge of the pump 281 (that is, the flow rate of the user-side refrigerant circuit B) in order to increase the quantity of heat exchange between the water and the heat source-side refrigerant in the intermediate heat exchanger 251. When the detected valve T1 of the first temperature sensor 641 is higher than the predetermined temperature T3, the inverter 661 decreases the discharge of the pump 281 (that is, the flow rate of the user-side refrigerant circuit B) in order to restrain the excessive heat exchange between the water and the heat source-side refrigerant in the intermediate heat exchanger 251.

Here, the predetermined temperature T5 is a value determined by, for example, the set temperature of the indoor unit 301, the temperature preset in the air conditioning apparatus 1, the value calculated on the basis of these items of temperature information (for example, the differential temperature or the like), the air volume of the fan (not shown) provided in the indoor unit 301, or the correction temperature calculated from these temperatures and the air volume of the fan.

When the detected valve T2 of the second temperature sensor 651 is lower than a predetermined temperature T6, the inverter 661 increases the discharge of the pump 281 (that is, the flow rate of the user-side refrigerant circuit B) in order to increase the quantity of heat exchange between the water and the indoor air in the indoor heat exchanger 311. When the detected valve T2 of the second temperature sensor 651 is higher than the predetermined temperature T6, the inverter 661 decreases the discharge of the pump 281 (that is, the flow rate of the user-side refrigerant circuit B) in order to restrain the excessive heat exchange between the water and the indoor air in the indoor heat exchanger 311.

Here, the predetermined temperature T6 is a value determined by the set temperature of the indoor unit 301, the temperature preset in the air conditioning apparatus 1, the value calculated on the basis of these items of temperature information (for example, the differential temperature or the like), the air volume of the fan (not shown) provided in the indoor unit 301, or the correction temperature calculated from these temperatures and the air volume of the fan.

Although the inverter 661 adjusts the flow rate of the water flowing in the user-side refrigerant circuit B1 using both the detected valve T1 and the detected valve T2 in Embodiment 3, the flow rate of the water flowing in the user-side refrigerant circuit B1 may be adjusted one of the detected valve T1 and the detected valve T2. It is also possible to adjust the flow rate of the water flowing in the user-side refrigerant circuit B1 on the basis of the set temperature of the indoor unit 301, the air volume of the fan (not shown) provided in the indoor unit 301 or the like without using the detected valve T1 and the detected valve T2. The same advantages are obtained also by providing pressure sensors instead of the first temperature sensors 641-643 and the second temperature sensors 651-653 and adjusting the flow rate of the water flowing in the user-side refrigerant circuit B1 according to the pressure differences or the like at outlet and inlet ports of the pumps 281-283.

In the air conditioning apparatus 1 in this configuration, the flow rate of the water can be controlled according to a heat load of the indoor units 301-303, so that motive power of the pumps 281-283 may be reduced.

In contrast to a multi-chamber type air conditioning apparatus in the related art, it is not necessary to provide the refrigerant flow rate control devices (for example, a restrictor in Patent Document 2) in the indoor units 301-303. Therefore, noise from the indoor unit can be reduced.

In the multi-chamber type air conditioning apparatus in the related art, the room temperature is adjusted by detecting the temperature of the refrigerant flowing into the indoor heat exchanger and the temperature of the refrigerant flowing out from the outdoor heat exchanger, and controlling the amount of restriction in the refrigerant flow rate control device on the basis of these temperatures. Therefore, in order to adjust the room temperature, communications between the relay unit and the indoor units are needed in addition to the communications between the outdoor unit and the relay unit. However, according to the air conditioning apparatus in Embodiment 3, the temperature adjustment in the room is achieved only by controlling the discharge of the pumps 281-283 (that is, the flow rate of the user-side refrigerant circuits B1-B3) on the basis of the detected values (T1 and T2) of the first temperature sensors 641-643 and the second temperature sensors 651-653 provided in the relay unit 20. Therefore, the communications between the relay unit 20 and the indoor units 301-303 for adjustment of the room temperature are not needed, so that the control of the air conditioning apparatus 1 can be simplified.

Although the inverters 661-663 are used as the fourth refrigerant flow rate control device in Embodiment 3, other configurations may be employed. For example, bypass piping which connects refrigerant inlet-side piping and refrigerant outlet-side piping of the indoor heat exchangers 311-313 may be provided. The flow rate of the user-side refrigerant flowing into the indoor heat exchangers 311-313 can be adjusted by providing a flow rate control valve or the like in the bypass piping and controlling the flow rate of the refrigerant in the bypass piping. Also, for example, the flow rate of the water flowing in the user-side refrigerant circuits B1-B3 may be adjusted by making up the pumps 281-283 of a plurality of pumps and changing the number of the pumps to be operated.

As described thus far, although strainers for catching refuses in the water, expansion tanks for preventing the piping from breaking due to the expansion of the water, constant pressure valves for adjusting the discharge pressures of the pumps 281-283 and the like are not provided in the user-side refrigerant circuits B1-B3, such auxiliary devices for preventing the valves in the pumps 281-283 from being clogged may be provided.

Embodiment 4

In Embodiment 4, an example of a method of installing the air conditioning apparatus 1 shown in Embodiment 1 to Embodiment 3 in a building will be described.

Figure 20:
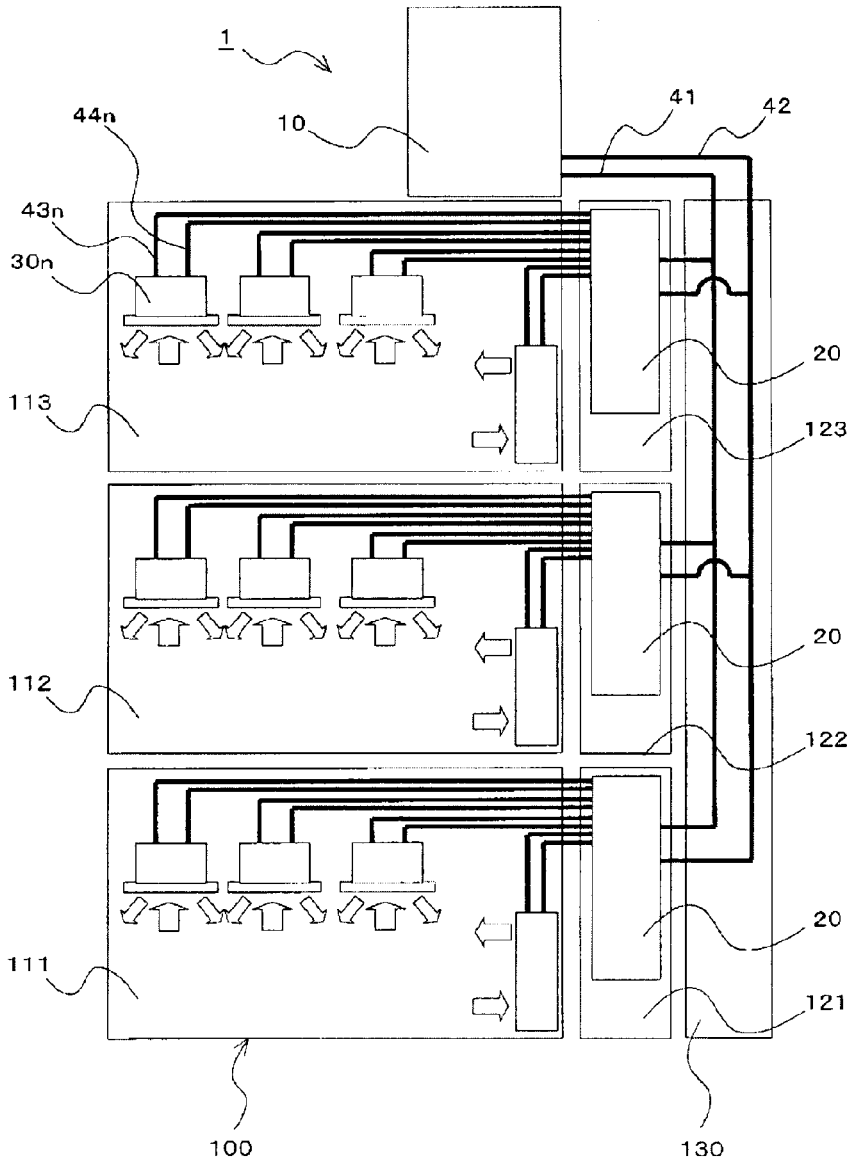
FIG. 20 is a schematic installation drawing of an air conditioning apparatus according to Embodiment 4 in the present invention.

FIG. 20 is a schematic installation drawing of the air conditioning apparatus in Embodiment 4. The outdoor unit 10 is installed on the roof of a building 100. The relay unit 20 is installed in a shared space 121 provided on a first floor of the building 100. Then, four pieces of the indoor units 301-304 are installed in a living space 111 provided on the first floor of the building 100. In the same manner, the relay units 20 are installed in shared spaces 122 and 123 on a second floor and a third floor of the building 100, and four pieces of the indoor units 301-304 are installed in living spaces 112 and 113. Here, the term "shared spaces 12*n*" means a mechanical room, a shared corridor, a lobby, and the like provided on each floor of the building 100. In other words, the shared spaces 12*n* mean spaces other than the living space 11*n* provided in the respective floors of the building 100.

The relay units 20 installed in the shared spaces on the respective floors are connected to the outdoor unit 10 by the first extension piping 41 and the second extension piping 42 provided in a piping-installed space 130. The indoor units 301-304 installed in the living spaces on the respective floors are connected to the relay units 20 installed in the shared spaces on the respective floors by the third extension piping 431-434 and the fourth extension piping 441-444.

In the air conditioning apparatus 1 configured in this manner, since the water flows in the piping installed in the living spaces 111-113, the refrigerant whose allowable concentration when leaking into a space is kept under control can be prevented from leaking into the living spaces 111-113. Also, the cooling-heating simultaneous operation of the indoor units 301-304 on the respective floors is enabled.

Also, since the outdoor unit 10 and the relay units 20 are provided in places other than the living space, maintenance may be performed easily.

Since the relay unit 20 is separable from the indoor units 301-304, the indoor units 301-304, the third extension piping 431-434, and the fourth extension piping 441-444 are reusable when the air conditioning apparatus 1 is installed instead of equipment which has been using the water refrigerant previously.

The outdoor unit 10 does not have to be installed on the roof of the building 100 and, for example, the basement or the mechanical rooms on the respective floors may also be applicable.

Embodiment 5

Figure 21:
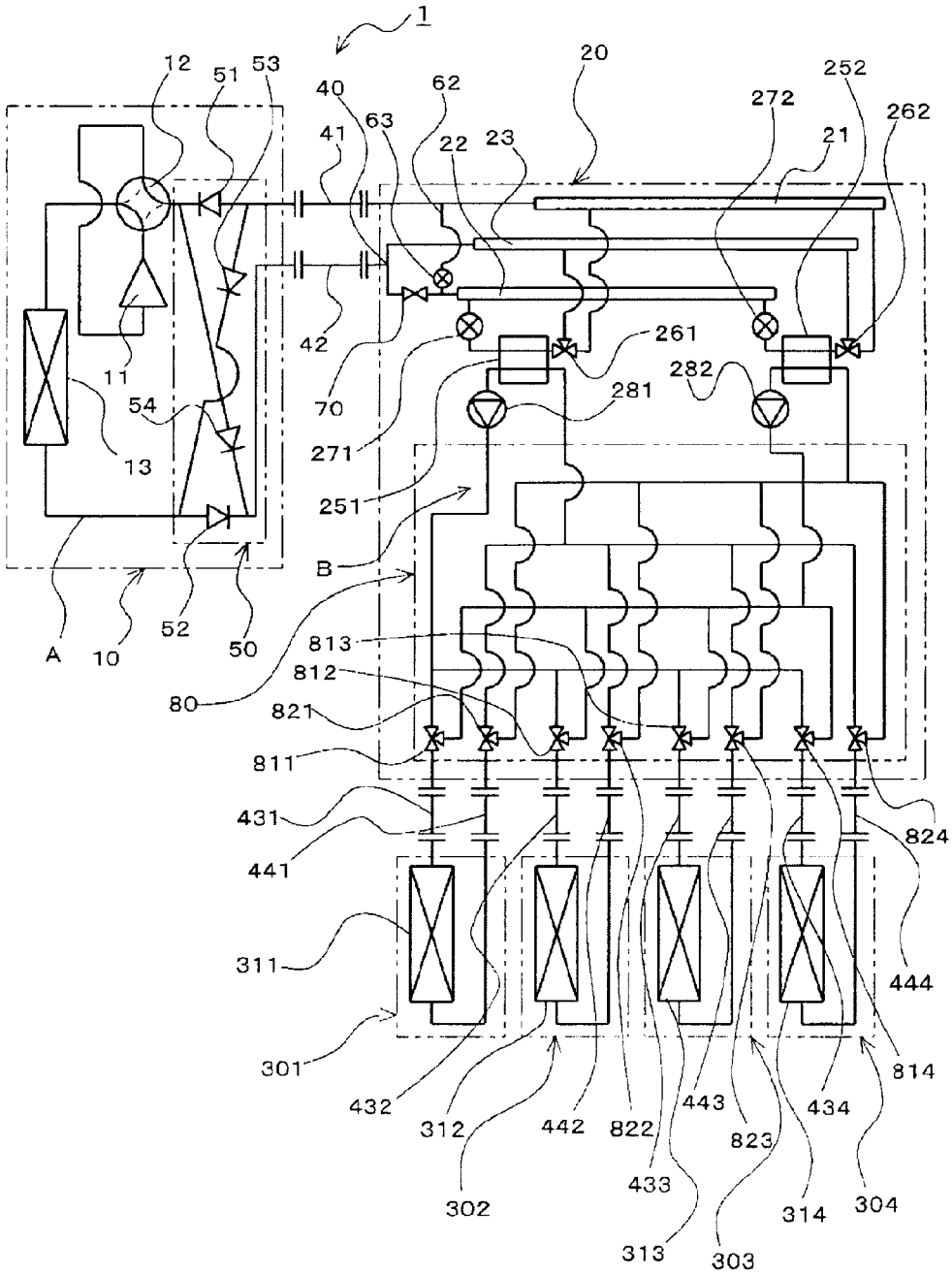
FIG. 21 is a refrigerant circuit diagram of the air conditioning apparatus according to Embodiment 5 in the present invention.

FIG. 21 is a refrigerant circuit diagram of the air conditioning apparatus according to Embodiment 5 in the present invention.

The air conditioning apparatus 1 includes the heat source-side refrigerant circuit A having the outdoor heat exchanger 13 or the like configured to perform the heat exchange with the outdoor air, and the user-side refrigerant circuit B having the indoor heat exchangers 31*n* c (hereinafter, n represents 1 and larger natural numbers, and represents the number of pieces of the indoor heat exchangers) configured to perform the heat exchange with the indoor air. The heat source-side refrigerant circulating in the heat source-side refrigerant circuit A and the user-side refrigerant circulating in the user-side refrigerant circuit B perform the heat exchange with respect to each other in the intermediate heat exchangers 25*n*. Then, respective components in the heat source-side refrigerant circuit A and the user-side refrigerant circuit B are provided in the outdoor unit 10, the relay unit 20, and the indoor units 30*n*. In Embodiment 5, the water is used as the user-side refrigerant.

In Embodiment 5, although the number of the indoor units 30*n* is four (n=4), it may be two or three, and may be four or more. The number of the relay units 20 is not limited to one, and a plurality of pieces may be provided. In other words, the present invention may be implemented in a configuration in which a plurality of the indoor units are provided in each of the plurality of relay units. Also, a plurality of the outdoor units 10 may be provided according to the output load.

The heat source-side refrigerant circuit A includes the compressor 11, the four-way valve 12, the outdoor heat exchanger 13, the refrigerant flow channel switching unit 50, the bypass piping 62, the third refrigerant flow rate control device 63, the first refrigerant branch portion 21, the second refrigerant branch portion 22, the third refrigerant branch portion 23, the intermediate heat exchangers 251 and 252, an opening and closing device 70, the three-way valves 261 and 262, and the second refrigerant flow rate control devices 271 and 272. Here, the four-way valve 12, the three-way valves 261, 262, and the refrigerant flow channel switching unit 50 correspond to the second refrigerant flow channel switching device, the first refrigerant flow channel switching device, and the third refrigerant flow channel switching device in the present invention, respectively.

The relay unit 20 is provided with the opening and closing device 70 provided between the branch piping 40 and the second refrigerant branch portion 22, and the bypass piping 62 connecting the first refrigerant branch portion 21 and the third refrigerant branch portion 23. The bypass piping 62 is provided with the third refrigerant flow rate control device 63.

The user-side refrigerant circuit B includes the intermediate heat exchangers 251 and 252, the pumps 281 and 282, the user-side refrigerant flow channel switching unit 80, and the indoor heat exchangers 311-314. The indoor heat exchangers 311-314 each are connected at one side thereof to each of the intermediate heat exchangers 251 and 252 via each of the third extension piping 431-434, the user-side refrigerant flow channel switching unit 80, and the pumps 281 and 2B2. Each of the other sides thereof are connected to each of the intermediate heat exchangers 251 and 252 via each of the fourth extension piping 441-444 and the user-side refrigerant flow channel switching unit 80. Here, the pumps 281 and 282 correspond to the circulating device in the present invention.

The user-side refrigerant flow channel switching unit 80 is configured to supply the user-side refrigerant of at least one of the user-side refrigerant heat-exchanged in the intermediate heat exchanger 251 and the user-side refrigerant heat-exchanged in the intermediate heat exchanger 252 to the indoor units 301-304. The user-side refrigerant flow channel switching unit 80 includes a plurality of water flow channel switching valves (first switching valves 81*n* and second switching valves 82*n*). The numbers of the first switching valves 81*n* and the second switching valves 82*n* to be provided correspond to the number of pieces of the indoor unit 30 to be connected to the relay unit 20 (four each in this case). In Embodiment 5, the three-way valves are used as the first switching valves 81*n* and the second switching valves 82*n*.

The refrigerant piping in the user-side refrigerant flow channel switching unit 80 is branched according to the number of pieces of the indoor units to be connected to the relay unit 20 (the user-side refrigerant flow channel switching unit 80) (four branches each in this case). More specifically, the refrigerant piping connected to one side of the intermediate heat exchanger 251 via the pump 281 is branched into four, and are connected to respective first switching valves 811-814. The refrigerant piping connected to one side of the intermediate heat exchanger 252 via the pump 282 is also branched into four, and are connected to the respective first switching valves 811-814. Remaining connecting ports of the first switching valves 811-814 are connected to the indoor heat exchangers 311-314 via the third extension piping 431-434 respectively. In other words, the first switching valves 811-814 are respectively configured to switch refrigerant inlet routes to the respective indoor heat exchangers 311-314 to routes through which the refrigerant flows in from the intermediate heat exchanger 251 or routes through which the refrigerant flows in from the intermediate heat exchanger 252.

Also, the refrigerant piping connected to the other side of the intermediate heat exchanger 251 is branched into four, and are connected to respective second switching valves 821-824. The refrigerant piping connected to the other side of the intermediate heat exchanger 252 is also branched into four, and are connected to the respective second switching valves 821-824. Remaining connecting ports of the second switching valves 821-824 are connected to the indoor heat exchangers 311-314 via the fourth extension piping 441-444 respectively. In other words, the second switching valves 821-824 are respectively configured to switch refrigerant outlet routes from the respective indoor heat exchangers 311-314 to routes through which the refrigerant flows out to the intermediate heat exchanger 251 or routes through which the refrigerant flows out to the intermediate heat exchanger 252.

The pumps 281 and 282 are configured to circulate the user-side refrigerant in the user-side refrigerant circuit (more specifically, between the intermediate heat exchangers 251 and 252 and the indoor heat exchangers 311-314). The type of the pumps 281 and 282 do not have to be specifically limited, and may be made up of, for example, a type which allows capacity control. The first switching valves 811-814 and the second switching valves 821-824 may be made up of two each of the two-way valves.

(Operating Actions)

Subsequently, the operating actions of the air conditioning apparatus 1 in Embodiment 5 will be described. The operating actions of the air conditioning apparatus 1 include four modes; the cooling operation mode, the heating operation mode, the cooling-dominated operation mode, and the heating-dominated operation mode.

(Cooling Operation Mode)

First of all, the cooling operation mode will be described.

Figure 22:
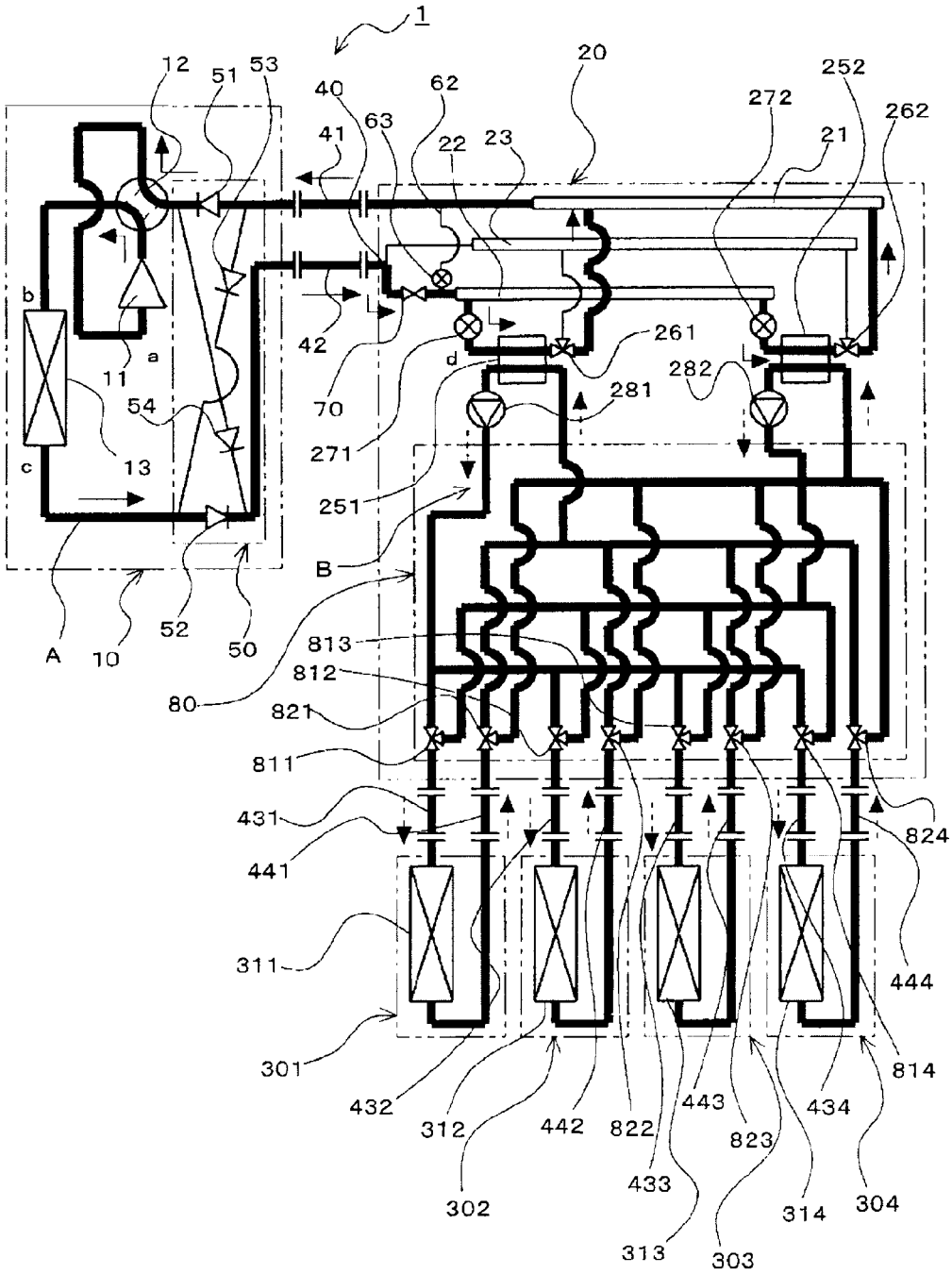
FIG. 22 is a refrigerant circuit diagram showing the flow of the refrigerant in a cooling operation mode of the air conditioning apparatus according to Embodiment 5 in the present invention.
Figure 23:
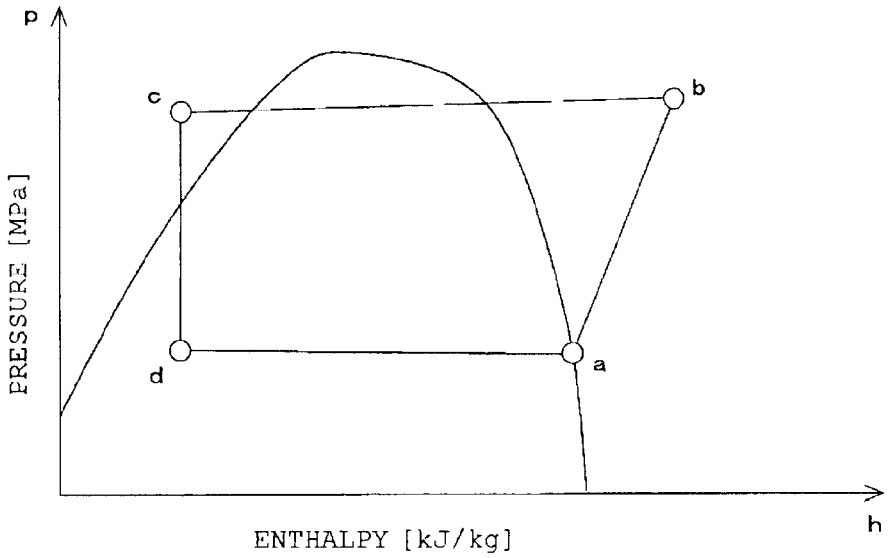
FIG. 23 is a p-h diagram showing the change of the heat source-side refrigerant in FIG. 22.

FIG. 22 is a refrigerant circuit diagram showing the flow of the refrigerant in the cooling operation mode of the air conditioning apparatus according to Embodiment 5 in the present invention. FIG. 23 is a p-h diagram showing the change of the heat source-side refrigerant in the cooling operation mode.

In FIG. 22, piping illustrated in thick lines indicates piping in which the refrigerant circulates. Then, the direction of flow of the heat source-side refrigerant is indicated by arrows of solid lines, and the direction of flow of water as the user-side refrigerant is indicated by arrows of broken lines. The states of refrigerant a-d shown in FIG. 23 indicate the states of the refrigerant at points indicated by reference signs a-d in FIG. 22, respectively.

When all the indoor units 301-304 perform the cooling operation, the four-way valve 12 is switched to allow the heat source-side refrigerant being discharged from the compressor 11 to flow toward the outdoor heat exchanger 13. In other words, the four-way valve 12 is switched to allow the heat source-side refrigerant being discharged from the first refrigerant branch portion 21 of the relay unit 20 to pass through the first extension piping 41 and the first check valve 51 and to flow into the compressor 11. The three-way valves 261 and 262 are switched to allow the intermediate heat exchangers 251 and 252 to communicate with the first refrigerant branch portion 21, respectively. The respective second refrigerant flow rate control devices 271 and 272 restrict the degrees of the openings thereof. The degree of opening of the opening and closing device 70 is brought into a fully opened state. The third refrigerant flow rate control device 63 reduces the degree of opening thereof to a fully closed state.

In the user-side refrigerant flow channel switching unit 80 of the relay unit 20, the first switching valves 811-814 are switched so that the user-side refrigerant circulated by one or both of the pumps 281 and 282 is supplied to the indoor units 301-304 (the indoor heat exchangers 311-314) via the third extension piping 431-434. Also, the second switching valves 821-824 are switched so that the user-side refrigerant flowing back from the indoor units 301-304 to the relay unit 20 returns back to one or both of the intermediate heat exchangers 251 and 252. When the user-side refrigerant supplied from both the pumps 281 and 282 joins at the first switching valves 811-814 and is supplied to the indoor units 301-304, the first switching valves 811-814 operate as mixing valves. In a case where the user-side refrigerant flowing back from the indoor units 301-304 to the relay unit 20 is branched from the second switching valves 821-824 and returns to both the intermediate heat exchangers, the second switching valves 821-824 operate as distributing valves. In FIG. 22, a case where the first switching valves 811-814 operate as the mixing valves and the second switching valves 821-824 operate as the distributing valves is illustrated. In this state, the operations of the compressor 11 and the pumps 281 and 282 are started.

The flow in the heat source-side refrigerant circuit A will be described. The low-temperature low-pressure vapor-state refrigerant is compressed by the compressor 11 and is discharged as the high-temperature high-pressure refrigerant. The refrigerant compression process of the compressor 11 is expressed by an isentropic curve as shown from the point a to b in FIG. 23 on the assumption that heat entry and exit with respect to the periphery does not occur. The high-temperature high-pressure refrigerant being discharged from the compressor 11 passes through the four-way valve 12 and flows into the outdoor heat exchanger 13. Then, it is transformed into condensed liquid while dissipating heat the outdoor air, thereby becoming a high-pressure liquid-state refrigerant in the outdoor heat exchanger 13. The change of the refrigerant in the outdoor heat exchanger 13 is performed under a substantially constant pressure. The change of the refrigerant at this time is expressed by a line slightly inclined but substantially horizontal as shown from the point b to c in FIG. 23 when considering the pressure loss of the outdoor heat exchanger 13.

The high-pressure liquid-state refrigerant flowing out from the outdoor heat exchanger 13 passes through the second check valve 52, the second extension piping 42, and the opening and closing device 70 and flows into the second refrigerant branch portion 22. The high-pressure liquid-state refrigerant flowing into the second refrigerant branch portion 22 is branched from the second refrigerant branch portion 22 and flows into the second refrigerant flow rate control devices 271 and 272. Then, the high-pressure liquid-state refrigerant is restricted and then is expanded (decompressed) in the second refrigerant flow rate control devices 271 and 272, thereby assuming a low-temperature low-pressure gas-liquid two-phase state. The changes of the refrigerant in the second refrigerant flow rate control devices 271 and 272 are performed under a constant enthalpy. The change of the refrigerant at this time is expressed by a vertical line as shown from the point c to d in FIG. 23.

The low-temperature low-pressure gas-liquid two-phase state refrigerant flowing out from the second refrigerant flow rate control devices 271 and 272 flow into the intermediate heat exchangers 251 and 252, respectively. Then, the refrigerant absorbs heat from the water flowing in the intermediate heat exchangers 251 and 252, thereby becoming a low-temperature low-pressure vapor-state refrigerant. The changes of the heat source-side refrigerant in the intermediate heat exchangers 251 and 252 are performed under a substantially constant pressure. The change of the refrigerant at this time is expressed by a line slightly inclined but substantially horizontal as shown from the point d to a in FIG. 23 when considering the pressure loss of the intermediate heat exchangers 251 and 252.

The low-temperature low-pressure vapor-state refrigerant flowing out from the intermediate heat exchangers 251 and 252 passes through the three-way valves 261 and 262 respectively, and flows into the first refrigerant branch portion 21. The low-temperature low-pressure vapor-state refrigerant joining in the first refrigerant branch portion 21 flows into the compressor 11 through the first extension piping 41, the first check valve 51, and the four-way valve 12, and is compressed therein.

Subsequently, the flow of the refrigerant in the user-side refrigerant circuit B will be described.

The water cooled by the heat source-side refrigerant flowing in the intermediate heat exchanger 251 passes through the pump 281 and flows into the user-side refrigerant flow channel switching unit 80. The water flows into the first switching valves 811-814 after having branched. Also, the water cooled by the heat source-side refrigerant flowing in the intermediate heat exchanger 252 passes through the pump 282 and flows into the user-side refrigerant flow channel switching unit 80. Then the water flows into the first switching valves 811-814 after having branched. The water flowing from the pump 281 into the first switching valves 811-814 and the water flowing from the pump 282 to the first switching valves 811-814 joins in the first switching valves 811-814 and flows into the third extension piping 431-434.

The water flowing into the third extension piping 431-434 flows into the indoor heat exchangers 311-314. Then, the water absorbs heat from the indoor air in the indoor heat exchangers 311-314 to cool the interior of the room in which the indoor units 301-304 are provided. The water flowing out from the indoor heat exchangers 311-314 passes through the fourth extension piping and flows into the second switching valves 821-824. Then, the water is branched from the second switching valves 821-824 and flows into the respective intermediate heat exchangers 251 and 252.

(Heating Operation Mode)

Subsequently, the heating operation mode will be described.

Figure 24:
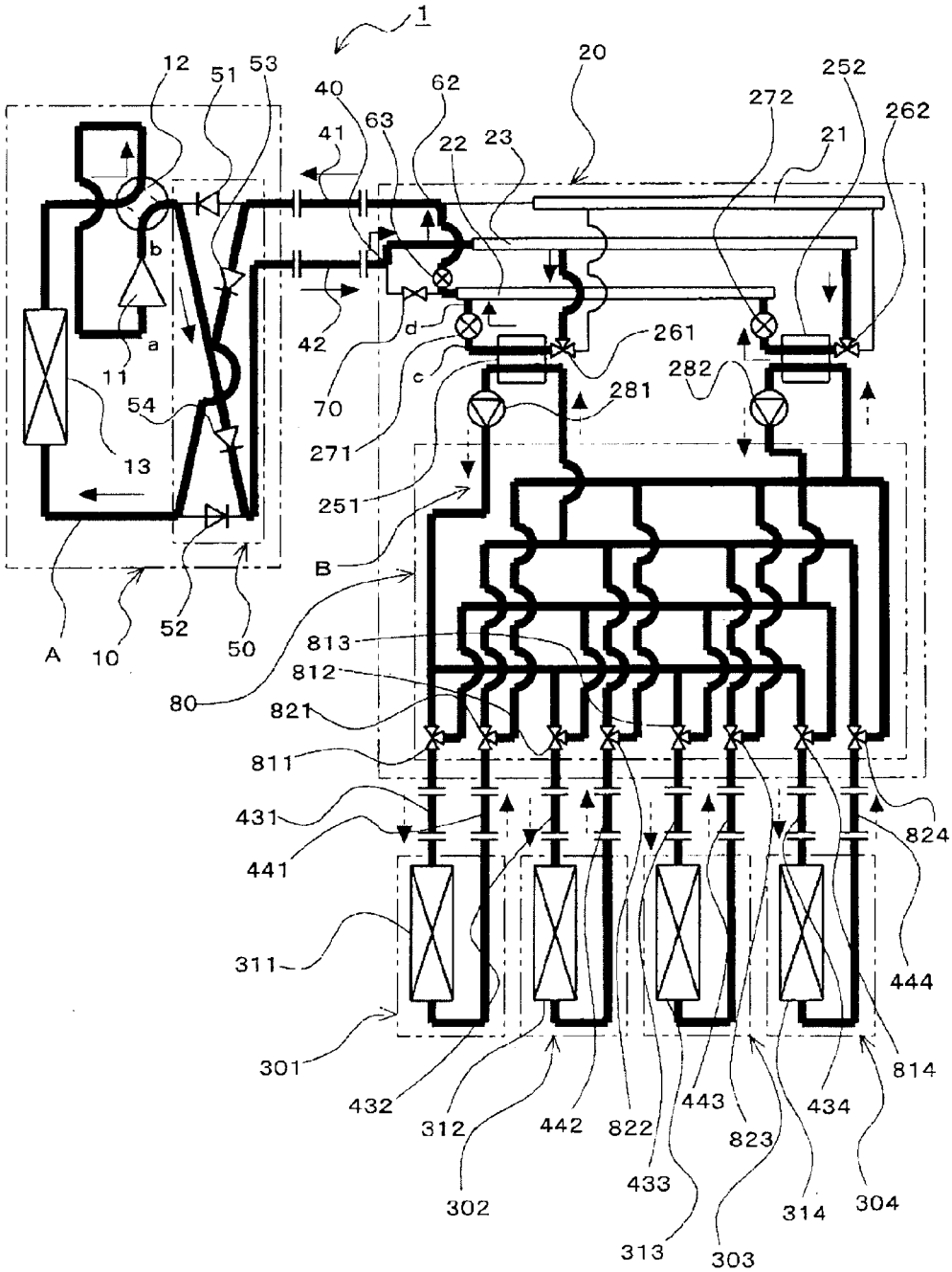
FIG. 24 is a refrigerant circuit diagram showing the flow of the refrigerant in a heating operation mode of the air conditioning apparatus according to Embodiment 5 in the present invention.
Figure 25:
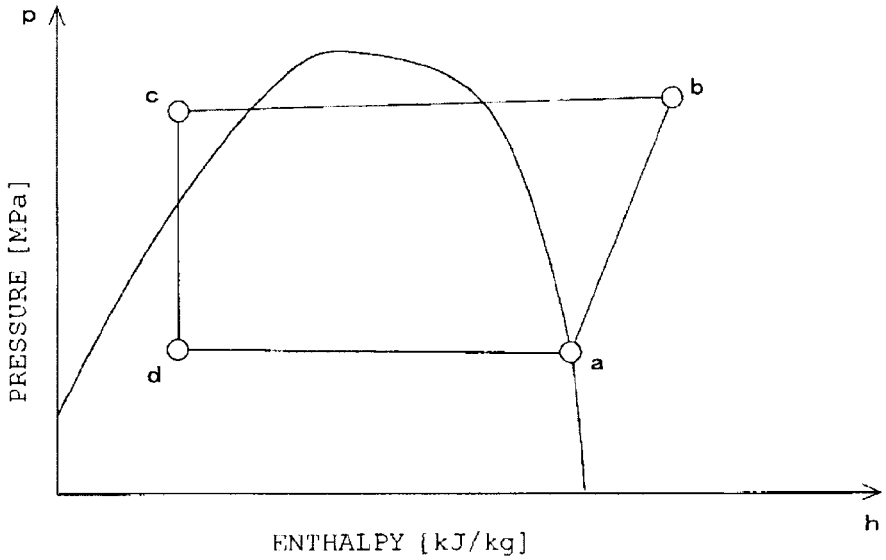
FIG. 25 is a p-h diagram showing the change of the heat source-side refrigerant in FIG. 24.

FIG. 24 is a refrigerant circuit diagram showing the flow of the refrigerant in the heating operation mode of the air conditioning apparatus according to Embodiment 5 in the present invention. FIG. 25 is a p-h diagram showing the change of the heat source-side refrigerant in the heating operation mode.

In FIG. 24, piping illustrated in thick lines indicates piping in which the refrigerant circulates. Then, the direction of flow of the heat source-side refrigerant is indicated by arrows of solid lines, and the direction of flow of water as the user-side refrigerant is indicated by arrows of broken lines. The states of refrigerant a-d shown in FIG. 25 indicate the states of the refrigerant at points indicated by reference signs a-d in FIG. 24, respectively.

When all the indoor units 301-304 perform the heating operation, the four-way valve 12 is switched to allow the heat source-side refrigerant being discharged from the compressor 11 to pass through the fourth check valve 54 and the second extension piping 42 and to flow into the third refrigerant branch portion 23 of the relay unit 20. In other words, the four-way valve 12 is switched to allow the heat source-side refrigerant flowing out from the outdoor heat exchanger 13 to flow into the compressor 11. The three-way valves 261 and 263 are switched to allow the intermediate heat exchangers 251 and 252 to communicate with the third refrigerant branch portion 23, respectively. The respective second refrigerant flow rate control devices 271 and 272 restrict the degrees of the openings thereof. The degree of opening of the opening and closing device 70 is brought into a fully closed state. The third refrigerant flow rate control device 63 increases the degree of opening thereof to a fully opened state. In this state, the operations of the compressor 11 and the pumps 281 and 282 are started.

The flow of the refrigerant in the heat source-side refrigerant circuit A will be described. The low-temperature low-pressure vapor-state refrigerant is compressed by the compressor 11 and is discharged as the high-temperature high-pressure refrigerant. The refrigerant compression process of the compressor 11 is expressed by an isentropic curve as shown from the point a to b in FIG. 25. The high-temperature high-pressure refrigerant being discharged from the compressor 11 passes through the four-way valve 12, the fourth check valve 54, and the second extension piping 42 and flows into the third refrigerant branch portion 23. The high-temperature high-pressure refrigerant flowing into the third refrigerant branch portion 23 is branched from the third refrigerant branch portion 23, passes through the three-way valves 261 and 262, and flows into the intermediate heat exchangers 251 and 252, respectively. Then, the refrigerant is transformed into condensed liquid while dissipating heat to the water flowing in the intermediate heat exchangers 251 and 252, thereby becoming a high-pressure liquid-state refrigerant. The change of the refrigerant at this time is expressed by a line slightly inclined but substantially horizontal as shown from the point b to c in FIG. 25.

The high-pressure liquid-state refrigerant flowing out from the intermediate heat exchangers 251 and 252 flows into the second refrigerant flow rate control devices 271 and 272. Then, the high-pressure liquid-state refrigerant is restricted and then is expanded (decompressed) in the second refrigerant flow rate control devices 271 and 272, thereby assuming a low-temperature low-pressure gas-liquid two-phase state. The change of the refrigerant at this time is expressed by a vertical line as shown from the point c to d in FIG. 25. The low-temperature low-pressure gas-liquid two-phase state refrigerant flowing out from the second refrigerant flow rate control devices 271 and 272 flows into the second refrigerant branch portion 22. The gas-liquid two-phase state refrigerant joining in the second refrigerant branch portion 22 passes through the bypass piping 62 and the third refrigerant flow rate control device 63 and flows into the first refrigerant branch portion 21 (more specifically, the piping which connects the first refrigerant branch portion 21 and the first extension piping 41). Subsequently, the refrigerant passes through the first extension piping 41 and the third check valve 53 and flows into the outdoor heat exchanger 13. Then, the refrigerant absorbs heat from the outdoor air in the outdoor heat exchanger 13, thereby becoming a low-temperature low-pressure vapor-state refrigerant. The change of the refrigerant at this time is expressed by a line slightly inclined but substantially horizontal as shown from the point d to a in FIG. 25. The low-temperature low-pressure vapor-state refrigerant flowing out from the outdoor heat exchanger 13 flows into the compressor 11 through the four-way valve 12, and is compressed therein, thereby becoming a high-temperature high-pressure refrigerant.

Subsequently, the flow of the refrigerant in the user-side refrigerant circuit B will be described.

The water heated by the heat source-side refrigerant flowing in the intermediate heat exchanger 251 passes through the pump 281 and flows into the user-side refrigerant flow channel switching unit 80. The water flows into the first switching valves 811-814 after having branched. Also, the water cooled by the heat source-side refrigerant flowing in the intermediate heat exchanger 252 passes through the pump 282 and flows into the user-side refrigerant flow channel switching unit 80. Then, the water flows into the first switching valves 811-814 after having branched. Then, the water flowing from the pump 281 into the first switching valves 811-814 and the water flowing from the pump 282 to the first switching valves 811-814 joins in the first switching valves 811-814, and flows into the third extension piping 431-434.

The water flowing into the third extension piping 431-434 flows into the indoor heat exchangers 311-314. Then, the water dissipates heat to the indoor air in the indoor heat exchangers 311-314 to heat up the interior of the room in which the indoor units 301-304 are provided. The water flowing out from the indoor heat exchangers 311-314 passes through the fourth extension piping and flows into the second switching valves 821-824. Then, the water is branched from the second switching valves 821-824 and flows into the intermediate heat exchangers 251 and 252 respectively.

(Cooling-Dominated Operation Mode)

Subsequently, the cooling-dominated operation mode will be described.

Figure 26:
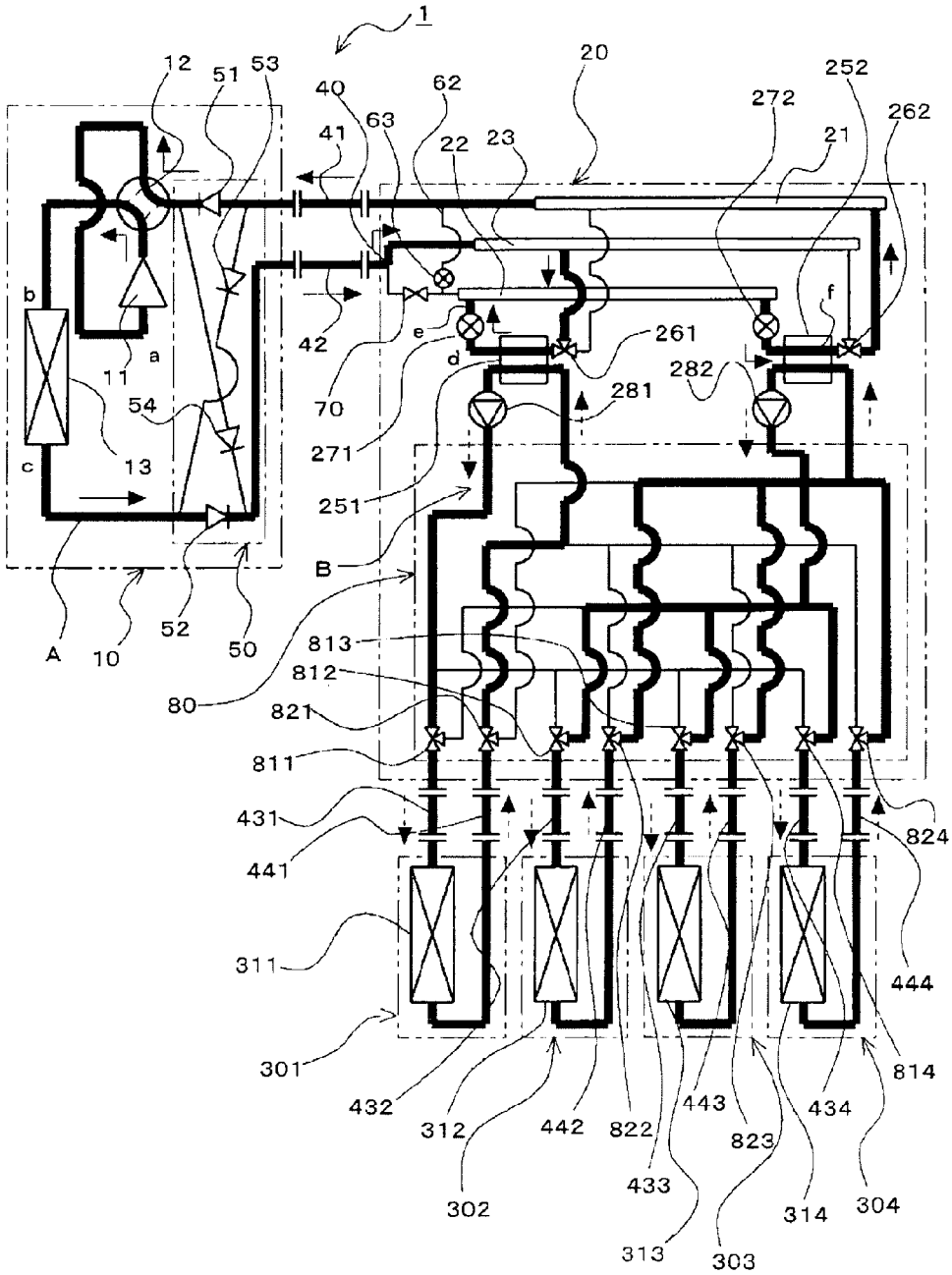
FIG. 26 is a refrigerant circuit diagram showing the flow of the refrigerant in a cooling-dominated operation mode of the air conditioning apparatus according to Embodiment 5 in the present invention.
Figure 37:
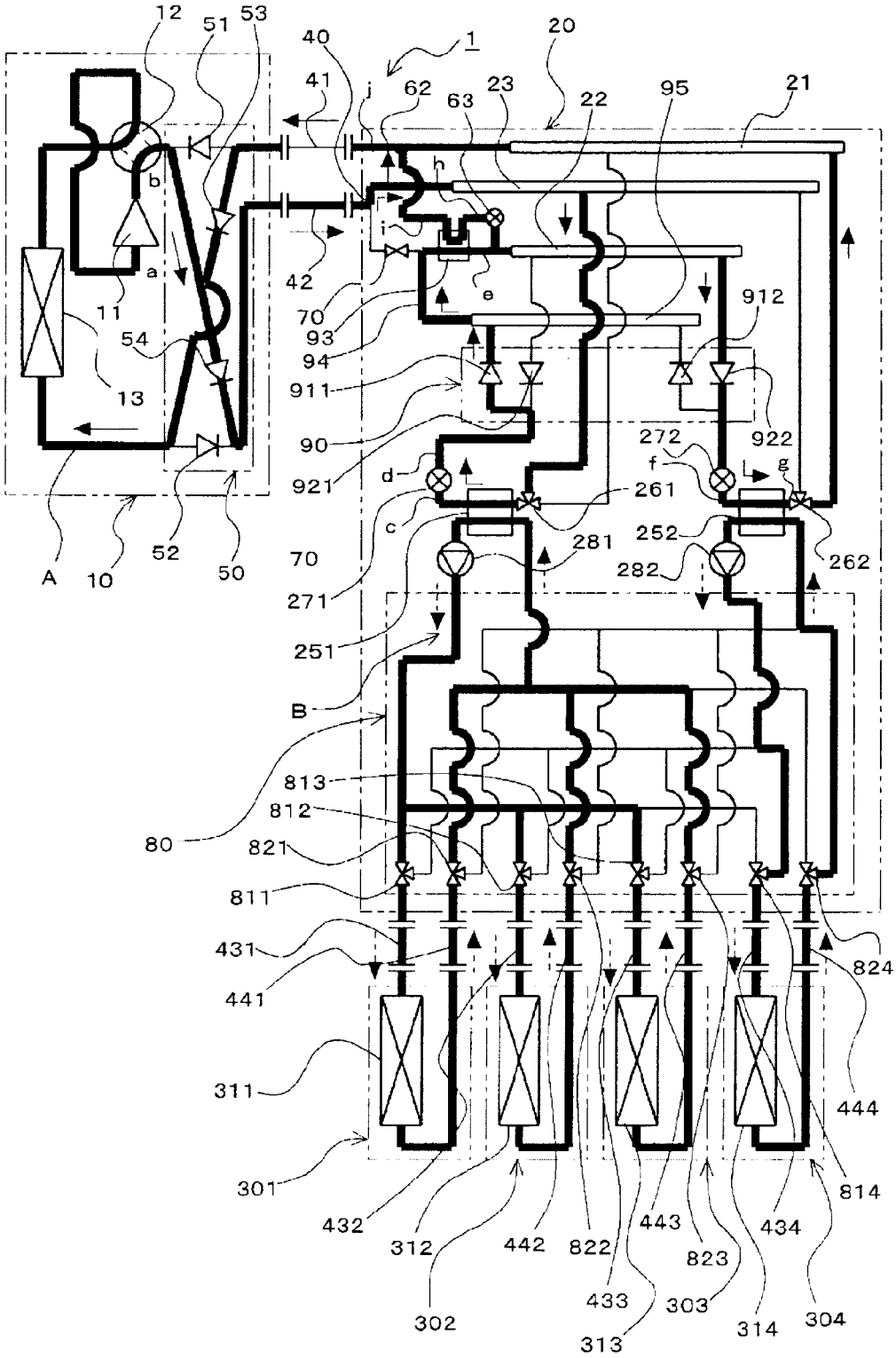
FIG. 37 is a refrigerant circuit diagram showing the flow of the refrigerant in a heating-dominated operation mode of the air conditioning apparatus according to Embodiment 6 in the present invention.

FIG. 26 is a refrigerant circuit diagram showing the flow of the refrigerant in the cooling-dominated operation mode of the air conditioning apparatus according to Embodiment 5 in the present invention. FIG. 37 is a p-h diagram showing the change of the heat source-side refrigerant in the cooling-dominated operation mode.

Figure 27:
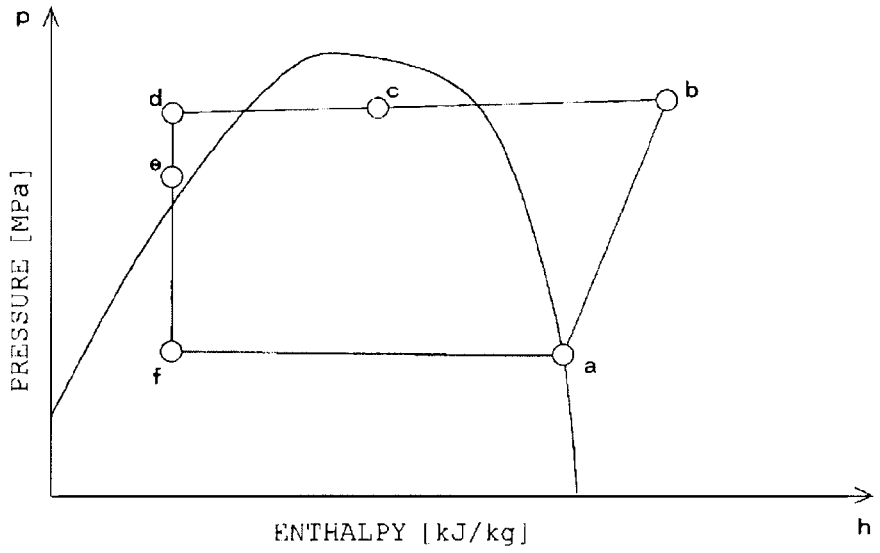
FIG. 27 is a p-h diagram showing the change of the heat source-side refrigerant in FIG. 26.

In FIG. 26, piping illustrated in thick lines indicates piping in which the refrigerant circulates. Then, the direction of flow of the heat source-side refrigerant is indicated by arrows of solid lines, and the direction of flow of water as the user-side refrigerant is indicated by arrows of broken lines. The states of refrigerant a-f shown in FIG. 27 indicate the states of the refrigerant at points indicated by reference signs a-f in FIG. 26, respectively.

In FIG. 26, the one indoor unit 30 on the left side of the drawing which performs the heating operation is illustrated as the indoor unit 301. Also, the three indoor units 30 which perform the cooling operation are illustrated as the indoor unit 302, the indoor unit 303, and the indoor unit 304 from the second indoor unit 30 from left side of the drawing to the indoor unit 30 on the right side of the drawing in sequence. The first switching valves to be connected to the indoor units 301-304 respectively are illustrated as the first switching valve 811 to the first switching valve 814, and the second switching valves connected respectively thereto are illustrated as the second switching valve 821 to the second switching valve 824.

A case where the indoor unit 301 performs the heating operation and the indoor units 302-304 perform the cooling operation will be described. The four-way valve 12 is switched to allow the heat source-side refrigerant being discharged from the compressor 11 to flow toward the outdoor heat exchanger 13. In other words, the four-way valve 12 is switched to allow the heat source-side refrigerant being discharged from the first refrigerant branch portion 21 of the relay unit 20 to pass through the first extension piping 41 and the first check valve 51 and to flow into the compressor 11. The three-way valve 261 is switched to allow the intermediate heat exchanger 251 to communicate with the third refrigerant branch portion 23. The three-way valve 262 is switched to allow the intermediate heat exchanger 252 to communicate with the first refrigerant branch portion 21. The second refrigerant flow rate control devices 271 and 272 restrict the degrees of the openings thereof. The degree of opening of the opening and closing device 70 is brought into a fully closed state. The third refrigerant flow rate control device 63 reduces the degree of opening thereof to a fully closed state.

In the user-side refrigerant flow channel switching unit 80 of the relay unit 20, the first switching valve 811 and the second switching valve 821 are switched to allow the user-side refrigerant to circulate between the intermediate heat exchanger 251 and the indoor unit 301 (the indoor heat exchanger 311). Also, the first switching valves 812-814 and the second switching valves 822-824 are switched to allow the user-side refrigerant to circulate between the intermediate heat exchanger 252 and the indoor units 302-304 (the indoor heat exchangers 312-314). In this state, the operations of the compressor 11 and the pumps 281 and 282 are started.

The flow of the refrigerant in the heat source-side refrigerant circuit A will be described. The low-temperature low-pressure vapor-state refrigerant is compressed by the compressor 11 and is discharged as the high-temperature high-pressure refrigerant. The refrigerant compression process of the compressor 11 is expressed by an isentropic curve as shown from the point a to b in FIG. 27. The high-temperature high-pressure refrigerant being discharged from the compressor 11 passes through the four-way valve 12 and flows into the outdoor heat exchanger 13. Then, the refrigerant condenses while dissipating heat to the outdoor air in the outdoor heat exchanger 13, thereby becoming a high-pressure gas-liquid two-phase state refrigerant. The change of the refrigerant at this time is expressed by a line slightly inclined but substantially horizontal as shown from the point b to c in FIG. 27.

The high-pressure gas-liquid two-phase refrigerant flowing out from the outdoor heat exchanger 13 passes through the second check valve 52 and the second extension piping 42 and flows into the third refrigerant branch portion 23. The high-pressure gas-liquid two-phase state refrigerant flowing into the third refrigerant branch portion 23 passes through the three-way valve 261, and flows into the intermediate heat exchanger 251. Then, the refrigerant condenses while dissipating heat to the water flowing in the intermediate heat exchanger 251, thereby becoming a liquid-state refrigerant. The change of the refrigerant at this time is expressed by a line slightly inclined but substantially horizontal as shown from the point c to d in FIG. 27. The refrigerant flowing out from the intermediate heat exchanger 251 is restricted and then is expanded (decompressed) in the second refrigerant flow rate control device 271 and flows into the second refrigerant branch portion 22. The change of the refrigerant at this time is expressed by a vertical line as shown from the point d to e in FIG. 27.

The refrigerant flowing into the second refrigerant branch portion 22 flows into the second refrigerant flow rate control device 272. Then, the refrigerant is further restricted and then is expanded (decompressed) in the second refrigerant flow rate control device 272, thereby assuming a low-temperature low-pressure gas-liquid two-phase state. The change of the refrigerant at this time is expressed by a vertical line as shown from the point e to f in FIG. 27. The low-temperature low-pressure gas-liquid two-phase state refrigerant flowing out from the second refrigerant flow rate control device 272 flows into the intermediate heat exchanger 252. Then, the refrigerant absorbs heat from the water flowing in the intermediate heat exchanger 252, thereby becoming a low-temperature low-pressure vapor-state refrigerant. The change of the refrigerant at this time is expressed by a line slightly inclined but substantially horizontal as shown from the point f to a in FIG. 27.

The low-temperature low-pressure vapor-state refrigerant flowing out from the intermediate heat exchanger 252 passes through the three-way valves 262 and flows into the first refrigerant branch portion 21. The low-temperature low-pressure vapor-state refrigerant flowing into the first refrigerant branch portion 21 flows into the compressor 11 through the first extension piping 41, the first check valve 51, and the four-way valve 12, and is compressed therein.

Subsequently, the flow of the user-side refrigerant in the user-side refrigerant circuit B will be described.

The flow of the user-side refrigerant when causing the indoor unit 301 to perform the heating operation will be described first, and then the flow of the user-side refrigerant when causing the indoor unit 302 to the indoor unit 304 to perform the cooling operation will be described.

The water heated by the heat source-side refrigerant in the intermediate heat exchanger 251 flows into the user-side refrigerant flow channel switching unit 80 by the pump 281. The water flowing into the user-side refrigerant flow channel switching unit 80 passes through the third extension piping 431 connected to the first switching valve 811 and flows into the indoor heat exchanger 311 of the indoor unit 301. Then, the water dissipates heat into the indoor air in the indoor heat exchanger 311 to heat up an area to be air-conditioned in the room or the like where the indoor unit 301 is installed. Subsequently, the water flowing out from the indoor heat exchanger 311 flows out from the indoor unit 301, passes through the fourth extension piping 441, and flows into the user-side refrigerant flow channel switching unit 80 (the second switching valve 821). The water flowing into the second switching valve 821 flows into the intermediate heat exchanger 251 again.

In contrast, the water cooled by the heat source-side refrigerant in the intermediate heat exchanger 252 flows into the user-side refrigerant flow channel switching unit 80 by the pump 282. The water flowing into the user-side refrigerant flow channel switching unit 80 is branched, then passes through the third extension piping 432-434 connected respectively to the first switching valve 812 to the first switching valve 814, and flows into the indoor heat exchangers 312-314 of the indoor unit 302 to the indoor unit 304. Then, the water absorbs heat from the indoor air in the indoor heat exchangers 312-314 to cool down the area to be air-conditioned in the room or the like where the indoor unit 302 to the indoor unit 304 are installed. Subsequently, the water flowing out from the indoor heat exchangers 312-314 flows out from the indoor unit 302 to the indoor unit 304, passes through the fourth extension piping 442-444, and flows into the user-side refrigerant flow channel switching unit 80 (the second switching valve 822 to the second switching valve 824). The water flowing into the second switching valve 822 to the second switching valve 824 joins in the user-side refrigerant flow channel switching unit 80 and flows into the intermediate heat exchanger 252 again.

(Heating-Dominated Operation Mode)

Subsequently, the heating-dominated operation mode will be described.

Figure 28:
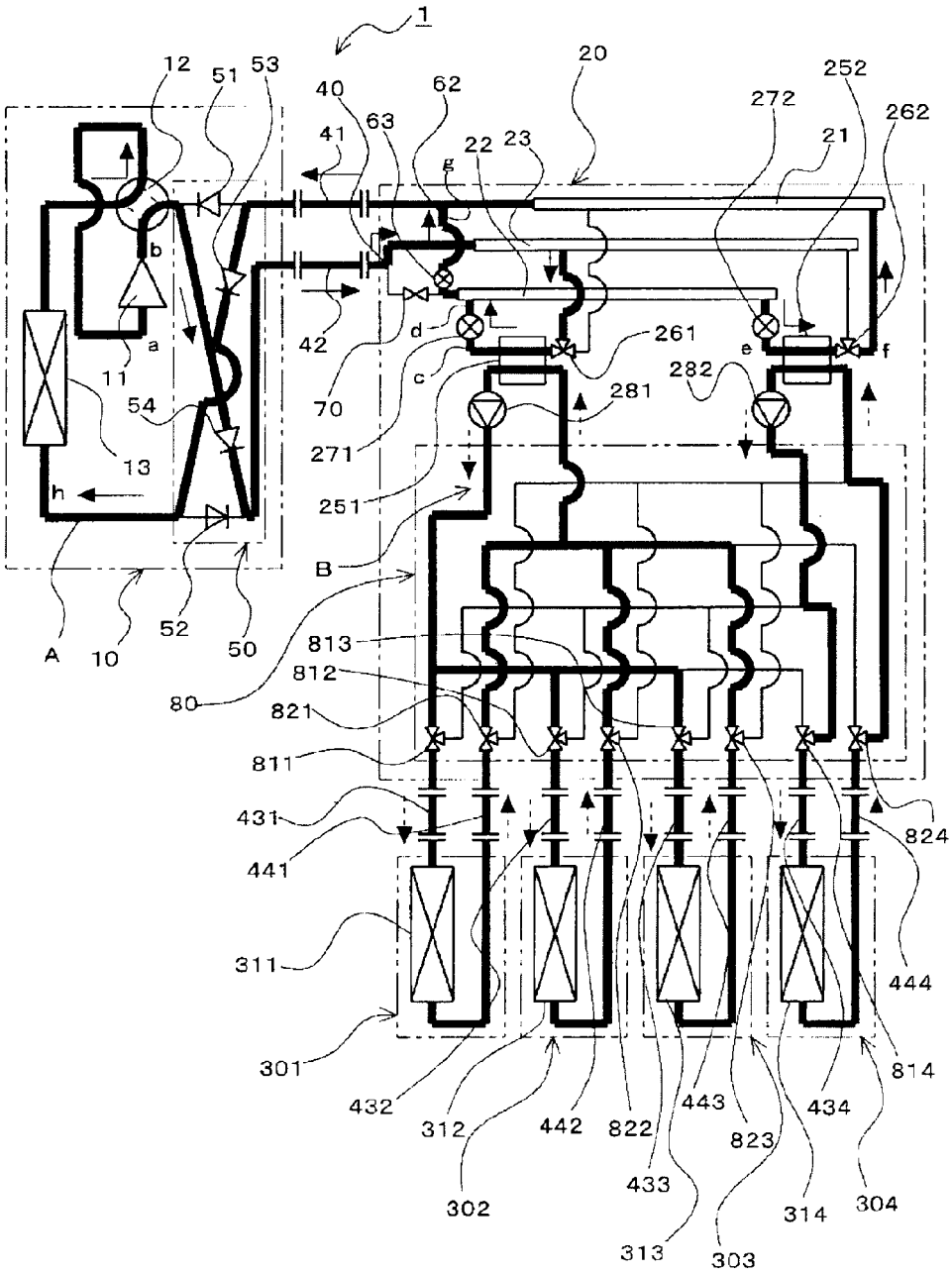
FIG. 28 is a refrigerant circuit diagram showing the flow of the refrigerant in a heating-dominated operation mode of the air conditioning apparatus according to Embodiment 5 in the present invention.
Figure 29:
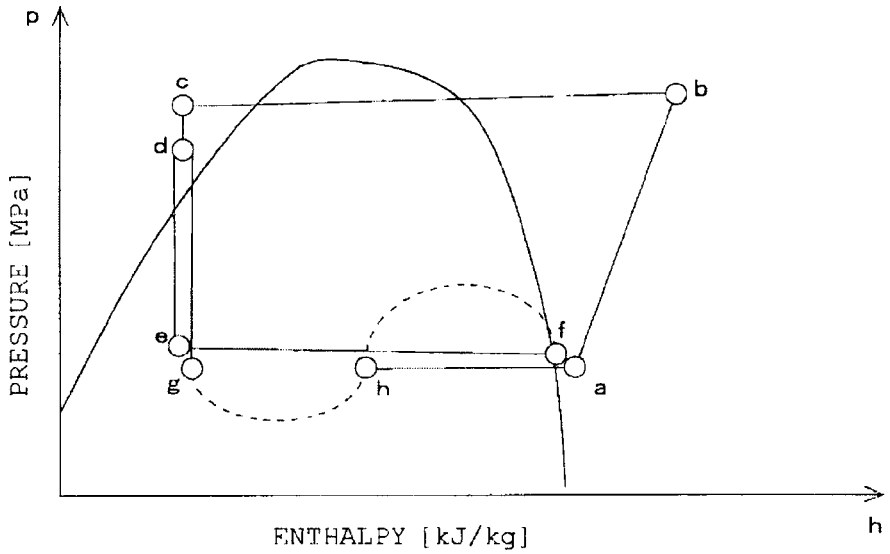
FIG. 29 is a p-h diagram showing the change of the neat source-side refrigerant in FIG. 28.

FIG. 28 is a refrigerant circuit diagram showing the flow of the refrigerant in the heating-dominated operation mode of the air conditioning apparatus according to Embodiment 5 in the present invention. FIG. 29 is a p-h diagram showing the change of the heat source-side refrigerant in the heating operation mode.

In FIG. 28, piping illustrated in thick lines indicates piping in which the refrigerant circulates. Then, the direction of flow of the heat source-side refrigerant is indicated by arrows of solid lines, and the direction of flow of water as the user-side refrigerant is indicated by arrows of broken lines. The states of refrigerant a-h shown in FIG. 29 indicate the states of the refrigerant at points indicated by reference signs a-h in FIG. 28, respectively.

A case where the indoor units 301-303 perform the heating operation and the indoor unit 304 performs the cooling operation will be described. The four-way valve 12 is switched to allow the heat source-side refrigerant being discharged from the compressor 11 to pass through the fourth check valve 54 and the second extension piping 42 and to flow into the third refrigerant branch portion 23 of the relay unit 20. In other words, the four-way valve 12 is switched to allow the heat source-side refrigerant flowing out from the outdoor heat exchanger 13 to flow into the compressor 11. The three-way valve 261 is switched to allow the intermediate heat exchanger 251 to communicate with the third refrigerant branch portion 23. The three-way valve 262 is switched to allow the intermediate heat exchanger 252 to communicate with the first refrigerant branch portion 21. The second refrigerant flow rate control devices 271 and 272 restrict the degrees of the openings thereof. The degree of opening of the opening and closing device 70 is brought into a fully closed state. The third refrigerant flow rate control device 63 reduces the degree of opening thereof to allow part of the heat source-side refrigerant flowing into the second refrigerant branch portion 22 to flow to the bypass piping 62. In this state, the operations of the compressor 11 and the pumps 281 and 282 are started.

In the user-side refrigerant flow channel switching unit 80 of the relay unit 20, the first switching valves 811-813 and the second switching valves 821-823 are switched to allow the user-side refrigerant to circulate between the intermediate heat exchanger 251 and the indoor units 301-303 (the indoor heat exchangers 311-313), respectively. Also, the first switching valve 814 and the second switching valve 824 are switched to allow the user-side refrigerant to circulate between the intermediate heat exchanger 252 and the indoor unit 304 (the indoor heat exchanger 314). In this state, the operations of the compressor 11 and the pumps 281 and 282 are started.

The flow of the refrigerant in the heat source-side refrigerant circuit A will be described. The low-temperature low-pressure vapor-state refrigerant is compressed by the compressor 11 and is discharged as the high-temperature high-pressure refrigerant. The refrigerant compression process of the compressor 11 is expressed by an isentropic curve as shown from the point a to b in FIG. 29. The high-temperature high-pressure refrigerant being discharged from the compressor 11 passes through the four-way valve 12, the fourth check valve 54, and the second extension piping 42 and flows into the third refrigerant branch portion 23. The high-temperature high-pressure refrigerant flowing into the third refrigerant branch portion 23 passes through the three-way valve 261, and flows into the intermediate heat exchanger 251. Then, the refrigerant is transformed into condensed liquid while dissipating heat to the water flowing in the intermediate heat exchanger 251, thereby becoming a high-pressure liquid-state refrigerant. The chance of the refrigerant at this time is expressed by a line slightly inclined but substantially horizontal as shown from the point b to c in FIG. 29.

The high-pressure liquid-state refrigerant flowing out from the intermediate heat exchanger 251 is restricted and then is expanded (decompressed) in the second refrigerant flow rate control device 271, and flows into the second refrigerant branch portion 22. The change of the refrigerant at this time is expressed by a vertical line as shown from the point c to d in FIG. 29.

Part of the high-pressure liquid-state refrigerant flowing from the intermediate heat exchanger 251 to the second refrigerant branch portion 22 flows into the second refrigerant flow rate control device 272. Then, the refrigerant is restricted and then is further expanded (decompressed) in the second refrigerant flow rate control device 272, thereby assuming a low-temperature low-pressure gas-liquid two-phase state. The change of the refrigerant at this time is expressed by a vertical line as shown from the point d to e in FIG. 29. The low-temperature low-pressure gas-liquid two-phase state refrigerant flowing out from the second refrigerant flow rate control device 272 flows into the intermediate heat exchanger 252. Then, the refrigerant absorbs heat from the water flowing in the intermediate heat exchanger 252, thereby becoming a low-temperature low-pressure vapor-state refrigerant. The change of the refrigerant at this time is expressed by a line slightly inclined but substantially horizontal as shown from the point e to f in FIG. 29. The low-temperature low-pressure vapor-state refrigerant flowing out from the intermediate heat exchanger 252 passes through the three-way valves 262 and flows into the first refrigerant branch portion 21.

Remaining part of the high-pressure liquid-state refrigerant flowing out from the intermediate heat exchanger 251 into the second refrigerant branch portion 22 flows into the third refrigerant flow rate control device 63. Then, the high-pressure liquid-state refrigerant is restricted and then is expanded (decompressed) in the third refrigerant flow rate control device 63, thereby assuming a low-temperature low-pressure gas-liquid two-phase state. The change of the refrigerant at this time is expressed by a vertical line as shown from the point d to g in FIG. 29. The low-temperature low-pressure gas-liquid two-phase state refrigerant flowing out from the third refrigerant flow rate control device 63 flows into the first refrigerant branch portion 21 (more specifically, the piping which connects the first refrigerant branch portion 21 and the first extension piping 41), and joins the low-temperature low-pressure vapor-state refrigerant flowing out from the intermediate heat exchanger 252 (point h).

The low-temperature low-pressure gas-liquid two-phase state refrigerant flowing out from the first refrigerant branch portion 21 passes through the first extension piping 41 and the third check valve 53 and flows into the outdoor heat exchanger 13. Then, the refrigerant absorbs heat from the outdoor air in the outdoor heat exchanger 13, thereby becoming a low-temperature low-pressure vapor-state refrigerant. The change of the refrigerant at this time is expressed by a line slightly inclined but substantially horizontal as shown from the point h to a in FIG. 29. The low-temperature low-pressure vapor-state refrigerant flowing out from the outdoor heat exchanger 13 flows into the compressor 11 through the four-way valve 12, and is compressed therein, thereby becoming a high-temperature high-pressure refrigerant.

Subsequently, the flow of the user-side refrigerant in the user-side refrigerant circuit B will be described.

The flow of the user-side refrigerant when causing the indoor units 301-303 to perform the heating operation will be described first, and then the flow of the user-side refrigerant when causing the indoor unit 304 to perform the cooling operation will be described.

The water heated by the heat source-side refrigerant in the intermediate heat exchanger 251 flows into the user-side refrigerant flow channel switching unit 80 by the pump 281. The water flowing into the user-side refrigerant flow channel switching unit 80 is branched, then passes through the third extension piping 431-433 connected respectively to the first switching valves 812-813, and flows into the indoor heat exchangers 311-313 of the indoor units 301-303. Then, the water dissipates heat into the indoor air in the indoor heat exchangers 311-313 to heat up the area to be air-conditioned in the room or the like where the indoor units 301-303 are installed. Subsequently, the water flowing out from the indoor heat exchangers 311-313 flows out from the indoor units 301-303, passes through the fourth extension piping 441-443, and flows into the user-side refrigerant flow channel switching unit 80 (the second switching valve 821 to the second switching valve 823). The water flowing into the second switching valve 821 to the second switching unit 823 joins in the user-side refrigerant flow channel switching unit 80, and then flows into the intermediate heat exchanger 251 again.

In contrast, the water cooled by the heat source-side refrigerant in the intermediate heat exchanger 252 flows into the user-side refrigerant flow channel switching unit 80 by the pump 282. The user-side refrigerant flowing into the user-side refrigerant flow channel switching unit 80 passes through the third extension piping 434 connected to the first switching valve 814 and flows into the indoor heat exchanger 314 of the indoor unit 304. Then, the refrigerant absorbs heat from the indoor air in the indoor heat exchanger 314 to cool down the area to be air-conditioned in the room or the like where the indoor unit 304 is installed. Subsequently, the water flowing out from the indoor heat exchanger 314 flows out from the indoor unit 304, passes through the fourth extension piping 444, and flows into the user-side refrigerant flow channel switching unit 80 (the second switching valve 824). The water flowing into the second switching valve 824 flows into the intermediate heat exchanger 252 again.

The air conditioning apparatus 1 configured in this manner achieves the same advantages as Embodiment 1. In addition, the number of the pumps 28*n* and the intermediate heat exchangers 25*n*, the flow rate and the pump head of the pumps 28*n*, the heat-exchange performance of the intermediate heat exchangers 25*n* can be determined irrespective of the number of the indoor units 30*n* or the cooling and heating performance of the individual indoor units 30*n*. Therefore, downsizing of the relay unit 20 is possible, and the high-efficiency pumps 82*n* and intermediate exchangers 25*n* can be used.

Also, the cooled or heated water can be supplied to the indoor units 30*n* using both the intermediate heat exchanger 251 and the intermediate heat exchanger 252 (a plurality of the intermediate heat exchangers 25*n*) at the time of the cooling operation and the heating operation, so that the efficiency of the air conditioning apparatus 1 is improved.

Although the three-way valves are provided as the first switching valves 811-814 and the second switching valves 821-824, which are the water flow channel switching valves, the first switching valves 811-814 and the second switching valves 821-824 may be made up of two each of the two-way valves.

Embodiment 6

Figure 30:
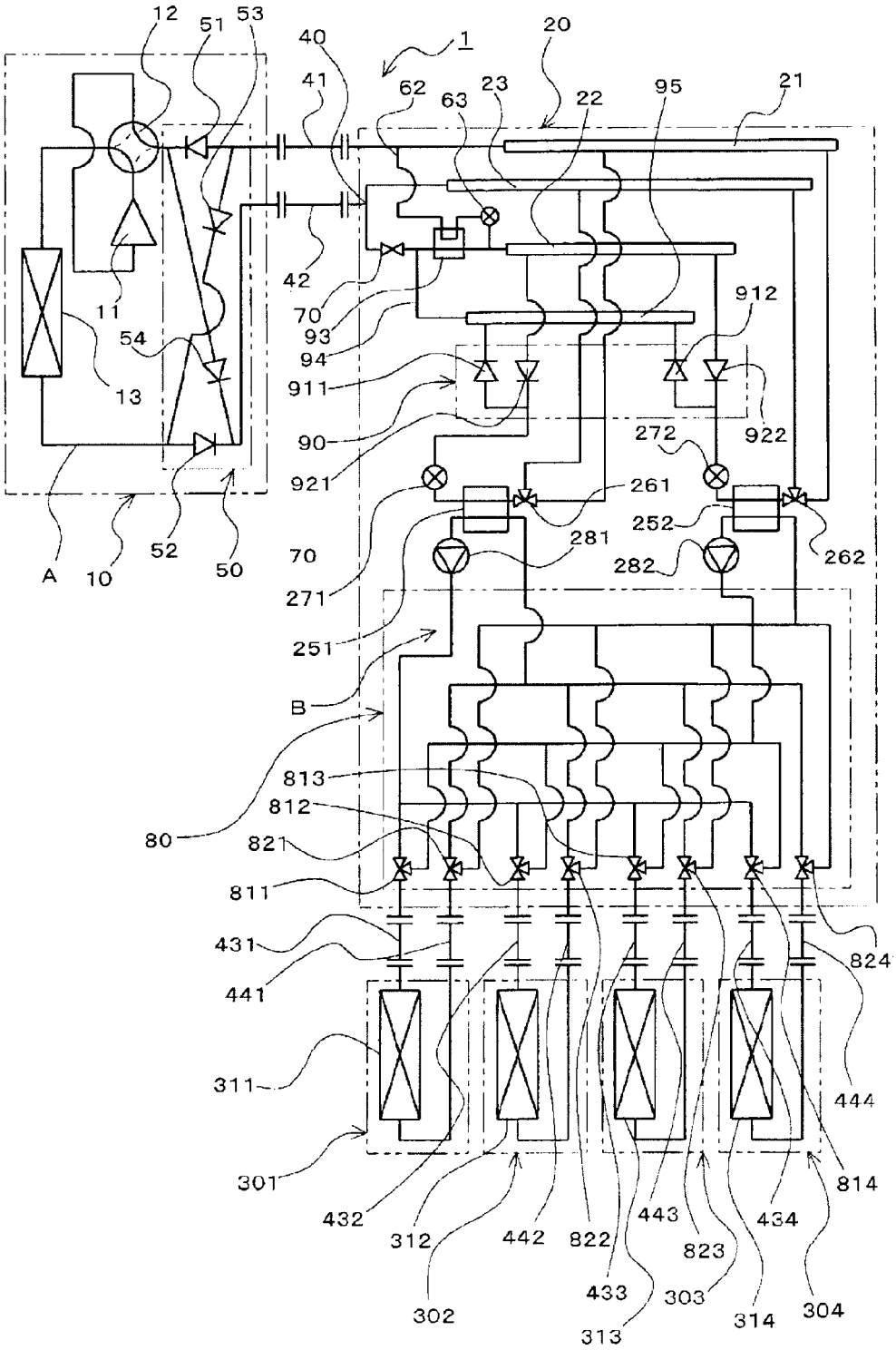
FIG. 30 is a refrigerant circuit diagram of the air conditioning apparatus according to Embodiment 6 in the present invention.

FIG. 30 is a refrigerant circuit diagram of the air conditioning apparatus according to Embodiment 6 in the present invention. The air conditioning apparatus 1 in this Embodiment includes a second refrigerant flow channel switching unit 90, a heat exchanger 93, a second bypass piping 94, and a fourth refrigerant branch portion 95 added to the configuration of the air conditioning apparatus 1 in Embodiment 5.

The heat exchanger 93 is provided between the opening and closing device 70 and the second refrigerant branch portion 22. The heat exchanger 93 is configured to cause the heat exchange between the heat source-side refrigerant flowing out from the opening and closing device 70 to the second refrigerant branch portion 22 and the heat source-side refrigerant flowing in the bypass piping 62. At this time, the bypass piping 62 is connected to a point between the heat exchanger 93 and the second refrigerant branch portion 22. The third refrigerant flow rate control device 63 is provided in the bypass piping 62 on the upstream side of the heat exchanger 93 with respect to the flow of the refrigerant.

A fourth refrigerant branch portion 95 is connected between the opening and closing device 70 and the heat exchanger 93 via the second bypass piping 94. The fourth refrigerant branch portion 95 and the second refrigerant branch portion 22 are connected respectively to the second refrigerant flow rate control devices 271 and 272 via the second refrigerant flow channel switching unit 90. More specifically, a plurality of fifth check valves 91*n* (two in Embodiment 6) and a plurality of sixth check valves 92*n* (two in Embodiment 6) are provided in the second refrigerant flow channel switching unit 90. Fifth check valves 911 and 912 are provided respectively in the piping which connects the fourth refrigerant branch portion 95 and the respective second refrigerant flow rate control devices 271 and 272, so that the heat source-side refrigerant flows only in the direction toward the fourth refrigerant branch portion 95. Sixth check valves 921 and 922 are provided respectively in the piping which connects the second refrigerant branch portion 22 and the respective second refrigerant flow rate control devices 271 and 272, so that the heat source-side refrigerant flows only in the directions toward the second refrigerant flow rate control devices 271 and 272.

(Operating Actions)

Subsequently, the operating actions of the air conditioning apparatus 1 in Embodiment 6 will be described. The operating actions of the air conditioning apparatus 1 include four modes; the cooling operation mode, the heating operation mode, the cooling-dominated operation mode, and the heating-dominated operation mode.

(Cooling Operation Mode)

First of all, the cooling operation mode will be described.

Figure 31:
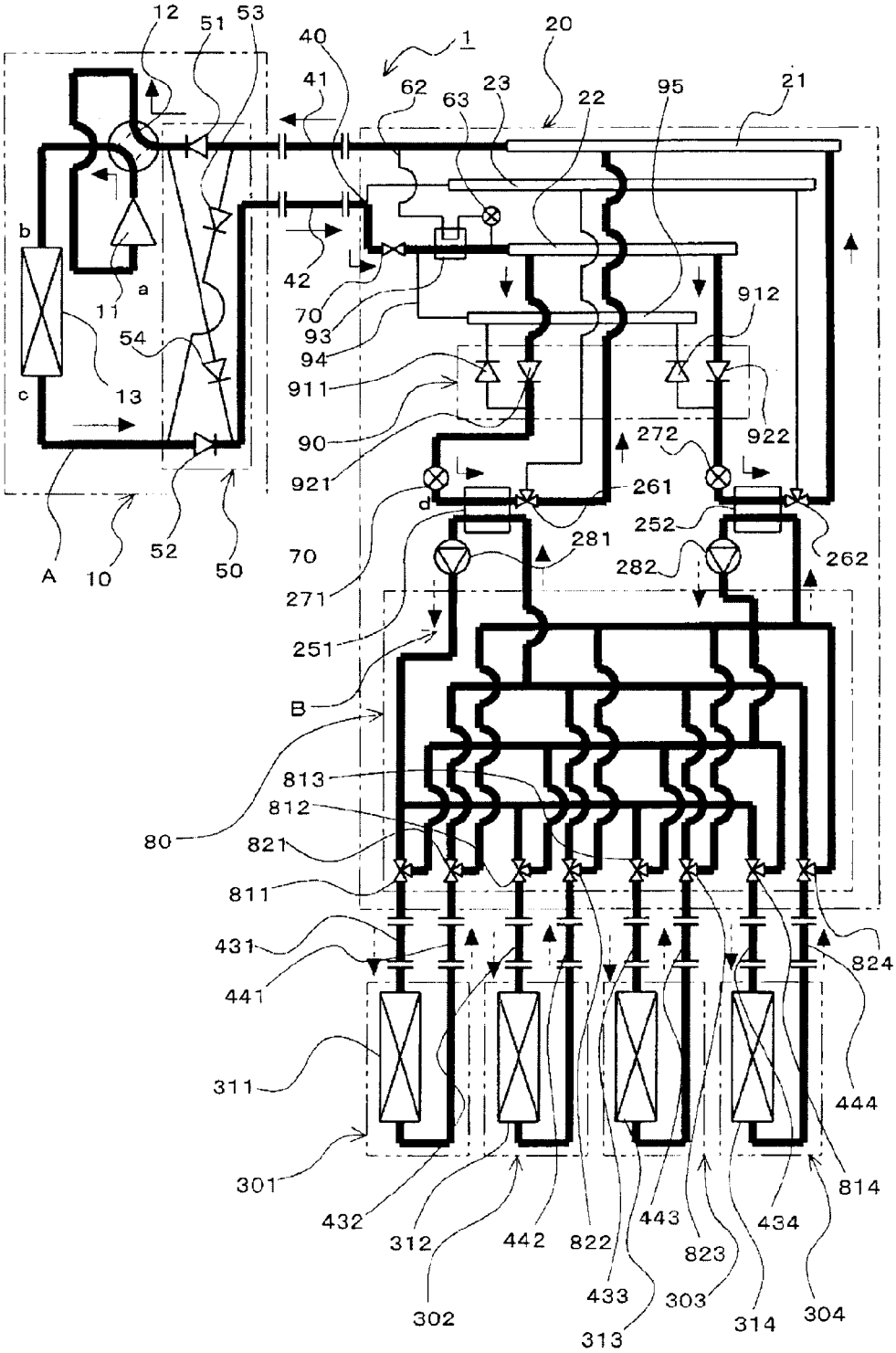
FIG. 31 is a refrigerant circuit diagram showing the flow of the refrigerant in a cooling operation mode of the air conditioning apparatus according to Embodiment 6 in the present invention.
Figure 32:
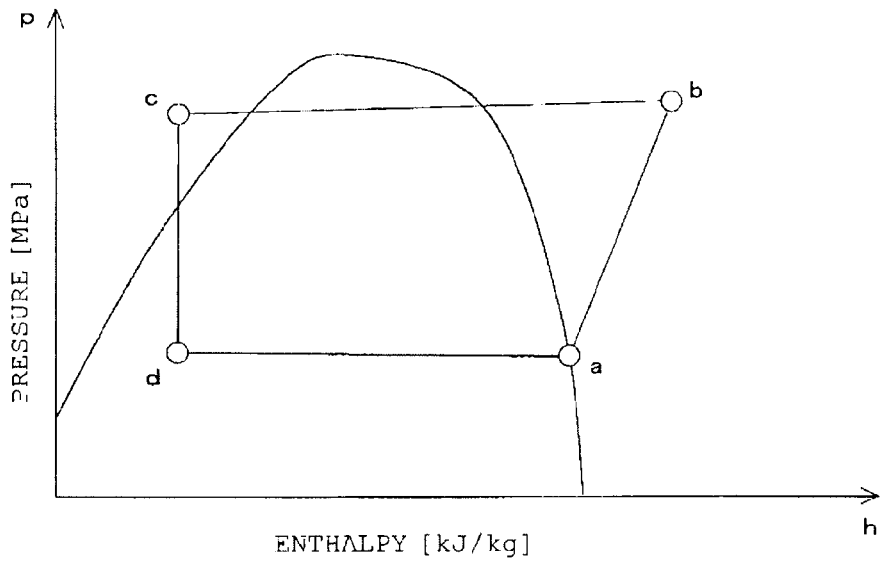
FIG. 32 is a p-h diagram showing the change of the heat source-side refrigerant in FIG. 31.

FIG. 31 is a refrigerant circuit diagram showing the flow of the refrigerant in the cooling operation mode of the air conditioning apparatus according to Embodiment 6 in the present invention. FIG. 32 is a p-h diagram showing the change of the heat source-side refrigerant in the cooling operation mode.

In FIG. 31, piping illustrated in thick lines indicates piping in which the refrigerant circulates. Then, the direction of flow of the heat source-side refrigerant is indicated by arrows of solid lines, and the direction of flow of water as the user-side refrigerant is indicated by arrows of broken lines. The states of refrigerant a-d shown in FIG. 32 indicate the states of the refrigerant at points indicated by reference signs a-d in FIG. 31, respectively.

When all the indoor units 301-304 perform the cooling operation, respective actions of the four-way valve 12, the three-way valves 261 and 262, the second refrigerant flow rate control devices 271 and 272, the opening and closing device 70, the third refrigerant flow rate control device 63, the first switching valves 811-814 and the second switching valves 821-824 of the user-side refrigerant flow channel switching unit 80, the compressor 11, and the pumps 281 and 282 are the same as the cooling operation mode in Embodiment 5, and hence description will be omitted.

The flow of the refrigerant in the heat source-side refrigerant circuit A will be described. The low-temperature low-pressure vapor-state refrigerant is compressed by the compressor 11 and is discharged as the high-temperature high-pressure refrigerant. The refrigerant compression process of the compressor 11 is expressed by an isentropic curve as shown from the point a to b in FIG. 32 on the assumption that heat entry and exit with respect to the periphery does not occur. The high-temperature high-pressure refrigerant being discharged from the compressor 11 passes through the four-way valve 12 and flows into the outdoor heat exchanger 13. Then, it is transformed into condensed liquid while dissipating heat to the outdoor air in the outdoor heat exchanger 13, thereby becoming a high-pressure liquid-state refrigerant. The change of the refrigerant in the outdoor heat exchanger 13 is performed under a substantially constant pressure. The change of the refrigerant at this time is expressed by a line slightly inclined but substantially horizontal as shown from the point b to c in FIG. 32 when considering the pressure loss of the outdoor heat exchanger 13.

The high-pressure liquid-state refrigerant flowing out from the outdoor heat exchanger 13 passes through the second check valve 52, the second extension piping 42, the opening and closing device 70, and the heat exchanger 93 and flows into the second refrigerant branch portion 22. The high-pressure liquid-state refrigerant flowing into the second refrigerant branch portion 22 is branched from the second refrigerant branch portion 22, passes through the sixth check valves 921 and 922, and flows into the second refrigerant flow rate control devices 271 and 272. Then, the high-pressure liquid-state refrigerant is restricted and then is expanded (decompressed) in the second refrigerant flow rate control devices 271 and 272, thereby assuming a low-temperature low-pressure gas-liquid two-phase state. The changes of the refrigerant in the second refrigerant flow rate control devices 271 and 272 are performed under a constant enthalpy. The change of the refrigerant at this time is expressed by a vertical line as shown from the point c to d in FIG. 32.

The low-temperature low-pressure gas-liquid two-phase state refrigerant flowing out from the second refrigerant flow rate control devices 271 and 272 flows into the intermediate heat exchangers 251 and 252, respectively. Then, the refrigerant absorbs heat from the water flowing in the intermediate heat exchangers 251 and 252, thereby becoming a low-temperature low-pressure vapor-state refrigerant. The changes of the heat source-side refrigerant in the intermediate heat exchangers 251 and 252 are performed under a substantially constant pressure. The change of the refrigerant at this time is expressed by a line slightly inclined but substantially horizontal as shown from the point d to a in FIG. 32 when considering the pressure loss of the intermediate heat exchangers 251 and 252.

The low-temperature low-pressure vapor-state refrigerant flowing out from the intermediate heat exchangers 251 and 252 passes through the three-way valves 261 and 262 respectively and flow into the first refrigerant branch portion 21. The low-temperature low-pressure vapor-state refrigerant joining in the first refrigerant branch portion 21 flows into the compressor 11 through the first extension piping 41, the first check valve 51, and the four-way valve 12, and is compressed therein.

Since the flow of the refrigerant in the user-side refrigerant circuit B is the same as the cooling operation mode in Embodiment 5, description will be omitted.

(Heating Operation Mode)

Subsequently, the heating operation mode will be described.

Figure 33:
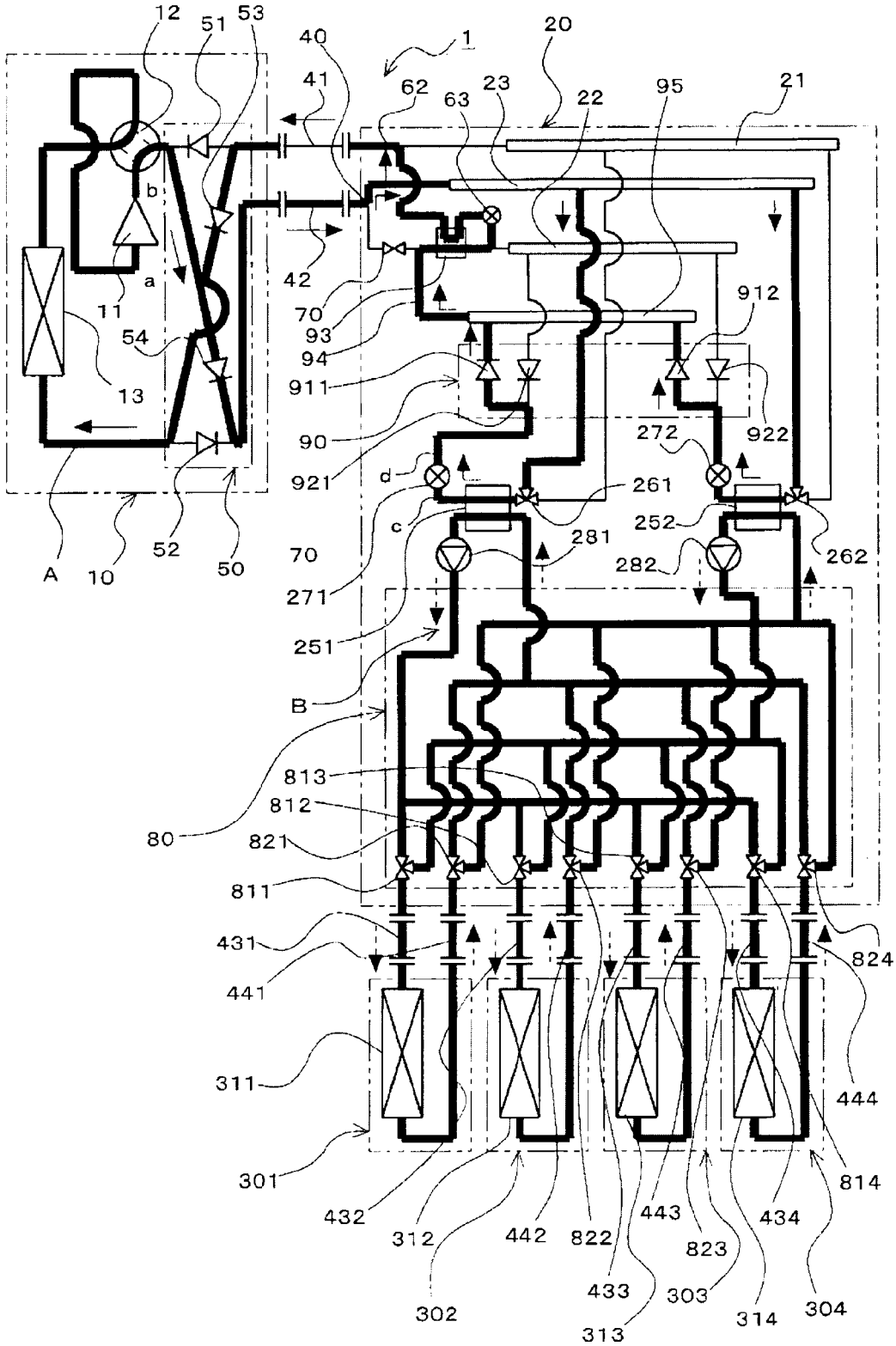
FIG. 33 is a refrigerant circuit diagram showing the flow of the refrigerant in a heating operation mode of the air conditioning apparatus according to Embodiment 6 in the present invention.
Figure 34:
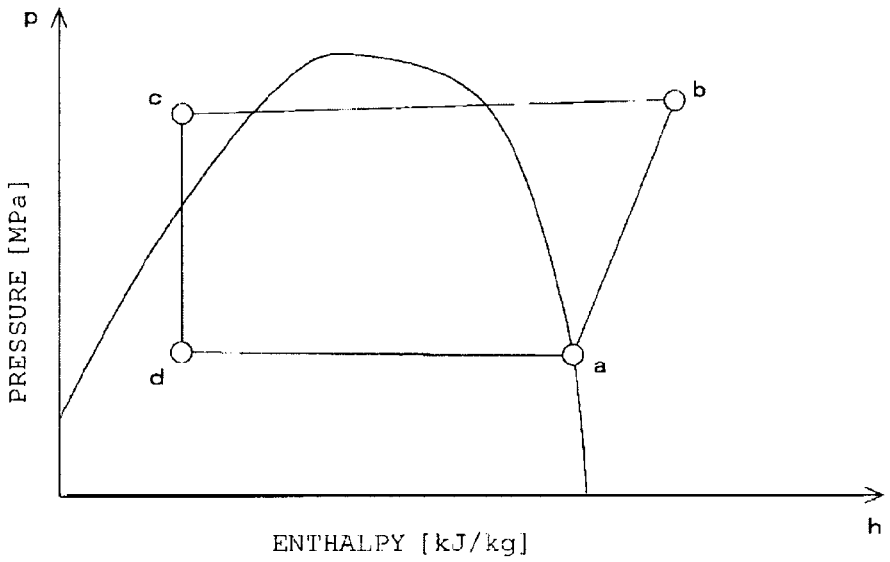
FIG. 34 is a p-h diagram showing the change of the heat source-side refrigerant in FIG. 33.

FIG. 33 is a refrigerant circuit diagram showing the flow of the refrigerant in the heating operation mode of the air conditioning apparatus according to Embodiment 6 in the present invention. FIG. 34 is a p-h diagram showing the change of the heat source-side refrigerant in the heating operation mode.

In FIG. 33, piping illustrated in thick lines indicates piping in which the refrigerant circulates. Then, the direction of flow of the heat source-side refrigerant is indicated by arrows of solid lines, and the direction of flow of water as the user-side refrigerant is indicated by arrows of broken lines. The states of refrigerant a-d shown in FIG. 34 indicate the states of the refrigerant at points indicated by reference signs a-d in FIG. 33, respectively.

When all the indoor units 301-304 perform the heating operation, respective actions of the four-way valve 12, the three-way valves 261 and 262, the second refrigerant flow rate control devices 271 and 272, the opening and closing device 70, the third refrigerant flow rate control device 63, the first switching valves 811-814 and the second switching valves 821-824 of the user-side refrigerant flow channel switching unit 80, the compressor 11, and the pumps 281 and 282 are the same as the heating operation mode in Embodiment 5, and hence description will be omitted.

The flow of the refrigerant in the heat source-side refrigerant circuit A will be described. The low-temperature low-pressure vapor-state refrigerant is compressed by the compressor 11 and is discharged as the high-temperature high-pressure refrigerant. The refrigerant compression process of the compressor 11 is expressed by an isentropic curve as shown from the point a to b in FIG. 34. The high-temperature high-pressure refrigerant being discharged from the compressor 11 passes through the four-way valve 12, the fourth check valve 54, and the second extension piping 42 and flows into the third refrigerant branch portion 23. The high-temperature high-pressure refrigerant flowing into the third refrigerant branch portion 23 is branched from the third refrigerant branch portion 23, passes through the three-way valves 261 and 262, respectively, and flows into the intermediate heat exchangers 251 and 252. Then, the refrigerant is transformed into condensed liquid while dissipating heat to the water flowing in the intermediate heat exchangers 251 and 252, thereby becoming a high-pressure liquid-state refrigerant. The change of the refrigerant at this time is expressed by a line slightly inclined but substantially horizontal as shown from the point b to c in FIG. 34.

The high-pressure liquid-state refrigerant flowing out from the intermediate heat exchangers 251 and 252 flows into the second refrigerant flow rate control devices 271 and 272. Then, the high-pressure liquid-state refrigerant is restricted and then is expanded (decompressed) in the second refrigerant flow rate control devices 271 and 272, thereby assuming a low-temperature low-pressure gas-liquid two-phase state. The change of the refrigerant at this time is expressed by a vertical line as shown from the point c to d in FIG. 34. The low-temperature low-pressure gas-liquid two-phase state refrigerant flowing out from the second refrigerant flow rate control devices 271 and 272 passes through the fifth check valves 911 and 912 and flows into the fourth refrigerant branch portion 95. The gas-liquid two-phase state refrigerant joining in the fourth refrigerant branch portion 95 passes through the second bypass piping 94, and flows into the heat exchanger 93. Then, the refrigerant passes through the bypass piping 62 and the third refrigerant flow rate control device 63 and flows into the first refrigerant branch portion 21 (more specifically, the piping which connects the first refrigerant branch portion 21 and the first extension piping 41).

The low-temperature low-pressure gas-liquid two-phase state refrigerant flowing into the first refrigerant branch portion 21 passes through the first extension piping 41 and the third check valve 53 and flows into the outdoor heat exchanger 13. Then, the low-temperature low-pressure gas-liquid two-phase state refrigerant flowing into the outdoor heat exchanger 13 absorbs heat from the outdoor air in the outdoor heat exchanger 13, thereby becoming a low-temperature low-pressure vapor-state refrigerant. The change of the refrigerant at this time is expressed by a line slightly inclined but substantially horizontal as shown from the point d to a in FIG. 34. The low-temperature low-pressure vapor-state refrigerant flowing out from the outdoor heat exchanger 13 flows into the compressor 11 through the four-way valve 12, and is compressed therein, thereby becoming a high-temperature high-pressure refrigerant. Since the flow of the refrigerant in the user-side refrigerant circuit B is the same as the heating operation mode in Embodiment 5, description will be omitted.

(Cooling-Dominated Operation Mode)

Subsequently, the cooling-dominated operation mode will be described.

Figure 35:
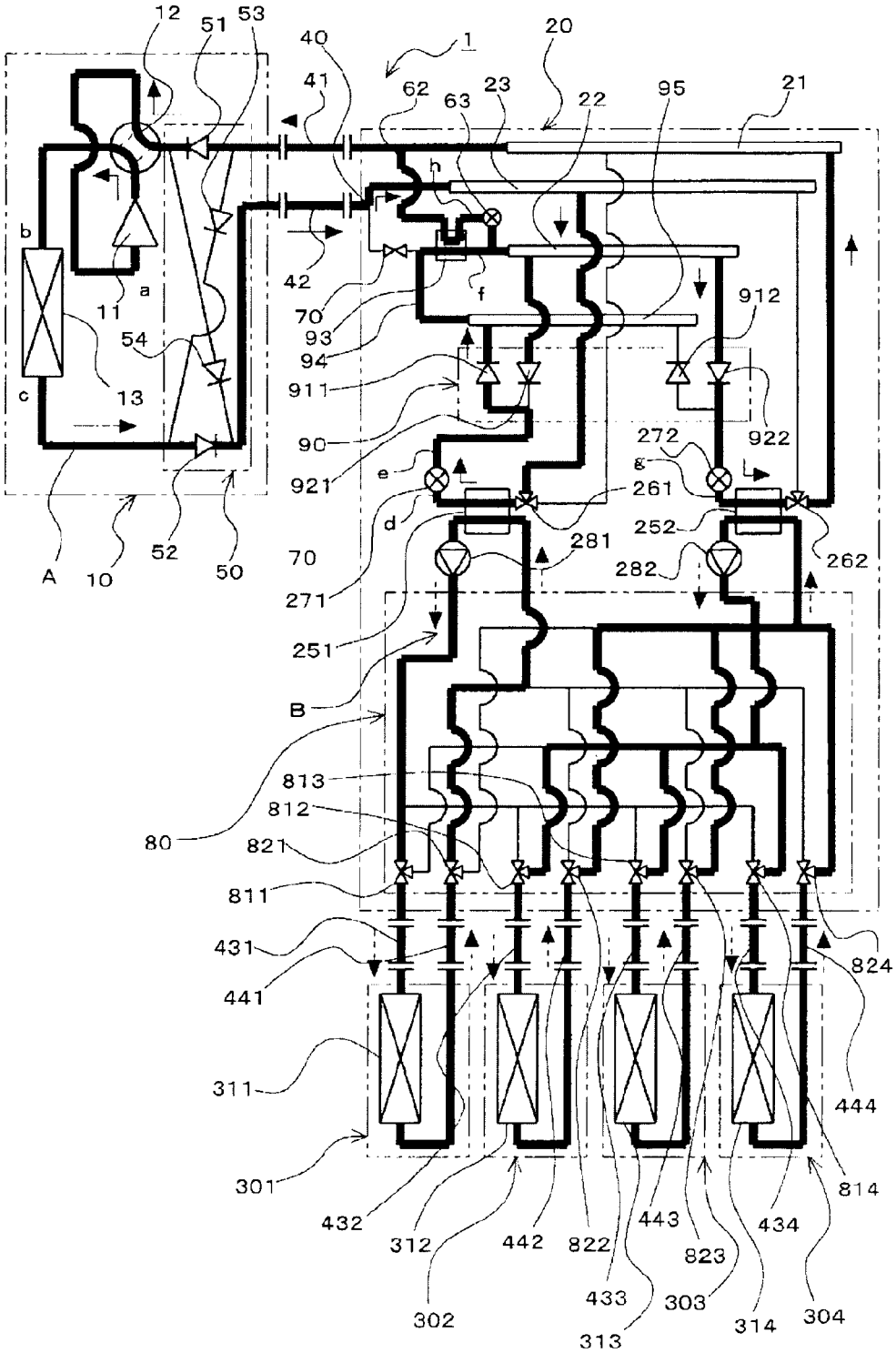
FIG. 35 is a refrigerant circuit diagram showing the flow of the refrigerant in a cooling-dominated operation mode of the air conditioning apparatus according to Embodiment 6 in the present invention.
Figure 36:
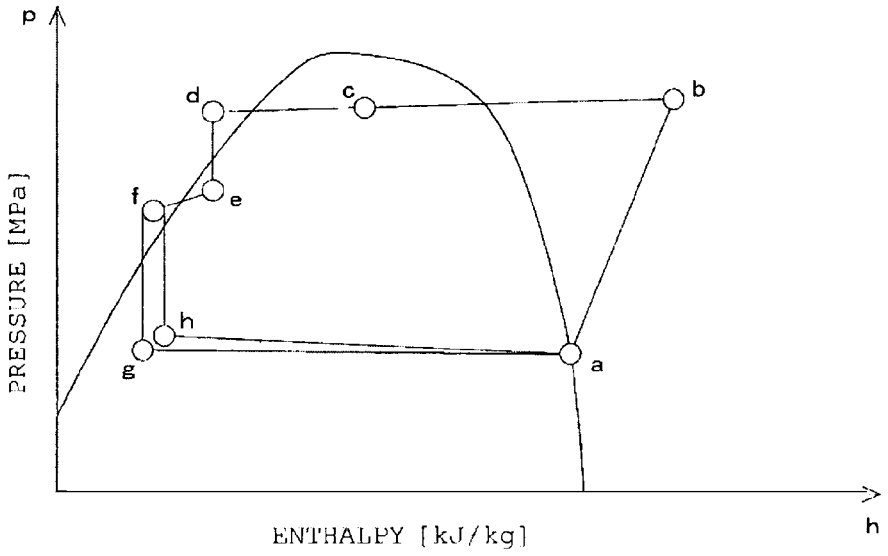
FIG. 36 is a p-h diagram showing the change of the heat source-side refrigerant in FIG. 35.

FIG. 35 is a refrigerant circuit diagram showing the flow of the refrigerant in the cooling-dominated operation mode of the air conditioning apparatus according to Embodiment 6 in the present invention. FIG. 36 is a p-h diagram showing the change of the heat source-side refrigerant in the cooling-dominated operation mode.

In FIG. 35, piping illustrated in thick lines indicates piping in which the refrigerant circulates. Then, the direction of flow of the heat source-side refrigerant is indicated by arrows of solid lines, and the direction of flow of water as the user-side refrigerant is indicated by arrows of broken lines. The states of refrigerant a-h shown in FIG. 36 indicate the states of the refrigerant at points indicated by reference signs a-h in FIG. 35, respectively.

When the indoor unit 301 performs the heating operation and the indoor units 302-304 perform the cooling operation, the degree of the opening of the third refrigerant flow rate control device 63 is restricted. The respective actions of the four-way valve 12, the three-way valves 261 and 262, the second refrigerant flow rate control devices 271 and 272, the opening and closing device 70, the first switching valves 811-814 and the second switching valves 821-824 of the user-side refrigerant flow channel switching unit 80, the compressor 11, and the pumps 281 and 282 are the same as the cooling-dominated operation mode in Embodiment 5, and hence description will be omitted.

The flow of the refrigerant in the heat source-side refrigerant circuit A will be described. The low-temperature low-pressure vapor-state refrigerant is compressed by the compressor 11 and is discharged as the high-temperature high-pressure refrigerant. The refrigerant compression process of the compressor 11 is expressed by an isentropic curve as shown from the point a to b in FIG. 36. The high-temperature high-pressure refrigerant being discharged from the compressor 11 passes through the four-way valve 12 and flows into the outdoor heat exchanger 13. Then, the refrigerant condenses while dissipating heat to the outdoor air in the outdoor heat exchanger 13, thereby becoming a high-pressure gas-liquid two-phase state refrigerant. The change of the refrigerant at this time is expressed by a line slightly inclined but substantially horizontal as shown from the point b to c in FIG. 36.

The high-pressure gas-liquid two-phase refrigerant flowing out from the outdoor heat exchanger 13 passes through the second check valve 52 and the second extension piping 42 and flows into the third refrigerant branch portion 23. The high-pressure gas-liquid two-phase state refrigerant flowing into the third refrigerant branch portion 23 passes through the three-way valve 261, and flows into the intermediate heat exchanger 251. Then, the refrigerant condenses while dissipating heat to the water flowing in the intermediate heat exchanger 251, thereby becoming a liquid-state refrigerant. The change of the refrigerant at this time is expressed by a line slightly inclined but substantially horizontal as shown from the point c to d in FIG. 36. The refrigerant flowing out from the intermediate heat exchanger 251 is restricted and expanded (decompressed) in the second refrigerant flow rate control device 271, thereby changing into a gas-liquid two-phase state refrigerant. The change of the refrigerant at this time is expressed by a vertical line as shown from the point d to e in FIG. 36.

The gas-liquid two-phase state refrigerant flowing out from the second refrigerant flow rate control device 271 passes through the fifth check valve 911 and flows into the fourth refrigerant branch portion 95. The gas-liquid two-phase state refrigerant flowing into the fourth refrigerant branch portion 95 passes through the second bypass piping 94 and flows into the heat exchanger 93. Then, the refrigerant is cooled by the low-temperature low-pressure refrigerant flowing in the bypass piping 62, thereby changing into a liquid-state refrigerant. The change of the refrigerant at this time is expressed by a line slightly inclined but substantially horizontal as shown from the point e to f in FIG. 36.

Part of the liquid-state refrigerant flowing out from the heat exchanger 93 flows into the bypass piping 62 and is decompressed in the third refrigerant flow rate control device 63, thereby changing into a low-temperature low-pressure gas-liquid two-phase state refrigerant. The change of the refrigerant at this time is expressed by a vertical line as shown from the point f to h in FIG. 36. This refrigerant flows into the heat exchanger 93. Then, this refrigerant is heated by the refrigerant flowing from the second bypass piping 94 and is evaporated, thereby changing into a low-temperature low-pressure vapor-state refrigerant. The change of the refrigerant at this time is expressed by a line slightly inclined but substantially horizontal as shown from the point h to the point a in FIG. 36.

In contrast, remaining refrigerant which does not flow into the bypass piping 62 flows into the second refrigerant branch portion 22. The refrigerant flowing into the second refrigerant branch portion 22 passes through the sixth check valve 922 and flows into the second refrigerant flow rate control device 272. Then, the refrigerant is further restricted and then is expanded (decompressed) in the second refrigerant flow rate control device 272, thereby assuming a low-temperature low-pressure gas-liquid two-phase state. The change of the refrigerant at this time is expressed by a vertical line as shown from the point f to g in FIG. 36. The low-temperature low-pressure vapor-state refrigerant flowing out from the intermediate heat exchanger 252 passes through the three-way valves 262 and flows into the first refrigerant branch portion 21. The low-temperature low-pressure vapor-state refrigerant flowing into the first refrigerant branch portion 21 joins the refrigerant flowing in the bypass piping 62. Then, the joining refrigerant flows into the compressor 11 through the first extension piping 41, the first check valve 51, and the four-way valve 12, and is compressed therein. Since the flow of the user-side refrigerant in the user-side refrigerant circuit B is the same as the cooling-dominant operating mode in Embodiment 5, description will be omitted.

(Heating-Dominated Operation Mode)

Subsequently, the heating-dominated operation mode will be described.

Figure 38:
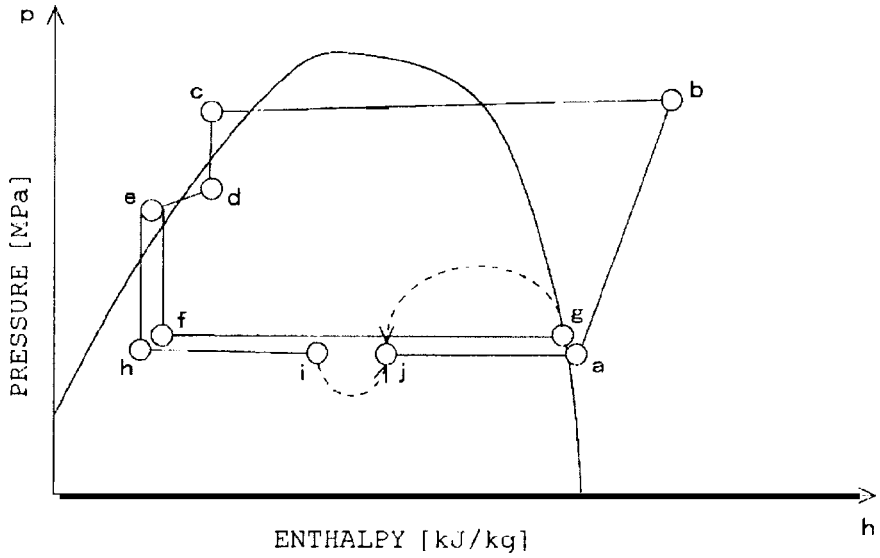
FIG. 38 is a p-h diagram showing the change of the heat source-side refrigerant in FIG. 37.

FIG. 37 is a refrigerant circuit diagram showing the flow of the refrigerant in the heating-dominated operation mode of the air conditioning apparatus according to Embodiment 5 in the present invention. FIG. 38 is a p-h diagram showing the change of the heat source-side refrigerant in the heating operation mode.

In FIG. 37, piping illustrated in thick lines indicates piping in which the refrigerant circulates. Then, the direction of flow of the heat source-side refrigerant is indicated by arrows of solid lines, and the direction of flow of water as the user-side refrigerant is indicated by arrows of broken lines. The states of refrigerant a-j shown in FIG. 38 indicate the states of the refrigerant at points indicated by reference signs a-j in FIG. 37, respectively.

A case where the indoor units 301-303 perform the heating operation and the indoor unit 304 performs the cooling operation will be described. The respective actions of the four-way valve 12, the three-way valves 261 and 262, the second refrigerant flow rate control devices 271 and 272, the opening and closing device 70, the third refrigerant flow rate control device 63, the first switching valves 811-814 and the second switching valves 821-824 of the user-side refrigerant flow channel switching unit 80, the compressor 11, and the pumps 281 and 282 are the same as those in the cooling-dominated operation mode in Embodiment 5, and hence description will be omitted.

The flow of the refrigerant in the heat source-side refrigerant circuit A will be described. The low-temperature low-pressure vapor-state refrigerant is compressed by the compressor 11 and is discharged as the high-temperature high-pressure refrigerant. The refrigerant compression process of the compressor 11 is expressed by an isentropic curve as shown from the point a to b in FIG. 38. The high-temperature high-pressure refrigerant being discharged from the compressor 11 passes through the four-way valve 12, the fourth check valve 54, and the second extension piping 42 and flows into the third refrigerant branch portion 23. The refrigerant flowing into the third refrigerant branch portion 23 passes through the three-way valve 261, and flows into the intermediate heat exchanger 251. Then, the refrigerant condenses while dissipating heat to the water flowing in the intermediate heat exchanger 251, thereby becoming a liquid-state refrigerant. The change of the refrigerant at this time is expressed by a line slightly inclined but substantially horizontal as shown from the point b to c in FIG. 38.

The refrigerant flowing out from the intermediate heat exchanger 251 is restricted and expanded (decompressed) in the second refrigerant flow rate control device 271, thereby changing into a gas-liquid two-phase state refrigerant. The change of the refrigerant at this time is expressed by a vertical line as shown from the point c to d in FIG. 38. The gas-liquid two-phase state refrigerant flowing out from the second refrigerant flow rate control device 271 passes through the fifth check valve 911 and flows into the fourth refrigerant branch portion 95. The gas-liquid two-phase state refrigerant flowing into the fourth refrigerant branch portion 95 passes through the second bypass piping 94 and flows into the heat exchanger 93. Then, the refrigerant is cooled by the low-temperature low-pressure refrigerant flowing in the bypass piping 62, thereby changing into a liquid-state refrigerant. The change of the refrigerant at this time is expressed by a line slightly inclined but substantially horizontal as shown from the point d to e in FIG. 38.

Part of the liquid-state refrigerant flowing out from the heat exchanger 93 flows into the bypass piping 62, and is decompressed in the third refrigerant flow rate control device 63, thereby changing into a low-temperature low-pressure gas-liquid two-phase state refrigerant. The change of the refrigerant at this time is expressed by a vertical line as shown from the point e to the point h in FIG. 38. This refrigerant flows into the heat exchanger 93. Then, this refrigerant is heated by the refrigerant flowing from the second bypass piping 94 and is evaporated, thereby becoming a gas-liquid two-phase state refrigerant with high degree of dryness. The change of the refrigerant at this time is expressed by a line slightly inclined but substantially horizontal as shown from the point h to the point i in FIG. 38.

In contrast, remaining refrigerant which does not flow into the bypass piping flows into the second refrigerant branch portion 22. The refrigerant flowing into the second refrigerant branch portion 22 passes through the sixth check valve 922 and flows into the second refrigerant flow rate control device 272. Then, the refrigerant is further restricted and then is expanded (decompressed) in the second refrigerant flow rate control device 272, thereby assuming a low-temperature low-pressure gas-liquid two-phase state. The change of the refrigerant at this time is expressed by a vertical line as shown from the point e to f in FIG. 38. The low-temperature low-pressure gas-liquid two-phase state refrigerant flowing out from the second refrigerant flow rate control device 272 flows into the intermediate heat exchanger 252. Then, the refrigerant absorbs heat from the water flowing in the intermediate heat exchanger 252, thereby becoming a low-temperature low-pressure vapor-state refrigerant. The change of the refrigerant at this time is expressed by a line slightly inclined but substantially horizontal as shown from the point f to g in FIG. 38. The low-temperature low-pressure vapor-state refrigerant flowing out from the intermediate heat exchanger 252 passes through the three-way valves 262 and flows into the first refrigerant branch portion 21. The low-temperature low-pressure vapor-state refrigerant flowing into the first refrigerant branch portion 21 joins the refrigerant flowing from the bypass piping 62, thereby changing into a gas-liquid two-phase state refrigerant (point j).

The low-temperature low-pressure gas-liquid two-phase state refrigerant flowing out from the first refrigerant branch portion 21 passes through the first extension piping 41 and the third check valve 53 and flows into the outdoor heat exchanger 13. Then, the refrigerant absorbs heat from the outdoor air in the outdoor heat exchanger 13, thereby becoming a low-temperature low-pressure vapor-state refrigerant. The change of the refrigerant at this time is expressed by a line slightly inclined but substantially horizontal as shown from the point j to a in FIG. 38. The low-temperature low-pressure vapor-state refrigerant flowing out from the outdoor heat exchanger 13 flows into the compressor 11 through the four-way valve 12, and is compressed therein, thereby becoming a high-temperature high-pressure refrigerant.

Since the flow of the user-side refrigerant in the user-side refrigerant circuit B is the same as that in Embodiment 5, description will be omitted.

According to the air conditioning apparatus 1 configured in this manner, the same advantages as in Embodiment 5 can be obtained. Furthermore, in the cooling-dominated operation and the heating-dominated operation, the heat source-side refrigerant flowing out from the intermediate heat exchanger 251 flows into the second refrigerant flow rate control device 272 after having changed into the liquid-state refrigerant. More specifically, the heat source-side refrigerant flowing out from the intermediate heat exchanger 251 is decompressed (expanded) in the second refrigerant flow rate control device 271, passes through the fifth check valve 911, the fourth refrigerant branch portion 95, and the second bypass piping 94, and flows into the heat exchanger 93. Then, the refrigerant is cooled by the low-temperature low-pressure gas-liquid two-phase state refrigerant flowing in the bypass piping 62, thereby changing into a liquid-state refrigerant, and flows into the second refrigerant flow rate control device 272. Accordingly, the gas-liquid two-phase state refrigerant can be prevented from flowing into the second refrigerant flow rate control device 272. Therefore, in the second refrigerant flow rate control device 272, the refrigerant can be decompressed without causing pressure vibrations which are generated when the gas-liquid two-phase state refrigerant flows in, so that the state of the refrigerant is stabilized. In other words, the advantages such that the piping vibrations and noise can be reduced are achieved.

The invention claimed is:

1. An air conditioning apparatus comprising:

a heat source-side refrigerant circuit, the heat source-side refrigerant circuit including: an outdoor heat exchanger connected at one end thereof to an end of a compressor; a first refrigerant branch portion connected to the other end of said compressor; a second refrigerant branch portion and a third refrigerant branch portion connected to the other end of said outdoor heat exchanger via branch piping; a first refrigerant flow rate control device configured to control the flow rate of a heat source-side refrigerant flowing in said second refrigerant branch portion; a plurality of intermediate heat exchangers each connected at one end thereof to said first refrigerant branch portion and said third refrigerant branch portion via a first refrigerant flow channel switching device, and connected at the other end thereof to said second refrigerant branch portion; and a plurality of second refrigerant flow rate control devices configured to control the flow rate of said heat source-side refrigerant flowing between the respective intermediate heat exchangers and said second refrigerant branch portion; and a plurality of user-side refrigerant circuits each including: a circulating device connected at one end of a user-side circuit configured to perform heat exchange with said heat source-side refrigerant circuit of one of said intermediate heat exchangers; and at least one indoor heat exchanger connected at one end thereof to said circulating device and connected at the other end thereof to the other end of said user-side circuit of said one of said intermediate heat exchangers, wherein said compressor and said outdoor heat exchanger are provided in an outdoor unit, said first refrigerant branch portion, said branch piping, said second refrigerant branch portion, said third refrigerant branch portion, said first refrigerant flow rate control device, said intermediate heat exchanger, said first refrigerant flow channel switching device, said second refrigerant flow rate control device, and said circulating device are provided in a relay unit, said indoor heat exchanger is provided in an indoor unit; and at least one of water and an antifreeze solution as the user-side refrigerant circulates in at least one of said plurality of user-side refrigerant circuits, wherein each of said user-side refrigerant circuits includes a user-side refrigerant flow path portion installed between said plurality of indoor heat exchangers and said plurality of intermediate heat exchangers, wherein said user-side refrigerant flow path portion includes a fluid flow switch that switches the connection of the intermediate heat exchangers to said plurality of indoor heat exchangers so as to fluidically connect said intermediate heat exchangers with at least any of said plurality of indoor heat exchangers.

2. The air conditioning apparatus of claim 1, wherein said outdoor unit includes a second refrigerant flow channel switching device configured to switch said heat source-side refrigerant circuit between a circuit which allows said heat source-side refrigerant being discharged by said compressor to flow into said first refrigerant branch portion and to flow out from said outdoor heat exchanger and a circuit which allows said heat source-side refrigerant being discharged by said compressor to flow into said outdoor heat exchanger and to flow out from said first refrigerant branch portion.

3. The air conditioning apparatus of claim 2, wherein said outdoor unit includes:

a third refrigerant flow channel switching device having: a first check valve provided between said second refrigerant flow channel switching device and said first refrigerant branch portion to allow said heat source-side refrigerant to flow only in the direction of said second refrigerant flow channel switching device; a second check valve provided between said outdoor heat exchanger and said branch piping to allow said heat source-side refrigerant to flow only in the direction of said branch piping; a third check valve provided in piping which connects an inlet side of said first check valve and an inlet side of said second check valve to allow said heat source-side refrigerant to flow only on the inlet side of said second check valve; and a fourth check valve provided in piping which connects an outlet side of said first check valve and an outlet side of said second check valve to allow said heat source-side refrigerant to flow only on the outlet side of said second check valve, and said relay unit includes:

bypass piping configured to connect said first refrigerant branch portion and said second refrigerant branch portion; and a third refrigerant flow rate control device provided in the bypass piping.

4. The air conditioning apparatus of claim 3, wherein said branch piping is provided with a gas-liquid separating device configured to separate said heat source-side refrigerant into a liquid-state refrigerant and a vapor-state refrigerant, said liquid-state refrigerant flows into said second refrigerant branch portion, and said vapor refrigerant flows into said third refrigerant branch portion.

5. The air conditioning apparatus of claim 1, wherein said user-side refrigerant circuit is provided with a fourth refrigerant flow rate control device configured to control the flow rate of said user-side refrigerant.

6. The air conditioning apparatus of claim 5, wherein said fourth refrigerant flow rate control device controls the flow rate of said user-side refrigerant on the basis of the temperature of said user-side refrigerant flowing into said indoor heat exchanger and the temperature of said user-side refrigerant flowing out from said indoor heat exchanger.

7. The air conditioning apparatus of claim 5, wherein said fourth refrigerant flow rate control device is provided in said relay unit.

8. The air conditioning apparatus of claim 1, wherein said relay unit and said indoor unit are able to be separated by piping which connects said circulating device and said indoor heat exchanger and a connecting device connecting said indoor heat exchanger and said intermediate heat exchanger.

9. The air conditioning apparatus of claim 1, wherein said heat source-side refrigerant is a natural refrigerant or a refrigerant having a global warming coefficient smaller than that of a fluorocarbons refrigerant.

10. The air conditioning apparatus of claim 1, wherein said heat source-side refrigerant heats said second refrigerant without condensing in a supercritical state in said intermediate heat exchanger.

11. The air conditioning of claim 1, wherein said indoor unit using at least one of the water and the antifreeze solution as said user-side refrigerant is installed in a living space provided on respective floors in a building, and said outdoor unit and said relay unit are installed outside of said living spaces.

12. The air conditioning apparatus of claim 11, further comprising a plurality of said relay units installed in shared spaces provided on the respective floors in said building.

13. An air conditioning apparatus of claim 1 comprising: a heat exchanger provided between said first refrigerant flow rate control device and said second refrigerant branch portion; first bypass piping whose one end is connected between the heat exchanger and said second refrigerant branch portion and whose the other end is connected with said first refrigerant branch portion via the heat exchanger; and a third refrigerant flow rate control device provided between said heat exchanger of said first bypass piping and said second refrigerant branch portion.

14. An air conditioning apparatus of claim 1 comprising: a second bypass piping whose one end is connected between said first refrigerant flow rate control device and said heat exchanger; and a fourth refrigerant branch portion to which the other end of said second bypass piping is connected, wherein said fourth refrigerant branch portion and said second refrigerant branch portion are connected with the second refrigerant flow rate control device via the second refrigerant flow path switch portion.

15. The air-conditioning apparatus of multi-chamber type of claim 1, wherein the heat source side refrigerant is a refrigerant whose permissible concentration of the refrigerant which leaks into the space is determined in an international standards, at least either water or anti-freezing fluid is used for the user-side refrigerant, the indoor units are installed in living space, the outdoor unit and the relay unit are installed outside the living space, and the relay unit and each indoor heat exchanger are connected with two pipes, wherein the apparatus is operable heating and cooling operations at the same time.

16. An air conditioning apparatus comprising: a heat source-side refrigerant circuit, the heat source-side refrigerant circuit including: an outdoor heat exchanger connected at one end thereof to an end of a compressor; a first refrigerant branch portion connected to the other end of said compressor; a second refrigerant branch portion and a third refrigerant branch portion connected to the other end of said outdoor heat exchanger via branch piping; a first refrigerant flow rate control device configured to control the flow rate of a heat source-side refrigerant flowing in said second refrigerant branch portion; a plurality of intermediate heat exchangers each connected at one end thereof to said first refrigerant branch portion and said third refrigerant branch portion via a first refrigerant flow channel switching device, and connected at the other end thereof to said second refrigerant branch portion; and a plurality of second refrigerant flow rate control devices configured to control the flow rate of said heat source-side refrigerant flowing between the respective intermediate heat exchangers and said second refrigerant branch portion; and a user-side refrigerant circuit including: a plurality of indoor heat exchangers; a first switching valve to which one end of said indoor heat exchanger is connected corresponded to each said plurality of indoor heat exchangers; and a second switching valve to which the other end of said indoor heat exchanger is connected, and in said user-side refrigerant circuit, one end of a user-side circuit performing heat exchange with said heat-source side refrigerant circuit of said intermediate heat exchanger is branched to be connected with said plurality of first switching valves and the other end is branched to be connected with said plurality of second switching valves, and wherein said compressor and said outdoor heat exchanger are provided in an outdoor unit, said first refrigerant branch portion, said branch piping, said second refrigerant branch portion, said third refrigerant branch portion, said first refrigerant flow rate control device, said intermediate heat exchanger, said first refrigerant flow channel switching device, said second refrigerant flow rate control device, and said circulating device are provided in a relay unit, said indoor heat exchanger is provided in an indoor unit; and in said user-side refrigerant circuit, at least one of water and an antifreeze solution as the user-side refrigerant circulates.

* * * * *